US011370640B2

(12) United States Patent
Hida et al.

(10) Patent No.: US 11,370,640 B2
(45) Date of Patent: Jun. 28, 2022

(54) ELEVATOR, SUSPENSION BODY FOR THE ELEVATOR, AND MANUFACTURING METHOD FOR THE SUSPENSION BODY

(71) Applicant: Mitsubishi Electric Corporation, Tokyo (JP)

(72) Inventors: Masahiko Hida, Tokyo (JP); Michihito Matsumoto, Tokyo (JP); Haruhiko Kakutani, Tokyo (JP); Rikio Kondo, Tokyo (JP); Shinya Naito, Tokyo (JP); Naoya Tanaka, Tokyo (JP); Masaya Sera, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 337 days.

(21) Appl. No.: 16/604,584

(22) PCT Filed: Apr. 26, 2018

(86) PCT No.: PCT/JP2018/017047

§ 371 (c)(1),
(2) Date: Oct. 11, 2019

(87) PCT Pub. No.: WO2018/199256

PCT Pub. Date: Nov. 1, 2018

(65) Prior Publication Data

US 2020/0122971 A1 Apr. 23, 2020

(30) Foreign Application Priority Data

Apr. 26, 2017 (WO) ..... PCT/JP2017/016598

(51) Int. Cl.
*B66B 7/06* (2006.01)
*B66B 9/00* (2006.01)
(Continued)

(52) U.S. Cl.
CPC ..... *B66B 7/062* (2013.01); *B66B 9/00* (2013.01); *D07B 1/16* (2013.01); *D07B 1/22* (2013.01);
(Continued)

(58) Field of Classification Search
CPC .. B66B 7/062; B66B 9/00; D07B 1/16; D07B 1/22; D07B 2205/205; D07B 2205/2096;
(Continued)

(56) References Cited

U.S. PATENT DOCUMENTS 2,237,173 A * 4/1941 Brill ..... B65G 15/34 428/126
6,695,098 B1 * 2/2004 Henley ..... B66B 7/08 187/411
(Continued)

FOREIGN PATENT DOCUMENTS

CN 102002872 A 4/2011
CN 102110491 A 6/2011
(Continued)

OTHER PUBLICATIONS

International Search Report and Written Opinion dated Jul. 24, 2018 for PCT/JP2018/017047 filed on Apr. 26, 2018, 12 pages including English Translation of the International Search Report.
(Continued)

*Primary Examiner* — Michael A Riegelman
(74) *Attorney, Agent, or Firm* — Xsensus LLP

(57) ABSTRACT

A suspension body for an elevator includes a core having a belt-like shape, and a covering layer covering at least a part of an outer periphery of the core. The core includes a load bearing layer. The load bearing layer is formed of an impregnation resin and a plurality of high-strength fibers. Further, the load bearing layer is divided into a plurality of segment layers arranged apart from each other in a thickness
(Continued)

direction of the core. An intermediate layer made of a material different from that for the load bearing layer is interposed between the segment layers adjacent to each other in the thickness direction of the core.

16 Claims, 67 Drawing Sheets

(51) Int. Cl.
*D07B 1/16* (2006.01)
*D07B 1/22* (2006.01)

(52) U.S. Cl.
CPC ..... *D07B 2205/205* (2013.01); *D07B 2205/2096* (2013.01); *D07B 2205/3003* (2013.01); *D07B 2205/3007* (2013.01); *D07B 2501/2007* (2013.01)

(58) Field of Classification Search
CPC .... D07B 2205/3003; D07B 2205/3007; D07B 2501/2007
See application file for complete search history.

(56) References Cited

U.S. PATENT DOCUMENTS

| | | | | |
|---|---|---|---|---|
| 9,550,653 | B2 * | 1/2017 | Wesson | B66B 7/06 |
| 9,944,493 | B2 * | 4/2018 | Dudde | D07B 5/006 |
| 10,160,620 | B2 * | 12/2018 | Mosher | D07B 5/005 |
| 11,117,784 | B2 * | 9/2021 | Zhao | D07B 1/165 |
| 11,279,594 | B2 * | 3/2022 | Yu | B66B 11/024 |
| 2004/0206579 | A1 * | 10/2004 | Baranda | B66B 11/004 187/254 |
| 2011/0000074 | A1 * | 1/2011 | Sakai | F16G 5/16 29/281.1 |
| 2011/0259677 | A1 * | 10/2011 | Dudde | D07B 1/145 187/411 |
| 2012/0195733 | A1 * | 8/2012 | Bruch | B66B 7/062 427/407.1 |
| 2014/0004298 | A1 * | 1/2014 | Reif | B29D 29/00 428/113 |
| 2014/0076669 | A1 * | 3/2014 | Wesson | D02G 3/32 187/254 |
| 2014/0318902 | A1 * | 10/2014 | Pelto-Huikko | B66B 7/062 156/73.2 |
| 2016/0318737 | A1 * | 11/2016 | Joki | B66B 11/043 |
| 2017/0036891 | A1 * | 2/2017 | Lehtinen | B66B 7/085 |
| 2017/0043979 | A1 * | 2/2017 | Kucharczyk | B66B 7/062 |
| 2017/0159236 | A1 * | 6/2017 | Lehtinen | D07B 7/145 |
| 2017/0217729 | A1 * | 8/2017 | Lehtinen | D07B 1/22 |
| 2018/0022578 | A1 * | 1/2018 | Mosher | B66B 9/00 187/254 |
| 2019/0301088 | A1 * | 10/2019 | Dudde | F16G 9/04 |
| 2019/0315596 | A1 * | 10/2019 | Sera | B66B 7/062 |
| 2020/0122971 | A1 * | 4/2020 | Hida | B66B 9/00 |
| 2021/0198081 | A1 * | 7/2021 | Hida | B66B 9/00 |
| 2021/0229956 | A1 * | 7/2021 | Dudde | D07B 1/22 |

FOREIGN PATENT DOCUMENTS

| | | | | |
|---|---|---|---|---|
| CN | 104528468 | A | 4/2015 | |
| CN | 104528498 | A | 4/2015 | |
| CN | 104552988 | A | 4/2015 | |
| CN | 105672009 | A | 6/2016 | |
| DE | 3813338 | A1 | 11/1989 | |
| EP | 2020398 | A1 * | 2/2009 | B66B 7/06 |
| EP | 3009390 | A1 | 4/2016 | |
| JP | 84029 | C2 | 11/1929 | |
| JP | 2001-524060 | A | 11/2001 | |
| JP | 2003-520172 | A | 7/2003 | |
| JP | 2004-538382 | A | 12/2004 | |
| JP | 2008-111549 | A | 5/2008 | |
| JP | 2013-504695 | A | 2/2013 | |
| JP | 2014-218770 | A | 11/2014 | |
| JP | 5642212 | B2 | 12/2014 | |
| JP | 2015-038005 | A | 2/2015 | |
| JP | 5713682 | B2 | 5/2015 | |
| KR | 10-1414330 | B1 | 7/2014 | |
| WO | 2002/010050 | A1 | 2/2002 | |
| WO | WO-2011004071 | A2 * | 1/2011 | B66B 7/062 |
| WO | 2012/120144 | A2 | 9/2012 | |
| WO | 2013/190615 | A1 | 12/2013 | |
| WO | 2015/134025 | A1 | 9/2015 | |
| WO | 2016/071564 | A1 | 5/2016 | |
| WO | 2016/096395 | A1 | 6/2016 | |
| WO | 2016/112277 | A1 | 7/2016 | |

OTHER PUBLICATIONS

Office Action dated Feb. 18, 2021, in corresponding Korean patent Application No. 10-2019-7030410, 10 pages.
Office Action dated Aug. 24, 2021, in corresponding Chinese patent Application No. 201880092528.2, 15 pages.
Extended European Search Report dated Aug. 12, 2020, issued in corresponding European Patent Application No. 18792156.4, 22 pages.

* cited by examiner

ELEVATOR, SUSPENSION BODY FOR THE ELEVATOR, AND MANUFACTURING METHOD FOR THE SUSPENSION BODY

CROSS-REFERENCE TO RELATED APPLICATIONS

The present application is based on PCT filing PCT/JP2018/017047, filed Apr. 26, 2018, which claims priority to PCT filing PCT/JP2017/016598, filed Apr. 26, 2017, the entire contents of each are incorporated herein by reference.

TECHNICAL FIELD

This invention relates to an elevator including a car suspended by a suspension body having a belt-like shape, the structure of a suspension body for the elevator, and a manufacturing method for the suspension body.

BACKGROUND ART

In a related-art rope on a hoisting machine, which uses reinforcement fibers, a load bearing portion is made of a polymer matrix and the reinforcement fibers. As the reinforcement fibers, carbon fibers or glass fibers are used. Further, the reinforcement fibers are evenly dispersed in the polymer matrix, and are arranged in parallel to a longitudinal direction of the rope (for example, see Patent Literature 1).

The above-mentioned rope using the reinforcement fibers has higher breaking strength per weight than a wire rope formed by twisting steel wires. Accordingly, particularly in a high-rise elevator requiring a long rope, a weight of the entire rope can be reduced, and a burden of driving on the hoisting machine can be reduced.

CITATION LIST

Patent Literature

[PTL 1] JP 5713682 B2

SUMMARY OF INVENTION

Technical Problem

However, the related-art rope described above is poor in flexibility. Thus, it is difficult to bend the related-art rope along a driving sheave of the hoisting machine. Moreover, the bending may cause increase in internal stress of the rope, and hence there is a risk of causing breakage of the rope. In order to avoid such breakage of the rope, it is necessary to increase a diameter of the driving sheave.

This invention has been made to solve the above-mentioned problem, and has an object to obtain an elevator capable of reducing stress generated on a load bearing layer of a suspension body when the suspension body is bent, a suspension body for the elevator, and a manufacturing method for the suspension body.

Solution to Problem

According to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein the load bearing layer is divided into a plurality of segment layers arranged apart from each other in a thickness direction of the core, and wherein an intermediate layer made of a material different from a material for the load bearing layer is interposed between the segment layers adjacent to each other in the thickness direction of the core.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein the load bearing layer includes a pair of outer bearing layers arranged apart from each other in a thickness direction of the core, and an intermediate bearing layer interposed between the pair of outer bearing layers, and wherein flexural rigidity of the pair of outer bearing layers is lower than flexural rigidity of the intermediate bearing layer.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein the load bearing layer includes a plurality of layers divided in a thickness direction of the core, and wherein among the layers forming the load bearing layer, an outermost layer, which is a layer located on an outermost side in a radial direction of a driving sheave when the suspension body is bent along an outer periphery of the driving sheave, has flexural rigidity lower than flexural rigidity of another layer forming the load bearing layer.

Moreover, according to one embodiment of the present invention, there is provided a suspension body for an elevator, including: a core including a load bearing layer formed of an impregnation resin and a plurality of high-strength fibers; and a covering layer covering at least a part of an outer periphery of the core, wherein the load bearing layer includes a plurality of layers divided in a thickness direction of the core, and wherein flexural rigidity of the layers forming the load bearing layer decreases gradually from one side toward another side in the thickness direction of the core.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein a product of a modulus of elasticity and a width of the load bearing layer in at least any one of both ends of the core in a thickness direction of the core is smaller than a product of a modulus of elasticity and a width of the load bearing layer in a neutral plane of the core.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein both ends of the core in a thickness direction of the core differ from each other in product of a modulus of elasticity and a width of the load bearing layer.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein the core is divided into a plurality of core segments arranged apart from each other in a width direction of the core, and wherein the covering layer enters a region between the core segments adjacent to each other.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein a density of the high-strength fibers in a center portion of the load bearing layer in a thickness direction of the load bearing layer is higher than a density of the high-strength fibers in both end portions of the load bearing layer in the thickness direction.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein a density of the high-strength fibers in a first end portion of the load bearing layer in a thickness direction of the load bearing layer is higher than a density of the high-strength fibers in a second end portion of the load bearing layer in the thickness direction.

Moreover, according to one embodiment of the present invention, there is provided a suspension body for an elevator, including: a core including a load bearing layer formed of an impregnation resin and a plurality of high-strength fibers; and a covering layer covering at least a part of an outer periphery of the core, wherein the core is divided into a plurality of core segments arranged apart from each other, wherein the covering layer enters a region between the core segments adjacent to each other, and wherein a density of the high-strength fibers in a center portion of each of the core segments in a thickness direction of each of the core segments is higher than a density of the high-strength fibers in both end portions of each of the core segments in the thickness direction.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein a density of the high-strength fibers in a center portion of the load bearing layer in a width direction of the load bearing layer is higher than a density of the high-strength fibers in both end portions of the load bearing layer in the width direction.

Moreover, according to one embodiment of the present invention, there is provided a suspension body for an elevator, including: a core including a load bearing layer formed of an impregnation resin and a plurality of high-strength fibers; and a covering layer covering at least a part of an outer periphery of the core, wherein the core is divided into a plurality of core segments arranged apart from each other, wherein the covering layer enters a region between the core segments adjacent to each other, wherein a sectional shape of each of the core segments perpendicular to a length direction of each of the core segments is circular, and wherein the high-strength fibers in each of the core segments are arranged in a spirally twisted state.

Moreover, according to one embodiment of the present invention, there is provided a suspension body for an elevator, including: a core including a load bearing layer formed of an impregnation resin and a plurality of high-strength fibers; and a covering layer covering at least a part of an outer periphery of the core, wherein the high-strength fibers inside the load bearing layer are arranged in parallel to a length direction of the core, and wherein at least a part of the high-strength fibers in an outer peripheral portion of the load bearing layer are arranged in a direction crossing the length direction of the core.

Moreover, according to one embodiment of the present invention, there is provided a suspension body for an elevator, including: a core including a load bearing layer formed of an impregnation resin and a plurality of high-strength fibers; and a covering layer covering at least a part of an outer periphery of the core, wherein the core is divided into a plurality of core segments arranged apart from each other, and wherein a first resin layer, which is made of the same material as that for the impregnation resin, and a second resin layer, which is made of the same material as that for the covering layer, are interposed between the core segments adjacent to each other.

Moreover, according to one embodiment of the present invention, there is provided a suspension body for an elevator, including: a core including a load bearing layer formed of an impregnation resin and a plurality of high-strength fiber bundles; and a covering layer covering at least a part of an outer periphery of the core, wherein in each of the high-strength fiber bundles, a plurality of high-strength fibers are arranged in a spirally twisted state.

Moreover, according to one embodiment of the present invention, there is provided a suspension body for an elevator, including: a core having a belt-like shape and including a load bearing layer formed of an impregnation resin and a plurality of high-strength fibers; and a covering layer covering at least a part of an outer periphery of the core, wherein both end portions of the core in the width direction are exposed from the covering layer to an outside.

According to one embodiment of the present invention, there is provided an elevator, including: a car; a hoisting machine including a driving sheave; and a suspension body wound around the driving sheave and configured to suspend the car, the suspension body including: a core having a belt-like shape and including a load bearing layer formed of an impregnation resin and a plurality of high-strength fibers; and a covering layer covering at least a part of an outer periphery of the core, wherein a difference in rigidity is set between one end and another end of the core in a thickness direction of the core, and wherein the suspension body is wound around the driving sheave in a direction in which the suspension body is easily bent when the suspension body is bent along an outer peripheral surface of the driving sheave.

Moreover, according to one embodiment of the present invention, there is provided an elevator, including: a car; a hoisting machine including a driving sheave; a suspension body wound around the driving sheave and configured to suspend the car; and a pair of end holding devices provided on both end portions of the suspension body, respectively, the suspension body including: a core having a belt-like shape and including a load bearing layer formed of an impregnation resin and a plurality of high-strength fibers; and a covering layer covering at least a part of an outer periphery of the core, wherein the pair of end holding devices is configured to hold the both end portions of the suspension body so as to inhibit shifting of the load bearing layer inside the suspension body in a length direction of the suspension body, and wherein a radius of the driving sheave is set so that, under a state in which a load of the car is applied to the suspension body and the suspension body is bent along the driving sheave, maximum tensile stress generated on the load bearing layer in the length direction of the suspension body is lower than tensile strength of the suspension body in the length direction, and maximum compressive stress generated on the load bearing layer in the length direction of the suspension body is lower than compressive strength of the suspension body in the length direction.

Moreover, according to one embodiment of the present invention, there is provided an elevator, including: a car; a hoisting machine including a driving sheave; a suspension body wound around the driving sheave and configured to suspend the car; and a pair of end holding devices provided on both end portions of the suspension body, respectively, the suspension body including: a core having a belt-like shape and including a load bearing layer formed of an impregnation resin and a plurality of high-strength fibers; and a covering layer covering at least a part of an outer periphery of the core, wherein at least any one of the pair of end holding devices is configured to hold each end portion of the suspension body under a state in which one end and another end of the suspension body in a thickness direction of the suspension body are shifted from each other in a length direction of the suspension body.

Moreover, according to one embodiment of the present invention, there is provided an elevator, including: an ascending/descending body; a hoisting machine including a driving sheave; a suspension body wound around the driving sheave and configured to suspend the ascending/descending body; a pair of end holding devices provided on both end portions of the suspension body, respectively, the suspension body including: a core having a belt-like shape and including a load bearing layer formed of an impregnation resin and a plurality of high-strength fibers; and a covering layer covering at least a part of an outer periphery of the core, wherein at least any one of the pair of end holding devices is coupled to the ascending/descending body so as to be rotatable about a shaft parallel to a width direction of the suspension body.

Moreover, according to one embodiment of the present invention, there is provided an elevator, including: a car; a hoisting machine including a driving sheave; and a suspension body wound around the driving sheave and configured to suspend the car, the suspension body including: a core having a belt-like shape and including a load bearing layer formed of an impregnation resin and a plurality of high-strength fibers; and a covering layer covering at least a part of an outer periphery of the core, wherein at least any one of end portions of the suspension body in a length direction of the suspension body is bent along an arc.

Moreover, according to one embodiment of the present invention, there is provided an elevator, including: a car; a hoisting machine including a driving sheave; and a suspension body wound around the driving sheave and configured to suspend the car, the suspension body including: a core having a belt-like shape and including a load bearing layer formed of an impregnation resin and a plurality of high-strength fibers; and a covering layer covering at least a part of an outer periphery of the core, wherein the suspension body has a ring shape.

According to one embodiment of the present invention, there is provided a manufacturing method for a suspension body for an elevator, including: forming a laminated body by alternately laminating a plurality of high-strength fiber layers each including a high-strength fiber fabric, and a low-elasticity fiber layer including a low-elasticity fiber fabric having a modulus of elasticity lower than that of the high-strength fiber fabric; impregnating an uncured thermosetting resin into the laminated body; forming a core by heating and curing the uncured thermosetting resin; and forming a covering layer covering at least a part of an outer periphery of the core.

Moreover, according to one embodiment of the present invention, there is provided a manufacturing method for a suspension body for an elevator, including: forming a laminated body by laminating, on one side of a suspension body, a plurality of high-strength fiber layers each including a high-strength fiber fabric, and laminating, on another side of the suspension body, a low-elasticity fiber layer including a low-elasticity fiber fabric having a modulus of elasticity lower than that of the high-strength fiber fabric; impregnating an uncured thermosetting resin into the laminated body; forming a core by heating and curing the uncured thermosetting resin; and forming a covering layer covering at least a part of an outer periphery of the core.

Moreover, according to one embodiment of the present invention, there is provided a manufacturing method for a suspension body for an elevator, including: forming a bundle body by causing a high-strength fiber thread to pass from a bundle portion through a drawing device and return to the bundle portion; impregnating an uncured thermosetting resin into the bundle body; forming a core by heating and curing the uncured thermosetting resin; and forming a covering layer covering at least a part of an outer periphery of the core.

Moreover, according to one embodiment of the present invention, there is provided a manufacturing method for a suspension body for an elevator, including: forming a plurality of unidirectional FRP plates each formed of a plurality of high-strength fibers and a resin; forming a laminated body by alternately laminating an intermediate-layer thermoplastic sheet made of a thermoplastic resin, and the unidirectional FRP plates; and forming a core by integrating the laminated body, and forming a covering layer, which covers at least apart of an outer periphery of the core, through pressure forming.

Moreover, according to one embodiment of the present invention, there is provided a manufacturing method for a suspension body for an elevator, including: paying out a plurality of high-strength fiber groups, which are different from each other in fiber density, from corresponding bobbins, respectively; forming a bundle of the plurality of high-strength fiber groups by bringing the plurality of high-strength fiber groups close to each other while maintaining mutual relative positions; impregnating an impregnation resin into the bundle; forming a core by performing hot forming on the bundle impregnated with the resin; and forming a covering layer covering at least a part of an outer periphery of the core.

Moreover, according to one embodiment of the present invention, there is provided a manufacturing method for a suspension body for an elevator, including: paying out a plurality of high-strength fiber groups from corresponding bobbins, respectively; forming a bundle of the plurality of high-strength fiber groups by bringing the plurality of high-strength fiber groups close to each other; twisting the bundle and impregnating an impregnation resin into the bundle; forming a core by performing hot forming on the bundle impregnated with the resin; and forming a covering layer covering at least a part of an outer periphery of the core.

Advantageous Effects of Invention

According to the elevator, the suspension body for an elevator, and the manufacturing method for the suspension body of this invention, there can be reduced stress generated on the load bearing layer of the suspension body when the suspension body is bent.

BRIEF DESCRIPTION OF DRAWINGS

FIG. 120 is an enlarged sectional view for illustrating a portion 113 in FIG. 119.

FIG. 121 is a plan view for illustrating a first high-strength fiber bundle in FIG. 120.

FIG. 122 is a plan view for illustrating a second high-strength fiber bundle in FIG. 120.

DESCRIPTION OF EMBODIMENTS

Figure 1:
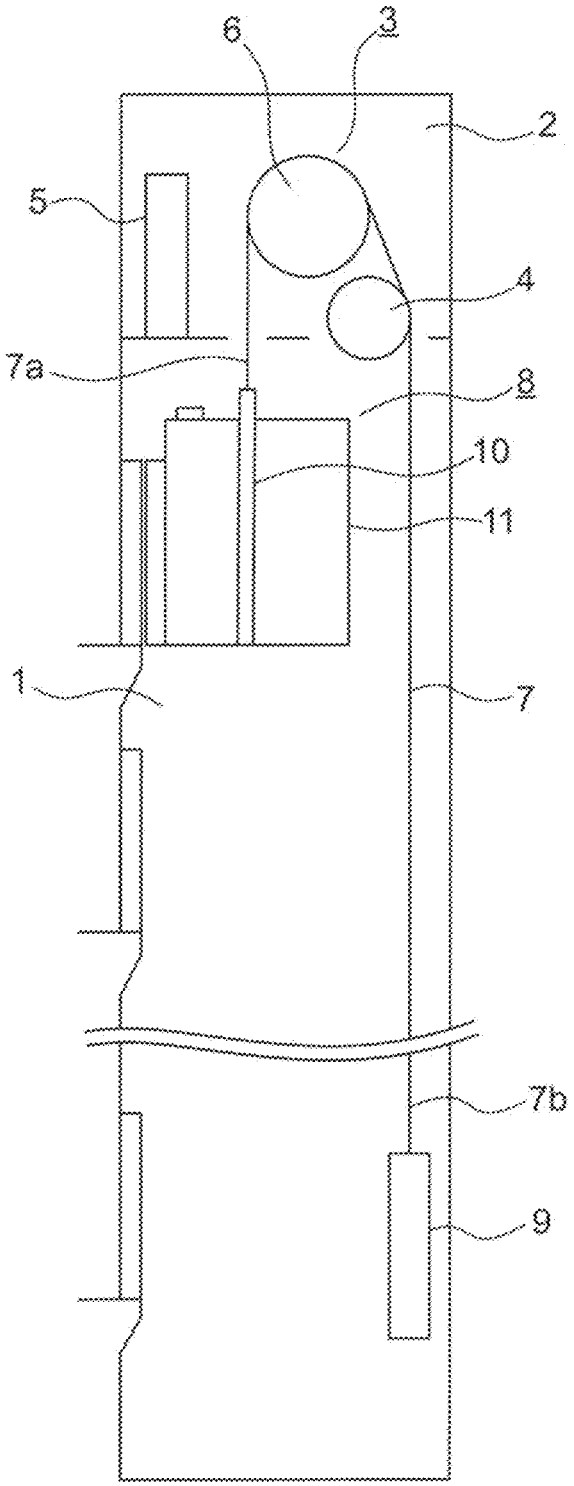
FIG. 1 is a configuration view for illustrating an elevator according to a first embodiment of this invention.

Now, the best mode for carrying out the present invention is described referring to the drawings.

First Embodiment

FIG. 1 is a configuration view for illustrating an elevator according to a first embodiment of this invention. In FIG. 1, a machine room 2 is provided in an upper part of a hoistway 1. A hoisting machine 3, a deflector sheave 4, and an elevator controller 5 are installed in the machine room 2. The hoisting machine 3 includes a driving sheave 6, a hoisting machine motor (not shown) configured to rotate the driving sheave 6, and a hoisting machine brake (not shown) configured to brake rotation of the driving sheave 6.

A plurality of suspension bodies 7 (only one suspension body is illustrated in FIG. 1) are wound around the driving sheave 6 and the deflector sheave 4. The suspension bodies 7 each have a first end portion 7*a* and a second end portion 7*b*. The first end portion 7*a* is connected to a car 8 serving as an ascending/descending body. The second end portion 7*b* is connected to a counterweight 9 serving as an ascending/descending body.

The car 8 and the counterweight 9 are suspended by the suspension bodies 7 through use of a 1:1 roping method. Further, the car 8 and the counterweight 9 are vertically moved in the hoistway 1 through rotation of the driving sheave 6. The elevator controller 5 is configured to control the hoisting machine 3, to thereby control operation of the car 8.

A pair of car guide rails (not shown) and a pair of counterweight guide rails (not shown) are installed in the hoistway 1. The car guide rails are configured to guide vertical movement of the car 8. The counterweight guide rails are configured to guide vertical movement of the counterweight 9.

The car 8 includes a car frame 10 and a cage 11. The suspension bodies 7 are connected to the car frame 10. The cage 11 is supported by the car frame 10.

Figure 2:
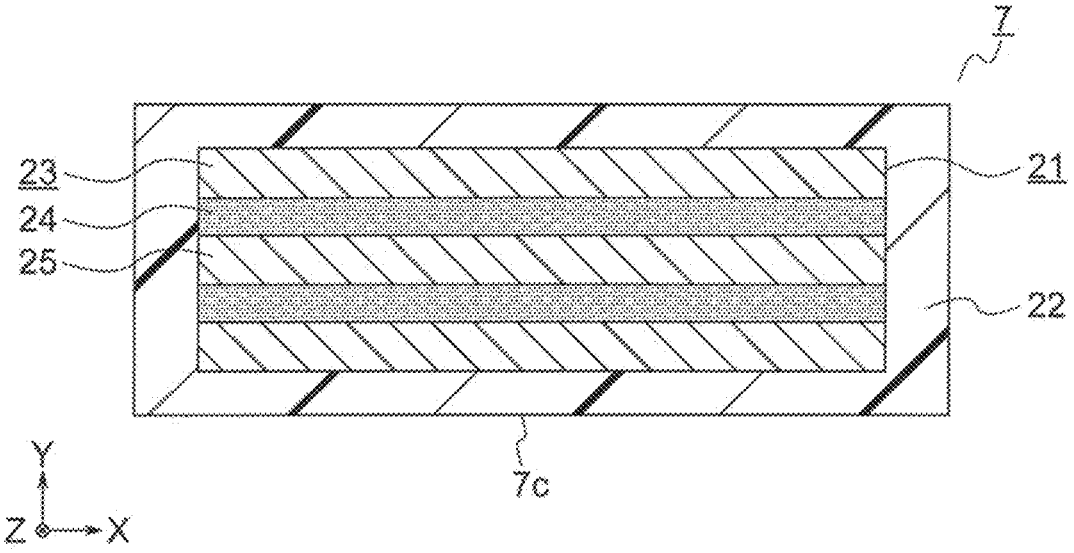
FIG. 2 is a sectional view for schematically illustrating a cross section of a suspension body in FIG. 1 perpendicular to a length direction thereof.

FIG. 2 is a sectional view for schematically illustrating a cross section of the suspension body 7 in FIG. 1 perpendicular to a length direction thereof (Z-axis direction in FIG. 2). The suspension body 7 has such a belt-like shape that a dimension in a thickness direction of the suspension body 7 (Y-axis direction in FIG. 2) is smaller than a dimension in a width direction of the suspension body 7 (X-axis direction in FIG. 2). That is, the suspension body 7 is a so-called flat belt.

Further, the suspension body 7 has a sheave contact surface 7*c* being any one of end surfaces in the thickness direction. When the suspension body 7 is wound around the driving sheave 6, the sheave contact surface 7*c* is brought into contact with an outer peripheral surface of the driving sheave 6. That is, when passing over the driving sheave 6, the suspension body 7 is bent along the outer peripheral surface of the driving sheave 6 so that the sheave contact surface 7*c* is positioned on an inner side of the suspension body 7.

The suspension body 7 includes a core 21 and a covering layer 22. The core 21 has a belt-like shape. The covering layer 22 covers an entire periphery of the core 21.

As a material for the covering layer 22, a thermoplastic resin, such as polyethylene, polypropylene, polyamide 6 (PA6), polyamide 12 (PA12), polyamide 66 (PA66), polycarbonate, polyether ether ketone, or polyphenylene sulfide, may be used.

In addition, as a material for the covering layer 22, an olefin-based, styrene-based, vinyl chloride-based, urethane-based, polyester-based, polyamide-based, fluorine-based, or butadiene-based thermoplastic elastomer may also be used.

Further, as a material for the covering layer 22, a thermosetting elastomer (rubber), such as a butadiene rubber, a styrene-butadiene rubber, a chloroprene rubber, an acrylic rubber, a urethane rubber, or a silicone rubber, may also be used.

Further, as a material for the covering layer 22, a carbon fiber, a glass fiber, an aramid fiber, a PBO (poly-p-phenylene benzobisoxazole) fiber, or a basalt fiber may be used. In addition, the material may be a composite material of a fiber and a resin.

It is preferred that a material having high heat resistance and high wear resistance be employed as a material for the covering layer 22. Through change of the material for the covering layer 22, a coefficient of friction between the suspension body 7 and the driving sheave 6 can be adjusted.

The core 21 includes a load bearing layer 23 and a plurality of intermediate layers 24. The load bearing layer 23 is divided into a plurality of layers in the thickness direction of the core 21, namely, the thickness direction of the suspension body 7. That is, the load bearing layer 23 is formed of a plurality of segment layers 25 arranged apart from each other in the thickness direction of the core 21.

The intermediate layer 24 is made of a material different from materials for the covering layer 22 and the load bearing layer 23. Further, the intermediate layer 24 is interposed between the segment layers 25 adjacent to each other in the thickness direction of the core 21. That is, the segment layers 25 and the intermediate layers 24 are alternately laminated in the thickness direction of the core 21. In this example, the load bearing layer 23 is divided into three segment layers 25. Thus, two intermediate layers 24 are used.

Further, the intermediate layer 24 may be interposed in an entire region between the segment layers 25 adjacent to each other in the thickness direction of the core 21, or may be interposed only in a bent region. With this configuration, the adjacent segment layers 25 are not held in direct contact with each other, and the covering layer 22 does not enter the region between the adjacent segment layers 25.

The load bearing layer 23 is a layer configured to mainly bear a load acting on the suspension body 7. Further, the load bearing layer 23 is formed of an impregnation resin and a high-strength fiber group provided in the impregnation resin.

The high-strength fiber group includes a plurality of high-strength fibers arranged along the length direction of the core 21 (Z-axis direction in FIG. 2). Further, the high-strength fiber group may be a high-strength fiber fabric or a high-strength fiber braid formed of the high-strength fibers arranged along the length direction of the core 21.

The high-strength fiber is a light-weight and high-strength fiber. As the high-strength fiber, for example, a carbon fiber, a glass fiber, an aramid fiber, a PBO (poly-p-phenylene benzobisoxazole) fiber, or a basalt fiber may be used. In addition, as the high-strength fiber, a composite fiber obtained by combining those fibers may be used.

As the impregnation resin of the load bearing layer 23, a thermosetting resin, such as polyurethane, an epoxy, an unsaturated polyester, vinyl ester, phenol, or silicone, may be used.

In addition, as the impregnation resin, a thermoplastic resin, such as polyethylene, polypropylene, polyamide 6 (PA6), polyamide 12 (PA12), polyamide 66 (PA66), polycarbonate, polyether ether ketone, or polyphenylene sulfide, may be used.

Moreover, the impregnation resin may contain a lubricant such as grease or oil. Alternatively, a lubricant such as grease may be used instead of the impregnation resin.

In particular, it is preferred that the impregnation resin be a resin having good adhesiveness with respect to the high-strength fibers. When a resin having a low modulus of elasticity is used as the impregnation resin, flexural rigidity of the suspension body 7 can be further reduced. Meanwhile, when a resin having a high modulus of elasticity is used as the impregnation resin, the high-strength fibers are firmly integrated together, thereby being capable of reducing unevenness in strength of the suspension body 7.

Shear rigidity of the intermediate layer 24 is lower than shear rigidity of the segment layer 25. As a material for the intermediate layer 24, a thermosetting resin, such as polyurethane, an epoxy, an unsaturated polyester, a vinyl ester, phenol, or silicone, may be used.

In addition, as a material for the intermediate layer 24, a thermoplastic resin, such as polyethylene, polypropylene, polyamide 6 (PA6), polyamide 12 (PA12), polyamide 66 (PA66), polycarbonate, polyether ether ketone, or polyphenylene sulfide, may also be used.

In the suspension body 7 for an elevator described above, the load bearing layer 23 is divided in the thickness direction of the core 21, and the intermediate layer 24 is interposed between the adjacent segment layers 25. Thus, through selection of a material for the intermediate layer 24, bendability of the core 21 can be improved. Further, it is possible to relieve stress on the segment layers 25, which are respectively located at an innermost layer and an outermost layer, when the core 21 is bent. With this configuration, a diameter of the driving sheave 6 can also be reduced.

Further, the shear rigidity of the intermediate layer 24 is set lower than the shear rigidity of the segment layer 25. Thus, when the core 21 is bent, the intermediate layers 24 are easily deformed in a shearing direction (Z-axis direction in FIG. 2). With this configuration, it is possible to more reliably relieve the stress on the segment layers 25, which are respectively located at the innermost layer and the outermost layer, when the core 21 is bent.

Figure 3:
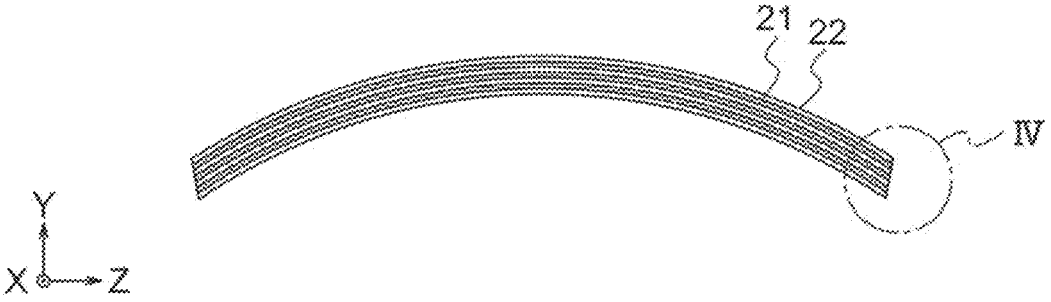
FIG. 3 is a sectional view for illustrating a bent state of a piece of the suspension body having the sectional structure in FIG. 2.
Figure 4:
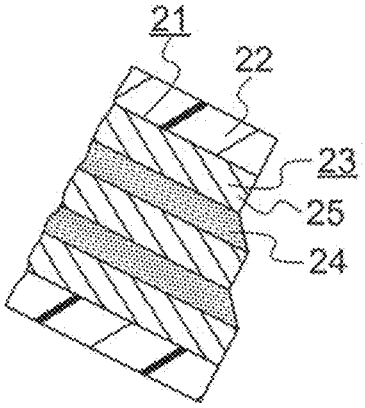
FIG. 4 is an enlarged sectional view for illustrating a portion IV in FIG. 3.

FIG. 3 is a sectional view for illustrating a bent state of a piece of the suspension body 7 having the sectional structure in FIG. 2, and illustrating a cross section (YZ cross section) of the suspension body 7 taken along the length direction. Further, FIG. 4 is an enlarged sectional view for illustrating a portion IV in FIG. 3. As illustrated in FIG. 4, when the suspension body 7 is bent, the intermediate layers 24 undergo shear deformation in the length direction of the core 21, thereby improving flexibility of the suspension body 7.

Figure 5:
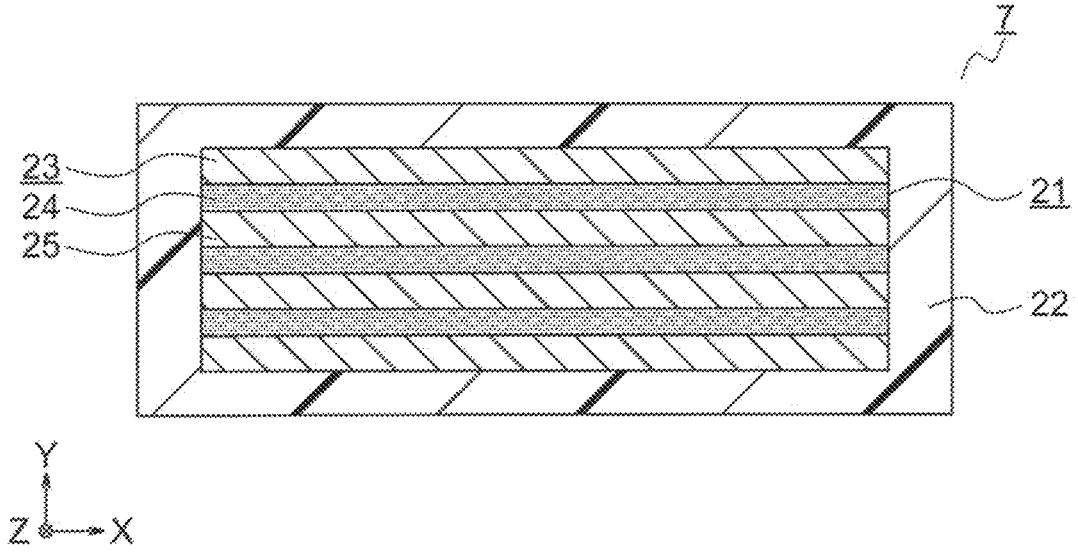
FIG. 5 is a sectional view for illustrating a modification example in which segment layers in FIG. 2 are modified into four layers.

The number of the segment layers 25 is not limited to three. For example, as illustrated in FIG. 5, the number of the segment layers 25 may be four. That is, the number of the segment layers 25 may be any number equal to or more than two. When the number of the segment layers 25 is set to n, the number of the intermediate layers 24 is n−1.

Further, it is desired that a modulus of rigidity of the intermediate layer 24 be set lower than a modulus of rigidity of the covering layer 22. With this configuration, the region between the segment layers 25 more easily undergoes shear deformation, thereby further improving the flexibility of the suspension body 7. Further, stress generated on the load bearing layer 23 when the core 21 is bent can be further reduced.

Moreover, in a case in which compression stiffness of a material for the intermediate layer 24 is set lower than compression stiffness of a material for the load bearing layer 23, when the suspension body 7 passes over the driving sheave 6, the suspension body 7 receives a load in a direction of compressing the cross section, and a thickness of the portion having received the compressive load is reduced. As a result, the suspension body 7 is easily bent.

Further, the intermediate layer 24 may be formed of an elastomer material having a characteristic, that is, a lower elastic modulus than that of the dividing layer 25. As the elastomer material, for example, an olefin-based, styrene-based, vinyl chloride-based, urethane-based, polyester-based, polyamide-based, fluorine-based, or butadiene-based thermoplastic elastomer may be used. In addition, as the elastomer material, a thermosetting elastomer (rubber), such as a butadiene rubber, a styrene-butadiene rubber, a chloroprene rubber, an acrylic rubber, a urethane rubber, or a silicone rubber, may be used.

Further, as a material for the intermediate layer 24, there may be used a polymer gel having intermediate properties between a solid and a liquid.

Moreover, as a material for the intermediate layer 24, there may be used a lubricant such as a liquid lubricant, a semi-solid lubricant, or a solid lubricant. As the liquid lubricant, for example, a lubricating oil is given. An example of the semi-solid lubricant is grease. Examples of the solid lubricant include graphite, tungsten disulfide, molybdenum disulfide, and polytetrafluoroethylene.

Further, the intermediate layer 24 may be formed of a low-friction sheet which is not bonded to the load bearing layer 23. As the sheet, for example, an olefin-based sheet, a fluorine-based sheet, a polyester-based sheet, or a polyamide-based sheet may be used.

As a material for the olefin-based sheet, there is given, for example, polyethylene or polypropylene. As a material for the fluorine-based sheet, there is given, for example, polytetrafluoroethylene. As a material for the polyester-based sheet, there is given, for example, polyethylene terephthalate. As a material for the polyamide-based sheet, there is given, for example, polyamide 6.

Further, a plurality of sheets can be arranged in layers. Moreover, the liquid lubricant, the semi-solid lubricant, and the solid lubricant can be used in combination. For example, a configuration in which the liquid lubricant is arranged on a surface of the sheet of the solid lubricant is conceivable. Through use of such a lubricant, shear resistance in the intermediate layer can be reduced, thereby improving the flexibility of the suspension body 7.

Moreover, as a material for the intermediate layer 24, there may be used a material that is more flexible and richer in cushioning property in the compressing direction than the material of the segment layer 25. An example of such material includes a polymer foam. Examples of the polymer foam include a polyurethane foam, a polyethylene foam, a polyethylene terephthalate foam, a polypropylene foam, an acrylic foam, a polystyrene foam, a phenol foam, a silicone foam, and an EVA foam.

Through use of the above-mentioned material that is rich in cushioning property in the compressing direction, vibration and a shock during operation of the car 8 can be absorbed. Further, when the suspension body 7 receives tension, a portion of the suspension body 7 held in contact with the driving sheave 6 is compressed in the thickness direction, and the thickness of the contact portion is reduced. As a result, the suspension body 7 is easily bent and deformed.

Further, the intermediate layer 24 may be formed of fibers (hereinafter referred to as "intermediate-layer fibers"). It is preferred that a form of the intermediate-layer fibers in this case be continuous fibers continuous in the length direction of the core 21, but the form of the intermediate-layer fibers may belong fibers or short fibers. When the intermediate-layer fibers are placed in the intermediate layer 24, deformation of the intermediate layer 24 in the compressing direction, namely, the thickness direction can be suppressed, thereby being capable of relieving stress concentration caused by bending of the segment layer 25 at the time of reception of the compressive load.

Moreover, when the intermediate-layer fibers are placed in the intermediate layer 24, it is preferred that a fiber density or modulus of elasticity of the intermediate-layer fibers, which are arranged in the intermediate layer 24 along the length direction of the core 21, be set lower than a fiber density or modulus of elasticity of the high-strength fibers, which are arranged in the load bearing layer 23 along the length direction of the core 21.

With this configuration, the flexural rigidity of the intermediate layer 24 in the length direction of the core 21 can be set lower than that of the load bearing layer 23 while suppressing compressive deformation of the intermediate layer 24, thereby improving the flexibility of the suspension body 7.

As a method of reducing a fiber density, for example, there is given a method of reducing a fiber diameter or a method of reducing a content of fibers. As a method of reducing a modulus of elasticity of fibers, for example, there is given a method of using glass fibers, polyester fibers, polyarylate fibers, polyethylene fibers, or aramid fibers as the intermediate-layer fibers when the high-strength fibers in the load bearing layer 23 are carbon fibers.

Further, when the intermediate-layer fibers are placed in the intermediate layer 24, the intermediate-layer fibers may include inclined fibers inclined with respect to the length direction of the core 21, for example, inclined at 45 degrees. With this configuration, the rigidity against torsion can be improved while reducing the rigidity against bending in the length direction of the core 21.

Moreover, when the intermediate-layer fibers are placed in the intermediate layer 24, the intermediate-layer fibers may include orthogonal fibers arranged along a direction orthogonal to the length direction of the core 21, that is, along the width direction of the suspension body 7. With this configuration, the flexural rigidity in the width direction of the core 21 can be improved while reducing the rigidity against bending in the length direction of the core 21.

Moreover, the load bearing layer 23 in the first embodiment may be formed of the high-strength fiber group without the impregnation resin. With this configuration, the flexural rigidity can be further reduced.

Further, the covering layer 22 may contain the lubricant.

Moreover, a portion including the lubricant and a portion without the lubricant may be provided depending on positions in the length direction for each of the covering layer 22, the load bearing layer 23, and the intermediate layer 24.

Second Embodiment

Figure 6:
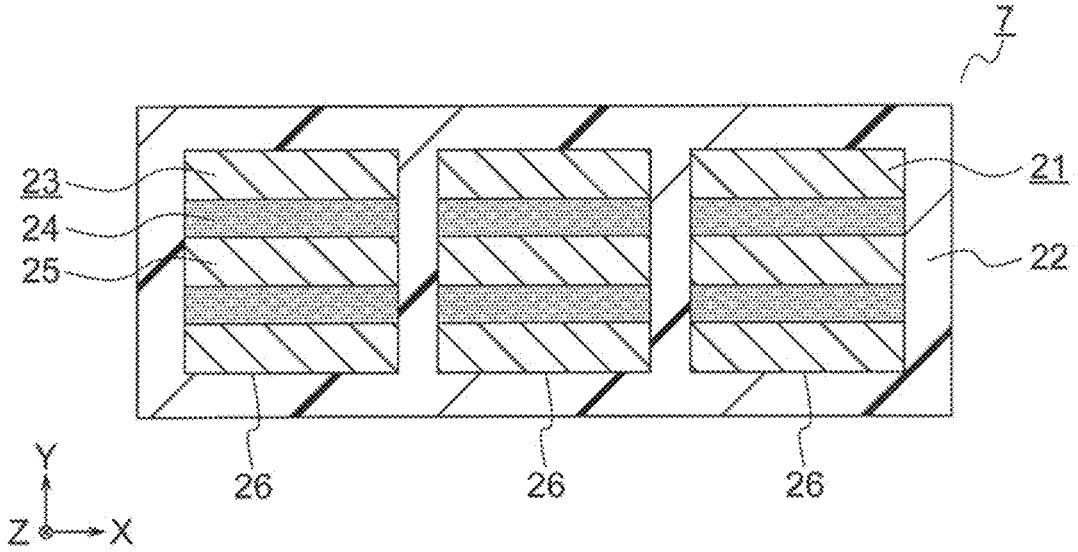
FIG. 6 is a sectional view for illustrating the suspension body for an elevator according to a second embodiment of this invention.

Next, FIG. 6 is a sectional view for illustrating the suspension body 7 for an elevator according to a second embodiment of this invention. The core 21 in the second embodiment is divided into a plurality of core segments 26 arranged apart from each other in the width direction of the suspension body 7. In this example, the core 21 is divided into three core segments 26. The covering layer 22 enters a region between the core segments 26 adjacent to each other in the width direction of the suspension body 7. The other configurations are the same as those of the first embodiment.

In the above-mentioned suspension body 7, the resin of the covering layer 22 is interposed between the core segments 26, and hence the suspension body 7 is easily bent also in the width direction thereof. Thus, when a surface of the driving sheave 6 to be brought into contact with the suspension body 7 is curved in the width direction of the suspension body 7, the suspension body 7 is easily bent along the driving sheave 6.

The number of segments of the core 21 may be any number equal to or more than two.

Further, also in the configuration in which the core 21 is divided, the number of the segment layers 25 and the configurations of the intermediate layers 24 can be modified in a manner similar to that in the first embodiment.

Third Embodiment

Figure 7:
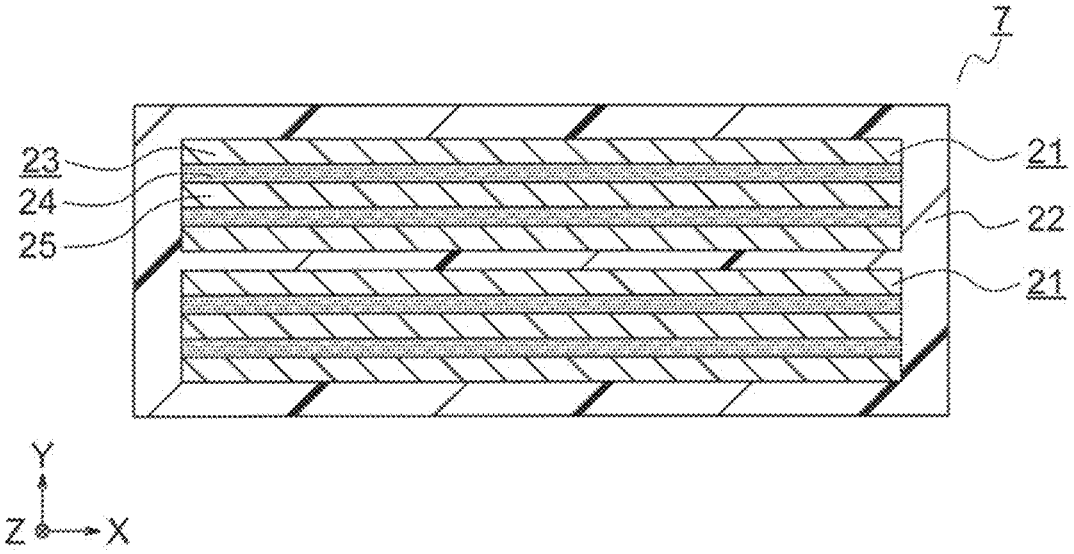
FIG. 7 is a sectional view for illustrating the suspension body for an elevator according to a third embodiment of this invention.

Next, FIG. 7 is a sectional view for illustrating the suspension body 7 for an elevator according to a third embodiment of this invention. In the third embodiment, two cores 21 are provided in the covering layer 22 so as to be arranged apart from each other in the thickness direction of the suspension body 7. The covering layer 22 enters a region between the cores 21 adjacent to each other in the thickness direction of the suspension body 7. Each of the cores 21 includes three segment layers 25 and two intermediate layers 24. The other configurations are the same as those of the first embodiment.

In the above-mentioned suspension body 7, when the suspension body 7 is bent, owing to deformation in the shearing direction of both the intermediate layers 24 in each of the cores 21, and the resin of the covering layer 22 entering the region between the cores 21, stress generated on the segment layers 25 can be reduced.

The number of the cores 21 may be any number equal to or more than two.

Further, also in the configuration in which two or more cores 21 are arranged in the covering layer 22, the number of the segment layers 25 and the configurations of the intermediate layers 24 can be modified in a manner similar to that in the first embodiment.

Moreover, in the configuration in which two or more cores 21 are arranged in the covering layer 22, at least a part of the cores 21 may be divided into the plurality of core segments 26 as in the second embodiment. That is, the second embodiment and the third embodiment may be carried out in combination.

Fourth Embodiment

Figure 8:
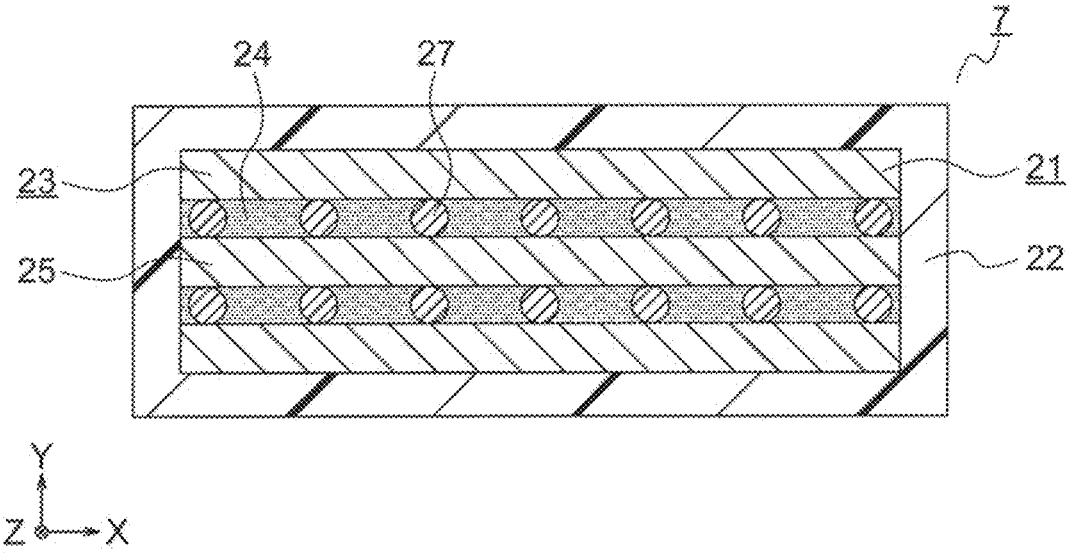
FIG. 8 is a sectional view for illustrating the suspension body for an elevator according to a fourth embodiment of this invention.

Next, FIG. 8 is a sectional view for illustrating the suspension body 7 for an elevator according to a fourth embodiment of this invention. In the fourth embodiment, a plurality of deformation suppressing members 27 are provided in each intermediate layer 24. The deformation suppressing members 27 are each configured to suppress deformation of the intermediate layer 24 in the thickness direction of the core 21, namely, the compressing direction. Thus, the deformation suppressing members 27 are each made of a material having higher compression stiffness than that of the intermediate layer 24.

Further, the deformation suppressing members 27 in the fourth embodiment are interposed between the segment layers 25 adjacent to each other in the thickness direction of the core 21, and function as spacers configured to maintain the distance between the segment layers 25. In FIG. 8, the deformation suppressing members 27 each have a circular sectional shape. The other configurations are the same as those of the first embodiment.

In the above-mentioned suspension body 7, compressive strength of the suspension body 7 is improved, and deformation of the intermediate layer 24 in the compressing direction is suppressed. Accordingly, it is possible to relieve stress concentration on the segment layers 25, which are respectively located at the innermost layer and the outermost layer, when the core 21 receives the compressive load in the thickness direction.

Figure 9:
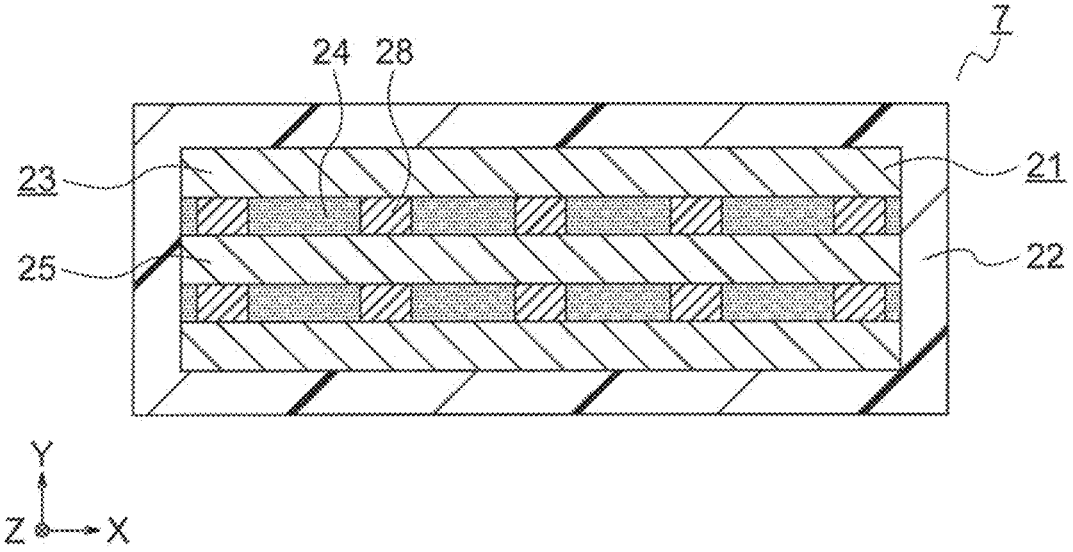
FIG. 9 is a sectional view for illustrating a first modification example of the fourth embodiment.

FIG. 9 is a sectional view for illustrating a first modification example of the fourth embodiment. In the first modification example, deformation suppressing members 28 each having a rectangular cross section are used. Thus, the sectional shape of the deformation suppressing members is not limited to a circular shape.

Figure 10:
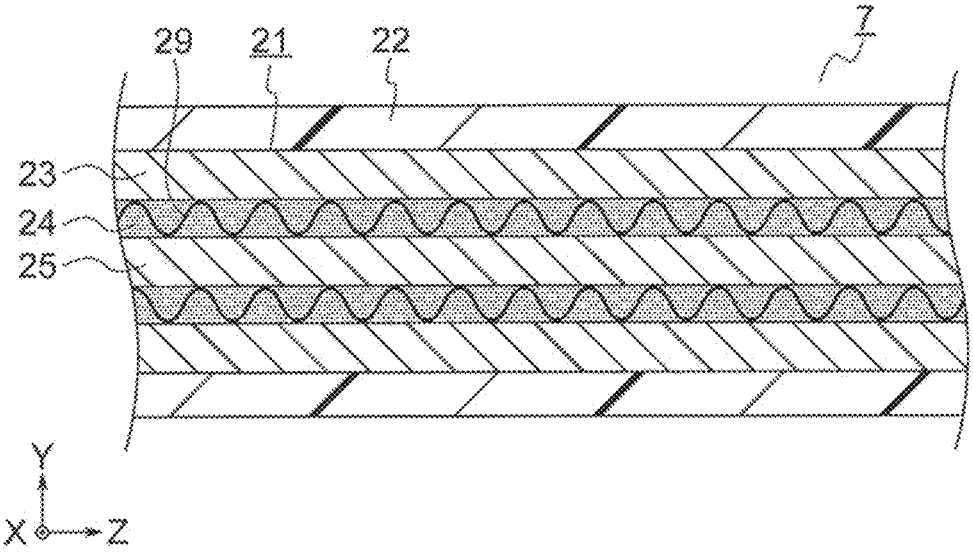
FIG. 10 is a sectional view for illustrating a second modification example of the fourth embodiment.

FIG. 10 is a sectional view for illustrating a second modification example of the fourth embodiment, and illustrating a cross section (YZ cross section) of the suspension body 7 taken along the length direction. In the second modification example, deformation suppressing members 29 each having a corrugated-sheet-like shape are used.

The deformation suppressing members may be arranged so as to be continuous in the length direction of the core 21, or arranged so as to be divided into a plurality of segments in the length direction. Alternatively, granular deformation suppressing members may be arranged so as to be dispersed in the length direction of the core 21.

Further, the deformation suppressing members may be arranged over an entire length of the suspension body 7, or arranged in portions of the suspension body 7 bearing the compressive load, for example, end portions of the suspension body 7 and a portion of the suspension body 7 to be brought into contact with the driving sheave 6.

Moreover, the deformation suppressing members may be embedded in the intermediate layer so as not to be held in direct contact with the segment layers.

Moreover, the deformation suppressing members may be provided in the intermediate layer in the second embodiment or the third embodiment.

Fifth Embodiment

Figure 11:
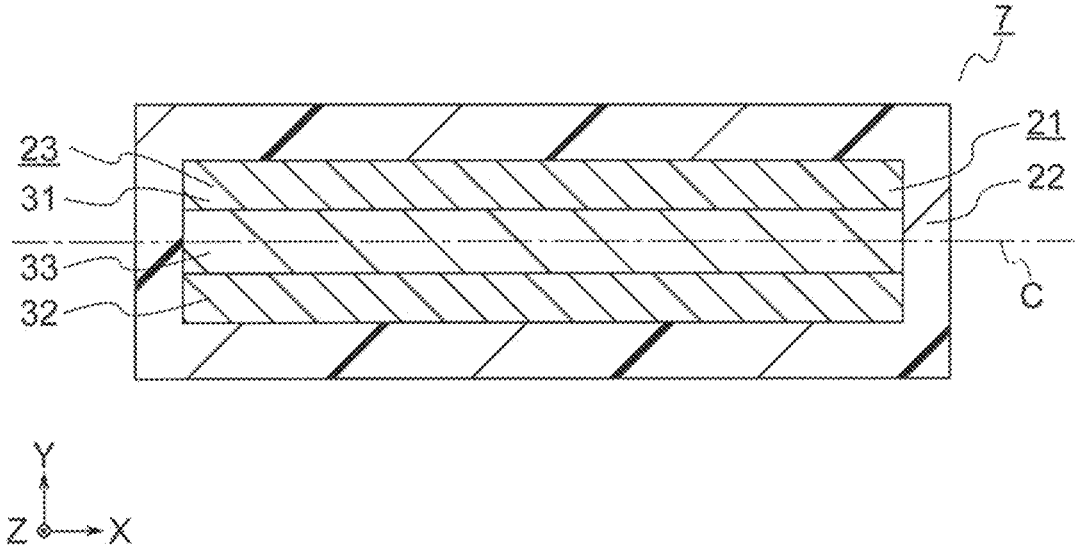
FIG. 11 is a sectional view for illustrating the suspension body for an elevator according to a fifth embodiment of this invention.

Next, FIG. 11 is a sectional view for illustrating the suspension body 7 for an elevator according to a fifth embodiment of this invention. The core 21 in the fifth embodiment does not include the intermediate layer 24, and include only the load bearing layer 23. The load bearing layer 23 includes an outermost layer 31, an innermost layer 32, and an intermediate bearing layer 33. The outermost layer 31 and the innermost layer 32 correspond to a pair of outer bearing layers.

The outermost layer 31 is a layer arranged outermost in the core 21 in a radial direction of the driving sheave 6 when the suspension body 7 is bent along the driving sheave 6. The innermost layer 32 is a layer arranged innermost in the core 21 in the radial direction of the driving sheave 6 when the suspension body 7 is bent along the driving sheave 6.

The intermediate bearing layer 33 is evenly interposed between the outermost layer 31 and the innermost layer 32 throughout the length direction and the width direction of the core 21. Similarly to the first embodiment, each of the outermost layer 31, the innermost layer 32, and the intermediate bearing layer 33 is formed of the impregnation resin and the high-strength fiber group provided in the impregnation resin.

However, in the fifth embodiment, flexural rigidity of the outermost layer 31 and the innermost layer 32 is lower than flexural rigidity of the intermediate bearing layer 33. The flexural rigidity of each layer can be adjusted through change of, for example, a density of the high-strength fibers forming the high-strength fiber group, a material for the high-strength fibers, or a material for the impregnation resin.

That is, by setting the density of the high-strength fibers in each of the outermost layer 31 and the innermost layer 32 lower than the density of the high-strength fibers in the intermediate bearing layer 33, the flexural rigidity of the outermost layer 31 and the innermost layer 32 can be set lower than the flexural rigidity of the intermediate bearing layer 33.

Further, also by setting the modulus of elasticity of each of the outermost layer 31 and the innermost layer 32 lower than the modulus of elasticity of the intermediate bearing layer 33, the flexural rigidity of the outermost layer 31 and the innermost layer 32 can be set lower than the flexural rigidity of the intermediate bearing layer 33. The other configurations are the same as those of the first embodiment.

In the above-mentioned suspension body 7, the flexural rigidity of the outermost layer 31 and the innermost layer 32, which are located away from a neutral plane C being a plane free from expansion and contraction when the suspension body 7 is bent, is lower than the flexural rigidity of the intermediate bearing layer 33, and hence the flexibility in the length direction of the core 21 is improved. With this configuration, when the suspension body 7 is bent, stress generated on the load bearing layer 23 can be reduced.

Sixth Embodiment

Figure 12:
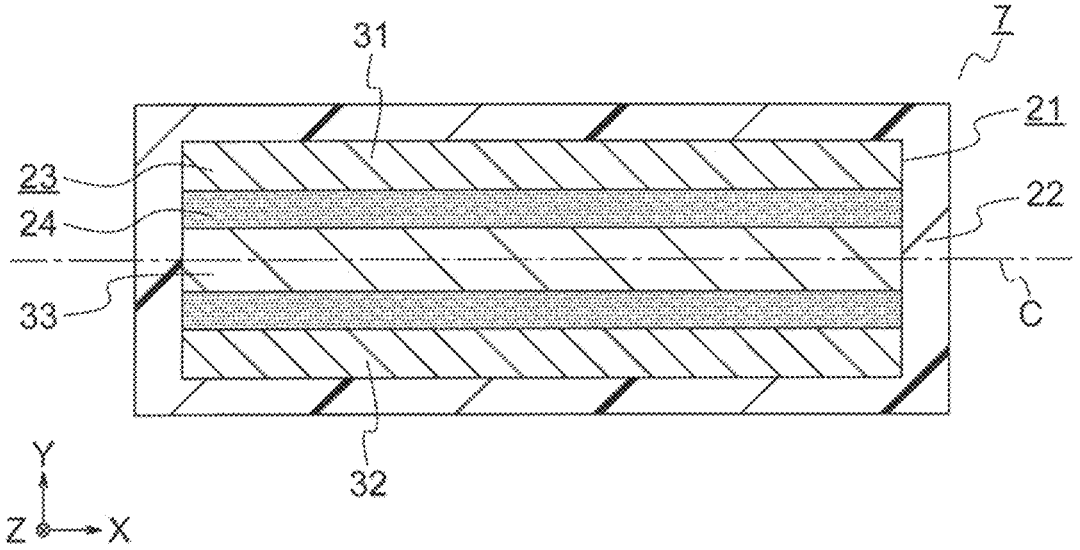
FIG. 12 is a sectional view for illustrating the suspension body for an elevator according to a sixth embodiment of this invention.

Next, FIG. 12 is a sectional view for illustrating the suspension body 7 for an elevator according to a sixth embodiment of this invention. In the sixth embodiment, the same intermediate layer 24 as that in the first embodiment is interposed between the outermost layer 31 and the intermediate bearing layer 33 and between the innermost layer 32 and the intermediate bearing layer 33. That is, the outermost layer 31, the innermost layer 32, and the intermediate bearing layer 33 can be considered as the segment layers 25 in the first embodiment, respectively.

In the above-mentioned suspension body 7, as described in the first embodiment, the intermediate layers 24 are easily deformed in the shearing direction, thereby further improving the flexibility in the length direction of the core 21. In particular, through use of the intermediate layers 24 made of a material having low shear rigidity, when the suspension body 7 is bent, stress generated on the load bearing layer 23 can be further relieved.

Seventh Embodiment

Figure 13:
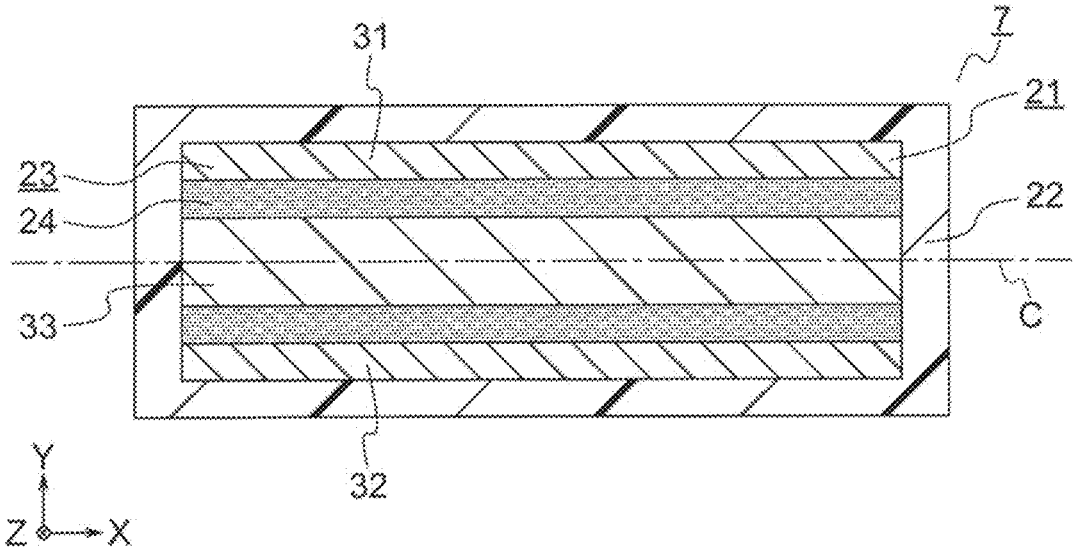
FIG. 13 is a sectional view for illustrating the suspension body for an elevator according to a seventh embodiment of this invention.

Next, FIG. 13 is a sectional view for illustrating the suspension body 7 for an elevator according to a seventh embodiment of this invention. In the seventh embodiment, a thickness dimension of each of the outermost layer 31 and the innermost layer 32 is smaller than a thickness dimension of the intermediate bearing layer 33. With this configuration, the flexural rigidity of the outermost layer 31 and the innermost layer 32 is lower than the flexural rigidity of the intermediate bearing layer 33. The other configurations are the same as those of the sixth embodiment.

Even with this configuration, the flexural rigidity of the outermost layer 31 and the innermost layer 32 can be set lower than the flexural rigidity of the intermediate bearing layer 33, thereby improving the flexibility of the suspension body 7. Further, when the suspension body 7 is wound around the driving sheave 6, stress generated on the outermost layer 31 and the innermost layer 32 can be reduced.

Eighth Embodiment

Figure 14:
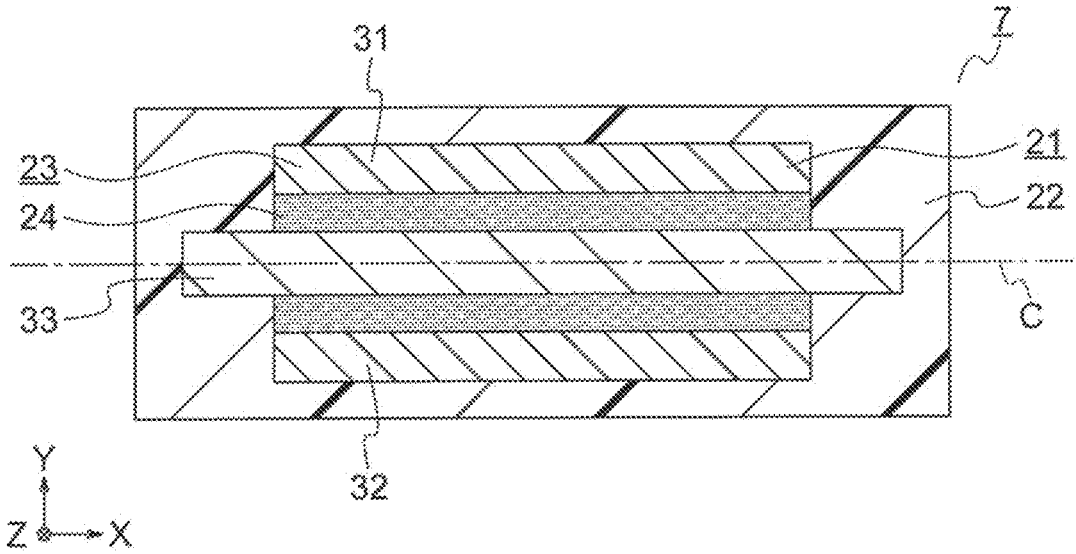
FIG. 14 is a sectional view for illustrating the suspension body for an elevator according to an eighth embodiment of this invention.

Next, FIG. 14 is a sectional view for illustrating the suspension body 7 for an elevator according to an eighth embodiment of this invention. In the eighth embodiment, a width dimension of each of the outermost layer 31 and the innermost layer 32 is smaller than a width dimension of the intermediate bearing layer 33. With this configuration, the flexural rigidity of the outermost layer 31 and the innermost layer 32 is lower than the flexural rigidity of the intermediate bearing layer 33. The other configurations are the same as those of the sixth embodiment.

Even with this configuration, the flexural rigidity of the outermost layer 31 and the innermost layer 32 can be set smaller than the flexural rigidity of the intermediate bearing layer 33, thereby improving the flexibility of the suspension body 7.

Figure 15:
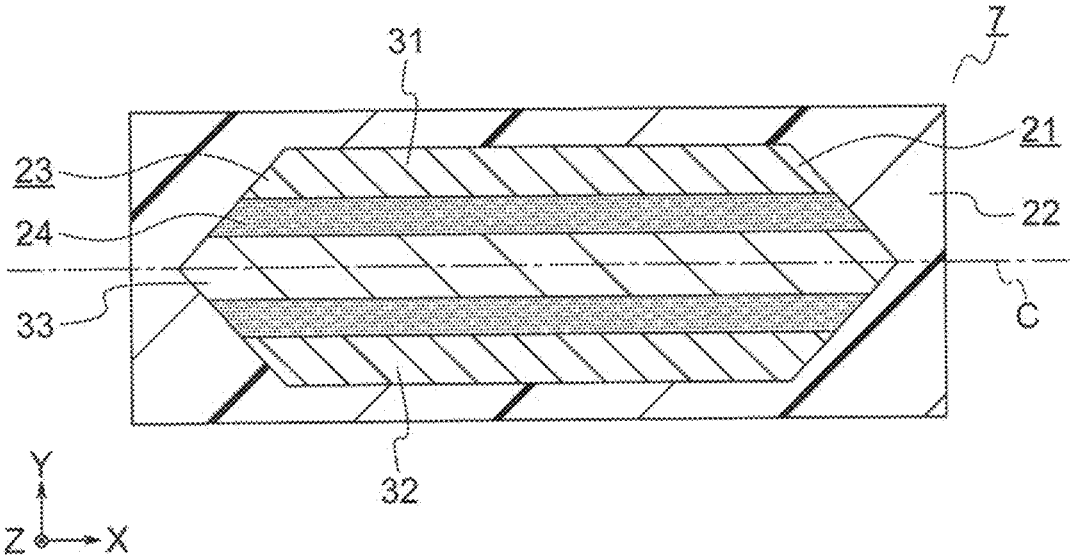
FIG. 15 is a sectional view for illustrating a first modification example of the eighth embodiment.

FIG. 15 is a sectional view for illustrating a first modification example of the eighth embodiment. In the first modification example, both ends of the core 21 in the width direction protrude continuously and gradually toward the outer side in the width direction from both ends of the core 21 in the thickness direction to an intermediate portion thereof. With this configuration, a width dimension of each of the outermost layer 31 and the innermost layer 32 is smaller than a width dimension of the intermediate bearing layer 33. Further, the flexural rigidity of the load bearing layer 23 decreases continuously and gradually from the neutral plane C toward the both ends of the core 21 in the thickness direction.

In this configuration, there is no discontinuous variation in flexural rigidity, and hence strength can be stabilized.

Figure 16:
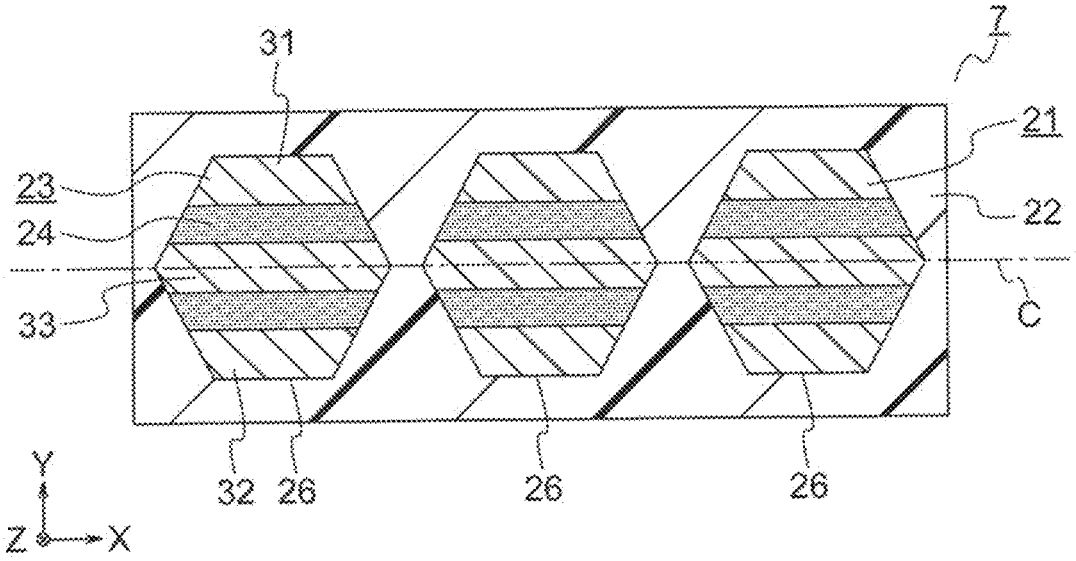
FIG. 16 is a sectional view for illustrating a second modification example of the eighth embodiment.

FIG. 16 is a sectional view for illustrating a second modification example of the eighth embodiment. In the second modification example, similarly to the second embodiment, the core 21 in the first modification example is divided into the plurality of core segments 26 arranged apart from each other in the width direction of the suspension body 7.

Both ends of each core segment 26 in the width direction protrude continuously and gradually toward the outer side in the width direction from both ends of the core segment 26 in the thickness direction to an intermediate portion thereof. With this configuration, the width dimension of each of the outermost layer 31 and the innermost layer 32 is smaller than the width dimension of the intermediate bearing layer 33.

Ninth Embodiment

Figure 17:
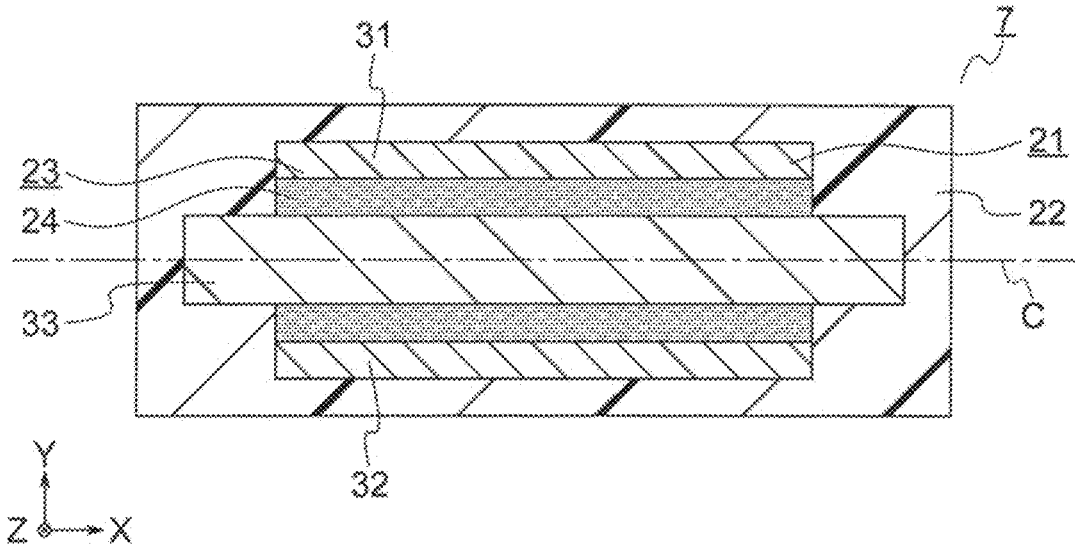
FIG. 17 is a sectional view for illustrating the suspension body for an elevator according to a ninth embodiment of this invention.

Next, FIG. 17 is a sectional view for illustrating the suspension body 7 for an elevator according to a ninth embodiment of this invention. In the ninth embodiment, the thickness dimension of each of the outermost layer 31 and the innermost layer 32 is smaller than the thickness dimension of the intermediate bearing layer 33. Further, the width dimension of each of the outermost layer 31 and the innermost layer 32 is smaller than the width dimension of the intermediate bearing layer 33. With this configuration, the flexural rigidity of the outermost layer 31 and the innermost layer 32 is lower than the flexural rigidity of the intermediate bearing layer 33.

That is, the ninth embodiment is a combination of the seventh embodiment and the eighth embodiment. The other configurations are the same as those of the seventh embodiment or the eighth embodiment.

Figure 18:
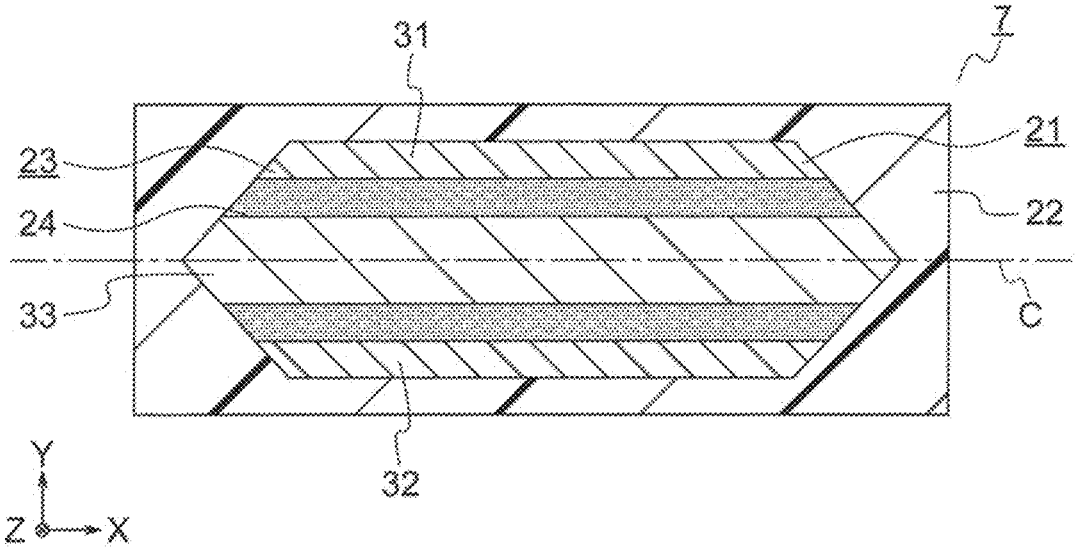
FIG. 18 is a sectional view for illustrating a modification example of the ninth embodiment.

Further, FIG. 18 is a sectional view for illustrating a modification example of the ninth embodiment. This modification example is a combination of the first modification example of the eighth embodiment and the seventh embodiment.

As described above, the configurations in the fifth embodiment to the eighth embodiment for setting the flexural rigidity of the outermost layer 31 and the innermost layer 32 lower than the flexural rigidity of the intermediate bearing layer 33 may be carried out in combination as appropriate.

Tenth Embodiment

Figure 19:
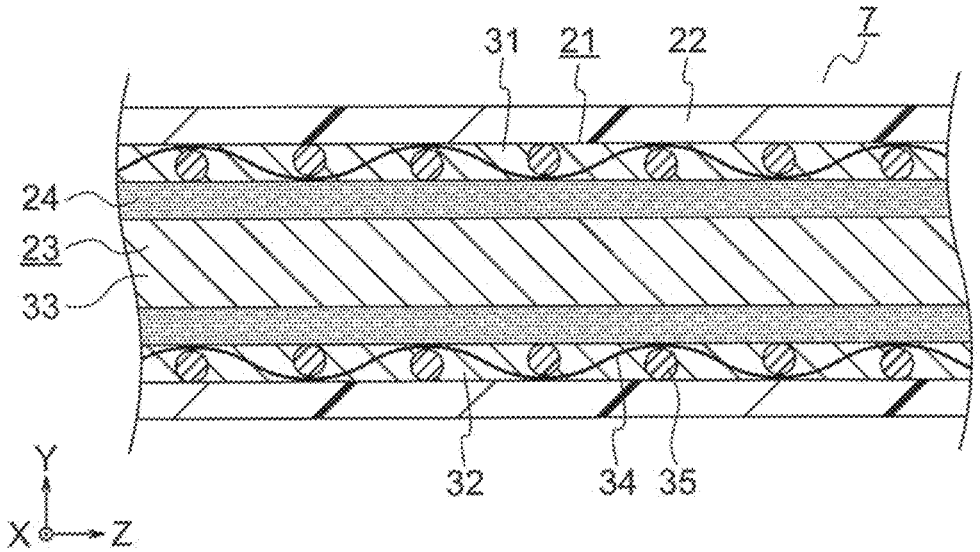
FIG. 19 is a sectional view for illustrating the suspension body for an elevator according to a tenth embodiment of this invention.

Next, FIG. 19 is a sectional view for illustrating the suspension body 7 for an elevator according to a tenth embodiment of this invention, and illustrating a cross section (YZ cross section) of the suspension body 7 taken along the length direction. In the tenth embodiment, high-strength fibers 34 forming the outermost layer 31 and the innermost layer 32 are arranged in a corrugated manner along the length direction of the core 21.

A plurality of bar-like guide members 35 configured to guide the high-strength fibers 34 are provided in each of the outermost layer 31 and the innermost layer 32. The guide members 35 are arranged apart from each other in the length direction of the core 21. Further, the guide members 35 are arranged in parallel to the width direction of the core 21.

Although not shown, the high-strength fibers forming the intermediate bearing layer 33 are arranged in parallel to the length direction of the core 21. With this configuration, the flexural rigidity of the outermost layer 31 and the innermost layer 32 is lower than the flexural rigidity of the intermediate bearing layer 33. The other configurations are the same as those of the seventh embodiment.

Even with this configuration, the flexural rigidity of the outermost layer 31 and the innermost layer 32 can be set lower than the flexural rigidity of the intermediate bearing layer 33, thereby improving the flexibility of the suspension body 7.

The guide members 35 may each be formed of a weft or a bundle of wefts.

Further, when the high-strength fibers 34 can be arranged in a corrugated manner, the guide members 35 may be omitted. For example, there may be used a fabric of the high-strength fibers 34 woven into a corrugated shape in advance.

Moreover, the high-strength fibers 34 having a corrugated shape in the tenth embodiment may be applied to the outermost layer 31 and the innermost layer 32 in the fifth embodiment to the ninth embodiment.

Moreover, in FIG. 12 to FIG. 19, the intermediate layers 24 are used, but the intermediate layers 24 may be omitted.

Further, the fifth embodiment to the tenth embodiment may be carried out in combination with the second embodiment, the third embodiment, and the fourth embodiment as appropriate, and the effects of the respective embodiments can be attained.

Moreover, in the fifth embodiment to the tenth embodiment, the load bearing layer 23 has the three-layer structure. However, the intermediate bearing layer 33 may be divided into a plurality of layers so that the load bearing layer 23 is formed of four or more layers.

Eleventh Embodiment

Figure 20:
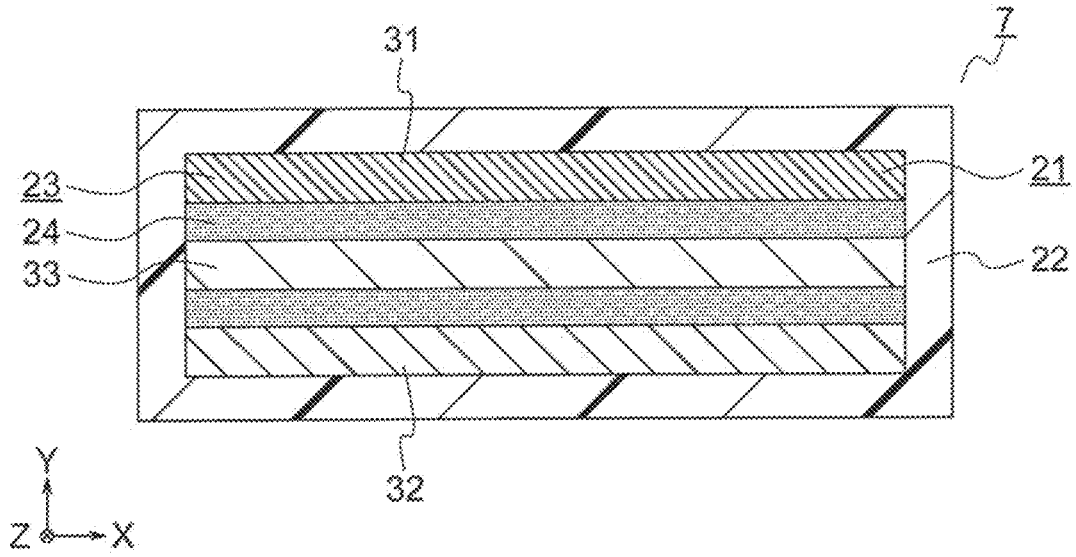
FIG. 20 is a sectional view for illustrating the suspension body for an elevator according to an eleventh embodiment of this invention.

Next, FIG. 20 is a sectional view for illustrating the suspension body 7 for an elevator according to an eleventh embodiment of this invention. In the eleventh embodiment, similarly to the sixth embodiment, the load bearing layer 23 is formed of a plurality of layers divided in the thickness direction of the core, that is, the outermost layer 31, the innermost layer 32, and the intermediate bearing layer 33. However, the flexural rigidity of the outermost layer 31 and the flexural rigidity of the innermost layer 32 are different from each other.

In the eleventh embodiment, the flexural rigidity of the outermost layer 31 is lower than the flexural rigidity of the other layers forming the load bearing layer 23, that is, the flexural rigidity of the innermost layer 32 and the intermediate bearing layer 33. The flexural rigidity of the innermost layer 32 is lower than the flexural rigidity of the intermediate bearing layer 33, or equal to the flexural rigidity of the intermediate bearing layer 33.

As a method of making a difference in rigidity between the outermost layer 31 and the innermost layer 32, the following method is given. For example, by setting the density of the high-strength fibers in the outermost layer 31 lower than the density of the high-strength fibers in each of the innermost layer 32 and the intermediate bearing layer 33, the flexural rigidity of the outermost layer 31 can be set lower than the flexural rigidity of the innermost layer 32 and the intermediate bearing layer 33.

Further, also by setting the modulus of elasticity of the outermost layer 31 lower than the modulus of elasticity of each of the innermost layer 32 and the intermediate bearing layer 33, the flexural rigidity of the outermost layer 31 can be set lower than the flexural rigidity of the innermost layer 32 and the intermediate bearing layer 33. The other configurations are the same as those of the sixth embodiment.

In the above-mentioned suspension body 7, when the suspension body 7 is wound around the driving sheave 6, stress generated on the outermost layer 31 can be reduced. Further, there is a difference in rigidity between one side and another side of the core 21 in the thickness direction, and hence the suspension body 7 is easily bent when being wound around the driving sheave 6. Moreover, when the suspension body 7 receives the compressive load in the length direction from, for example, the hoisting machine brake, the suspension body 7 can be easily bent in one direction.

Twelfth Embodiment

Figure 21:
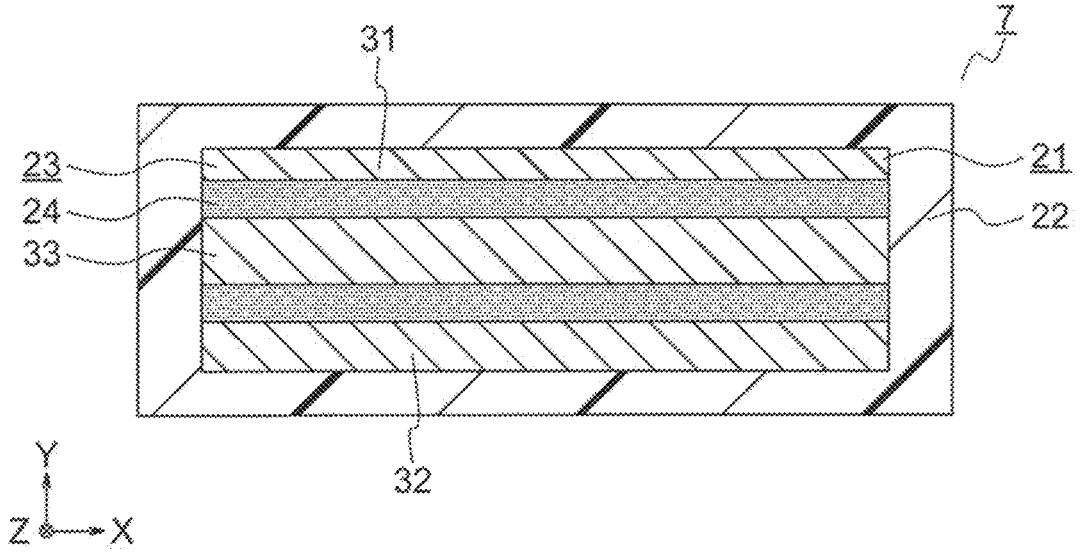
FIG. 21 is a sectional view for illustrating the suspension body for an elevator according to a twelfth embodiment of this invention.

Next, FIG. 21 is a sectional view for illustrating the suspension body 7 for an elevator according to a twelfth embodiment of this invention. In the twelfth embodiment, the thickness dimension of the outermost layer 31 is different from the thickness dimension of the innermost layer 32, and the thickness dimension of the outermost layer 31 is smaller than the thickness dimension of the innermost layer 32. Further, the thickness dimensions of the outermost layer 31 and the innermost layer 32 are smaller than the thickness dimension of the intermediate bearing layer 33. With this configuration, the flexural rigidity of the outermost layer 31 is lower than the flexural rigidity of the innermost layer 32 and the intermediate bearing layer 33. The other configurations are the same as those of the eleventh embodiment.

Even with this configuration, the flexural rigidity of the outermost layer 31 and the innermost layer 32 is lower than the flexural rigidity of the intermediate bearing layer 33, and there is a difference in rigidity between the outermost layer 31 and the innermost layer 32. Accordingly, the suspension body 7 is easily bent when being wound around the driving sheave 6. Further, when the suspension body 7 receives the compressive load in the length direction from, for example, the hoisting machine brake, the suspension body 7 can be easily bent in one direction.

Thirteenth Embodiment

Figure 22:
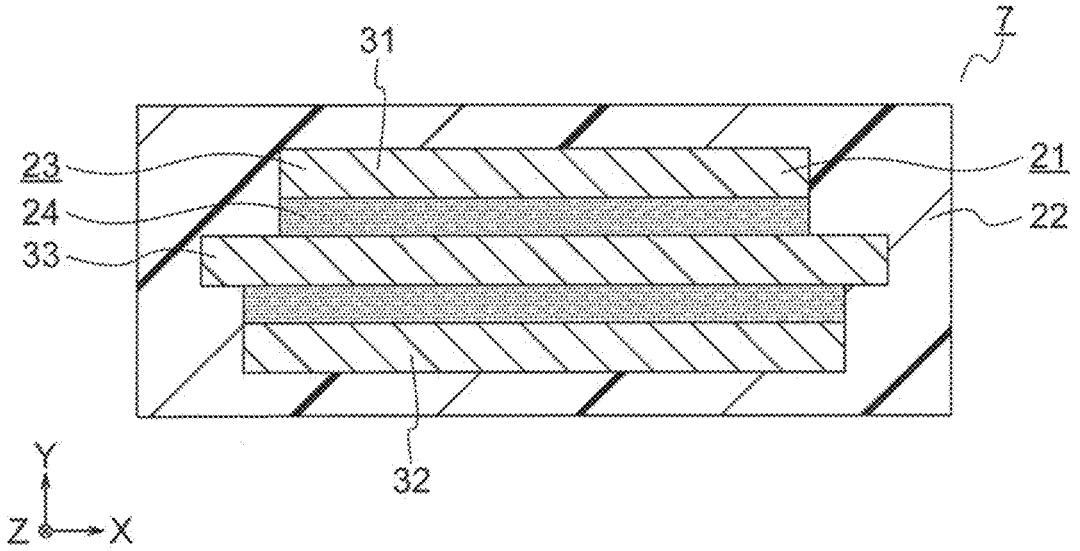
FIG. 22 is a sectional view for illustrating the suspension body for an elevator according to a thirteenth embodiment of this invention.

Next, FIG. 22 is a sectional view for illustrating the suspension body 7 for an elevator according to a thirteenth embodiment of this invention. In the thirteenth embodiment, the width dimension of the outermost layer 31 is smaller than the width dimension of the innermost layer 32. With this configuration, the flexural rigidity of the outermost layer 31 is lower than the flexural rigidity of the innermost layer 32.

Further, the width dimension of the innermost layer 32 is smaller than the width dimension of the intermediate bearing layer 33. With this configuration, the flexural rigidity of the innermost layer 32 is lower than the flexural rigidity of the intermediate bearing layer 33. The other configurations are the same as those of the eleventh embodiment.

Even with this configuration, the flexural rigidity of the outermost layer 31 and the innermost layer 32 is lower than the flexural rigidity of the intermediate bearing layer 33, and there is a difference in rigidity between the outermost layer 31 and the innermost layer 32. Accordingly, the suspension body 7 is easily bent when being wound around the driving sheave 6. Further, when the suspension body 7 receives the compressive load in the length direction from, for example, the hoisting machine brake, the suspension body 7 can be easily bent in one direction.

Fourteenth Embodiment

Figure 23:
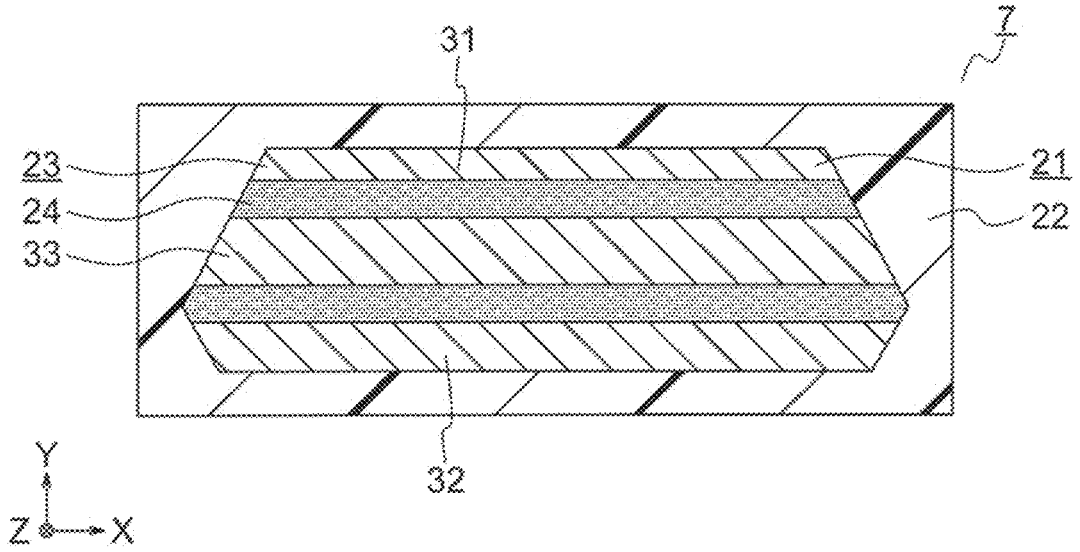
FIG. 23 is a sectional view for illustrating the suspension body for an elevator according to a fourteenth embodiment of this invention.

Next, FIG. 23 is a sectional view for illustrating the suspension body 7 for an elevator according to a fourteenth embodiment of this invention. In the fourteenth embodiment, both ends of the core 21 in the width direction protrude continuously and gradually toward the outer side in the width direction from both ends of the core 21 in the thickness direction to a boundary between the innermost layer 32 and the intermediate layer 24 adjacent thereto.

Further, the thickness dimension of the outermost layer 31 is smaller than the thickness dimensions of the innermost layer 32 and the intermediate bearing layer 33. With this configuration, the flexural rigidity of the outermost layer 31 is lower than the flexural rigidity of the innermost layer 32 and the intermediate bearing layer 33. The other configurations are the same as those of the eleventh embodiment.

Even with this configuration, the flexural rigidity of the outermost layer 31 and the innermost layer 32 is lower than the flexural rigidity of the intermediate bearing layer 33, and there is a difference in rigidity between the outermost layer 31 and the innermost layer 32. Accordingly, the suspension body 7 is easily bent when being wound around the driving sheave 6. Further, when the suspension body 7 receives the compressive load in the length direction from, for example, the hoisting machine brake, the suspension body 7 can be easily bent in one direction.

The configurations in the eleventh embodiment to the fourteenth embodiment for setting the flexural rigidity of the outermost layer 31 lower than the flexural rigidity of the innermost layer 32 and the intermediate bearing layer 33 may be carried out in combination as appropriate.

Further, in FIG. 21 to FIG. 23, the intermediate layers 24 are used, but the intermediate layers 24 may be omitted.

Moreover, the eleventh embodiment to the fourteenth embodiment may be carried out as appropriate in combination with the embodiments described prior to the eleventh embodiment, and the effects of the respective embodiments can be attained.

Moreover, in the eleventh embodiment to the fourteenth embodiment, the load bearing layer 23 has the three-layer structure. However, the intermediate bearing layer 33 may be divided into a plurality of layers so that the load bearing layer 23 is formed of four or more layers.

Fifteenth Embodiment

Figure 24:
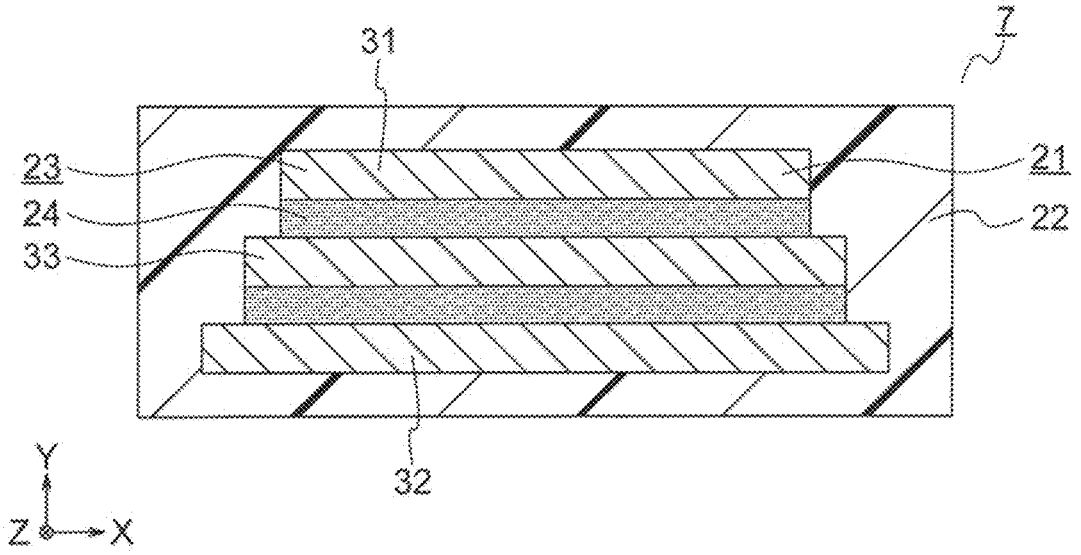
FIG. 24 is a sectional view for illustrating the suspension body for an elevator according to a fifteenth embodiment of this invention.

Next, FIG. 24 is a sectional view for illustrating the suspension body 7 for an elevator according to a fifteenth embodiment of this invention. In the fifteenth embodiment, the width dimension of the intermediate bearing layer 33 is smaller than the width dimension of the innermost layer 32. Further, the width dimension of the outermost layer 31 is smaller than the width dimension of the intermediate bearing layer 33.

With this configuration, the flexural rigidity of the layers forming the load bearing layer 23 decreases gradually from the innermost layer 32 toward the outermost layer 31. That is, the flexural rigidity of the intermediate bearing layer 33 is lower than the flexural rigidity of the innermost layer 32, and the flexural rigidity of the outermost layer 31 is lower than the flexural rigidity of the intermediate bearing layer 33. The other configurations are the same as those of the first embodiment.

In the above-mentioned suspension body 7, there is a difference in rigidity between the outermost layer 31 and the innermost layer 32. Accordingly, the suspension body 7 is easily bent when being wound around the driving sheave 6.

Further, there is a difference in rigidity between one side and another side of the core 21 in the thickness direction. Accordingly, when the suspension body 7 receives the compressive load in the length direction from, for example, the hoisting machine brake, the suspension body 7 can be easily bent in one direction and be less likely to buckle.

Figure 25:
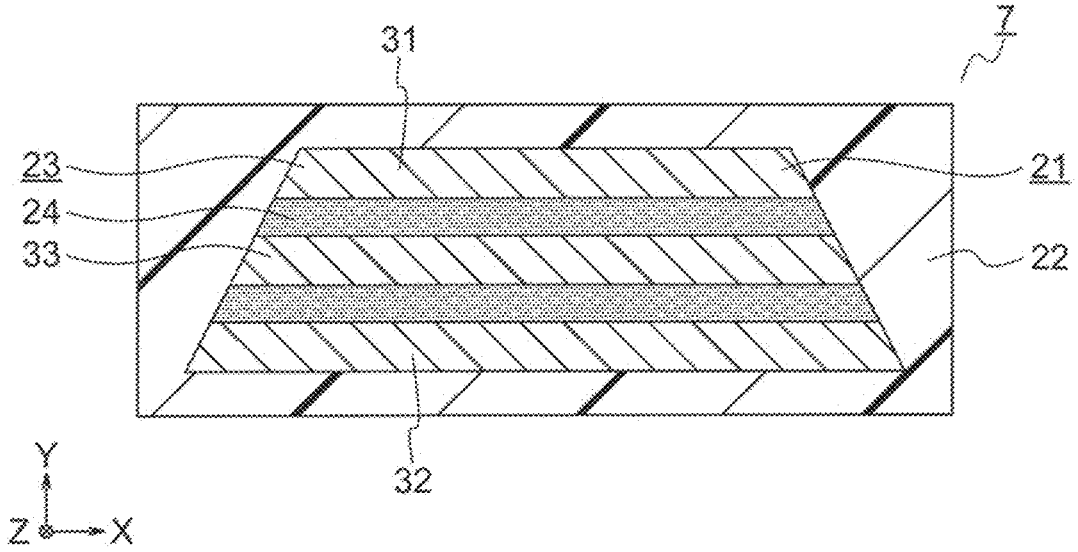
FIG. 25 is a sectional view for illustrating a first modification example of the fifteenth embodiment.

FIG. 25 is a sectional view for illustrating a first modification example of the fifteenth embodiment. In the first modification example, the width dimension of the core 21 decreases continuously and gradually from an end portion of the core 21 on a radially inner side of the driving sheave 6 toward an end portion of the core 21 on a radially outer side thereof when the suspension body 7 is bent along the driving sheave 6. With this configuration, the flexural rigidity of the layers forming the load bearing layer 23 decreases continuously and gradually from the radially inner side toward the radially outer side.

Figure 26:
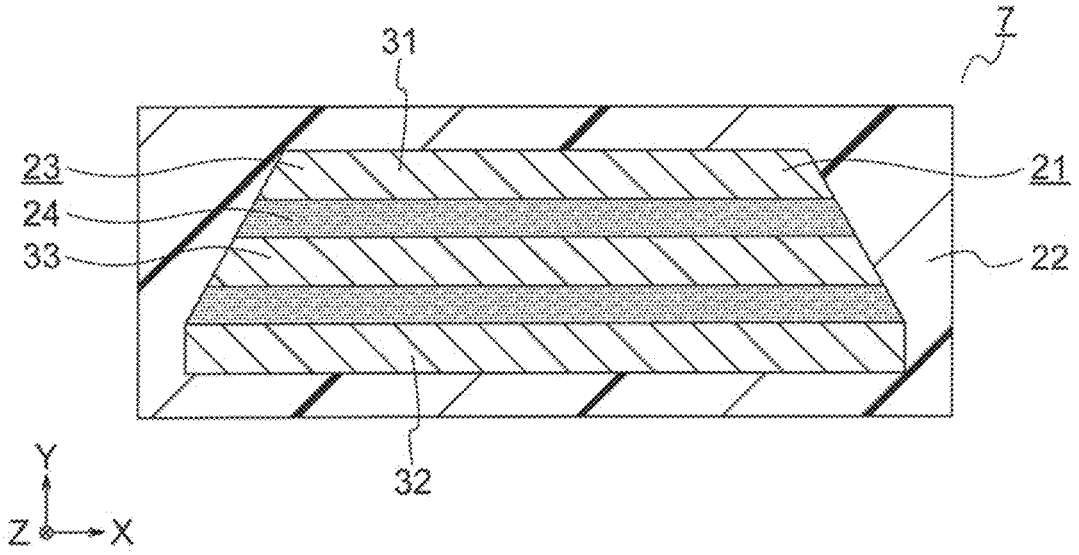
FIG. 26 is a sectional view for illustrating a second modification example of the fifteenth embodiment.

FIG. 26 is a sectional view for illustrating a second modification example of the fifteenth embodiment. In the second modification example, the width dimension of the core 21 decreases continuously and gradually from the boundary between the innermost layer 32 and the intermediate layer 24 adjacent thereto toward the radially outer side. With this configuration, the flexural rigidity of the layers forming the load bearing layer 23 decreases continuously and gradually from the radially inner side toward the radially outer side.

In the configurations illustrated in FIG. 25 and FIG. 26, there is no discontinuous variation in flexural rigidity, and hence the strength can be stabilized.

In FIG. 24 to FIG. 26, the intermediate layers 24 are used, but the intermediate layers 24 may be omitted.

Further, the fifteenth embodiment may be carried out in combination with, for example, the second embodiment, the third embodiment, the fourth embodiment, and the tenth embodiment as appropriate, and the effects of the respective embodiments can be attained.

Moreover, in the fifteenth embodiment, the load bearing layer 23 has the three-layer structure. However, the intermediate bearing layer 33 may be divided into a plurality of layers so that the load bearing layer 23 is formed of four or more layers.

Moreover, in the eleventh embodiment to the fourteenth embodiment, the flexural rigidity of the outermost layer 31 is set lower than the flexural rigidity of the innermost layer 32, but the flexural rigidity of the innermost layer 32 may be set lower than the flexural rigidity of the outermost layer 31. That is, the configurations illustrated in FIG. 20 to FIG. 23 may be inverted.

Further, in the fifteenth embodiment, the flexural rigidity of the load bearing layer 23 is set to become gradually lower from the radially inner side toward the radially outer side, but the flexural rigidity of the load bearing layer 23 may be set to become gradually lower from the radially outer side toward the radially inner side. That is, the configurations illustrated in FIG. 24 to FIG. 26 may be inverted.

Sixteenth Embodiment

Figure 27:
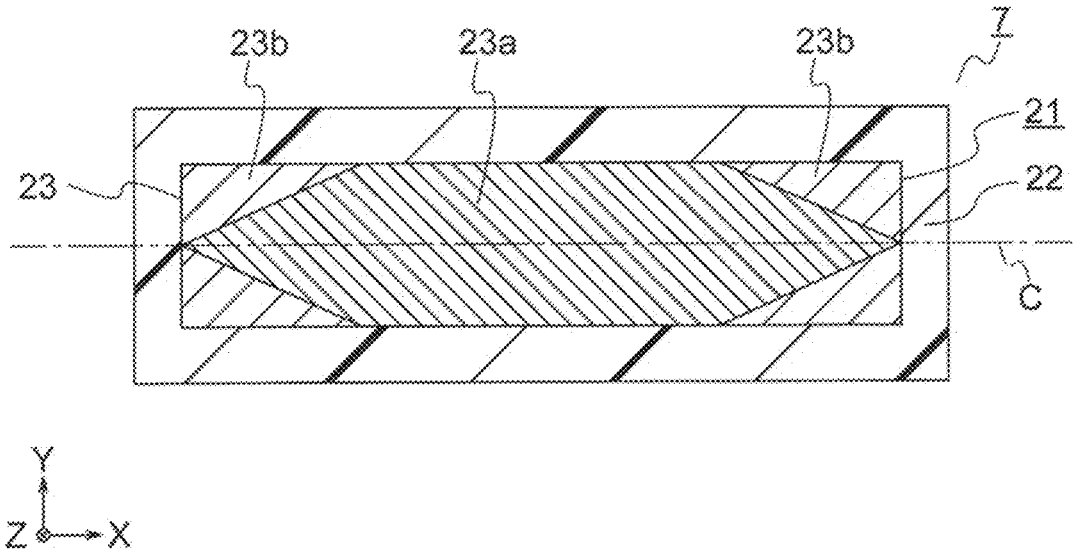
FIG. 27 is a sectional view for illustrating the suspension body for an elevator according to a sixteenth embodiment of this invention.

Next, FIG. 27 is a sectional view for illustrating the suspension body 7 for an elevator according to a sixteenth embodiment of this invention. In the sixteenth embodiment, the core 21 includes only the load bearing layer 23. The cross section of the load bearing layer 23 perpendicular to the length direction of the core 21 is formed by a combination of a first region 23*a* and a plurality of second regions 23*b*.

The fiber density of the high-strength fibers in each of the second regions 23*b* is lower than the fiber density of the high-strength fibers in the first region 23*a*.

The first region 23*a* and the second regions 23*b* are combined so that a value of E×W, which is a product of a modulus of elasticity E and a width W of the load bearing layer 23 in each end of the core 21 in the thickness direction, is smaller than a value of E×W, which is a product of the modulus of elasticity E and the width W of the load bearing layer 23 in the neutral plane C of the core 21.

In FIG. 27, the load bearing layer 23 has a rectangular cross section having constant width dimensions. In the cross section perpendicular to the length direction of the core 21, a width dimension of the first region 23*a* decreases continuously and gradually from the neutral plane C toward both ends of the core 21 in the thickness direction.

With this configuration, the first region 23*a* becomes continuously and gradually narrower from the neutral plane C in the thickness direction of the core, and the second regions 23*b* become continuously and gradually wider. The other configurations are the same as those of the first embodiment.

In the above-mentioned suspension body 7, a portion of the core 21 on the front surface side, which is distant from the neutral plane C, has low flexural rigidity, and hence flexibility in the length direction of the core 21 is improved.

Figure 28:
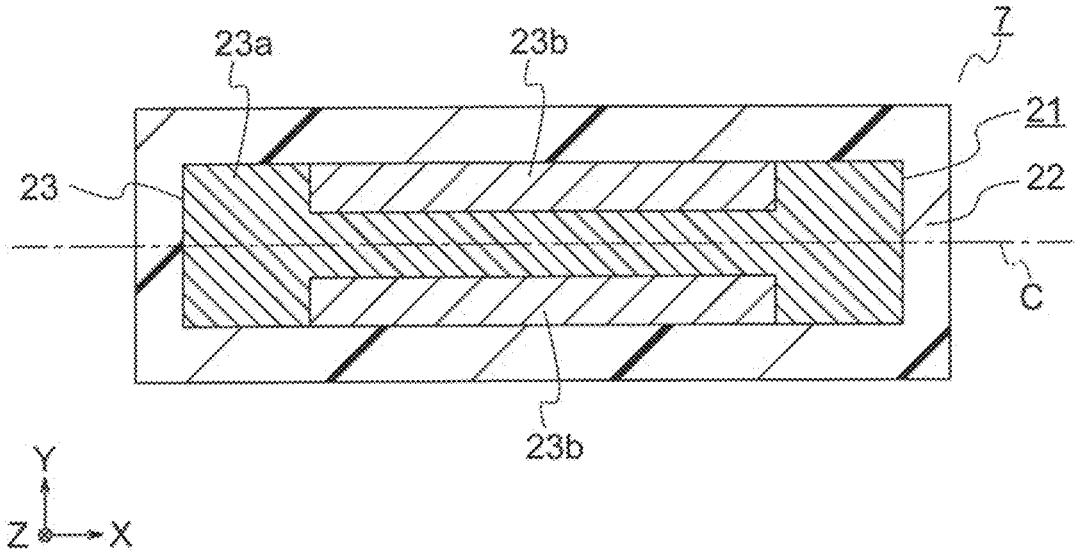
FIG. 28 is a sectional view for illustrating a first modification example of the sixteenth embodiment.

FIG. 28 is a sectional view for illustrating a first modification example of the sixteenth embodiment. In the first modification example, in the cross section perpendicular to the length direction of the core 21, recessed portions are formed in widthwise centers of both end surfaces of the load bearing layer 23 in the thickness direction of the core 21. Insides of the recessed portions correspond to the second regions 23*b*, and the remaining portion corresponds to the first region 23*a*.

Figure 29:
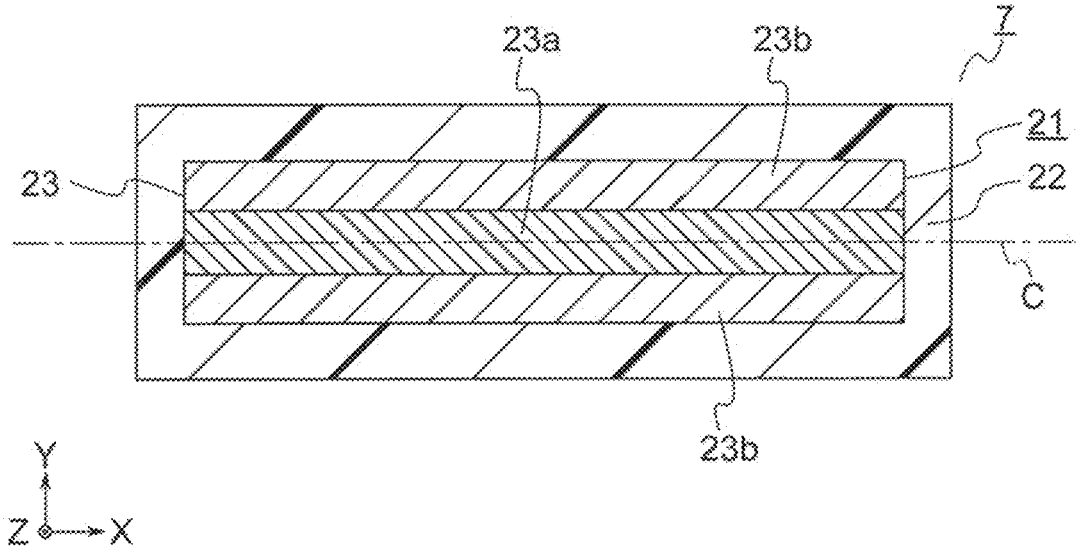
FIG. 29 is a sectional view for illustrating a second modification example of the sixteenth embodiment.

FIG. 29 is a sectional view for illustrating a second modification example of the sixteenth embodiment. In the second modification example, an entire intermediate portion of the load bearing layer 23 in the thickness direction of the core 21 corresponds to the first region 23*a*. Both end portions of the load bearing layer 23 in the thickness direction of the core 21 correspond to the second regions 23*b*.

Figure 30:
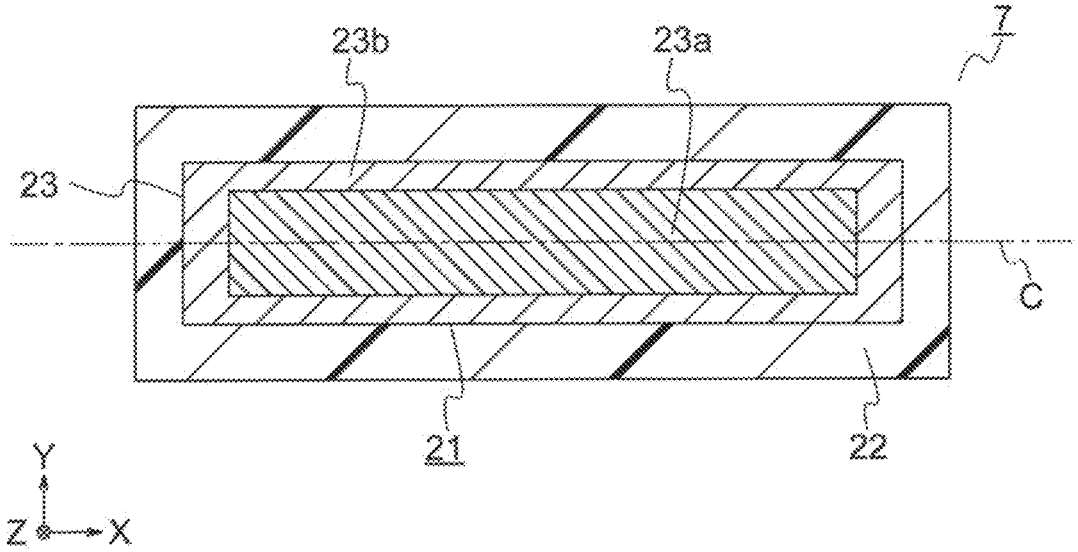
FIG. 30 is a sectional view for illustrating a third modification example of the sixteenth embodiment.

FIG. 30 is a sectional view for illustrating a third modification example of the sixteenth embodiment. In the third modification example, the load bearing layer inside the core 21 corresponds to the first region 23*a*, and the second region 23*b* is formed so as to cover the first region 23*a*.

Further, the region 23*b* may have a configuration without the high-strength fibers. The region 23*b* may be made of, for example, a thermoplastic resin, a thermosetting resin, or an elastomeric material, or may be formed of a lubricant prevented from adhering to the first region 23*a* or a sheet having a low frictional property. Further, a plurality of sheets can be arranged in layers, and a liquid lubricant, a semi-solid lubricant, and a solid lubricant may be used in combination. For example, a configuration in which the liquid lubricant is arranged on a surface of the sheet of the solid lubricant is conceivable. With this configuration, the flexural rigidity of the suspension body 7 can be further reduced.

Even with the configurations illustrated in FIG. 28 to FIG. 30, the value of E×W of the load bearing layer 23 at each end of the core 21 in the thickness direction is smaller than the value of E×W of the load bearing layer 23 at the neutral plane C of the core 21.

In the sixteenth embodiment, the fiber density of the second region 23*b* is set lower than the fiber density of the first region 23*a*, but the modulus of elasticity of the second region 23*b* in the length direction may be set lower than the modulus of elasticity of the first region 23*a* in the length direction.

Seventeenth Embodiment

Figure 31:
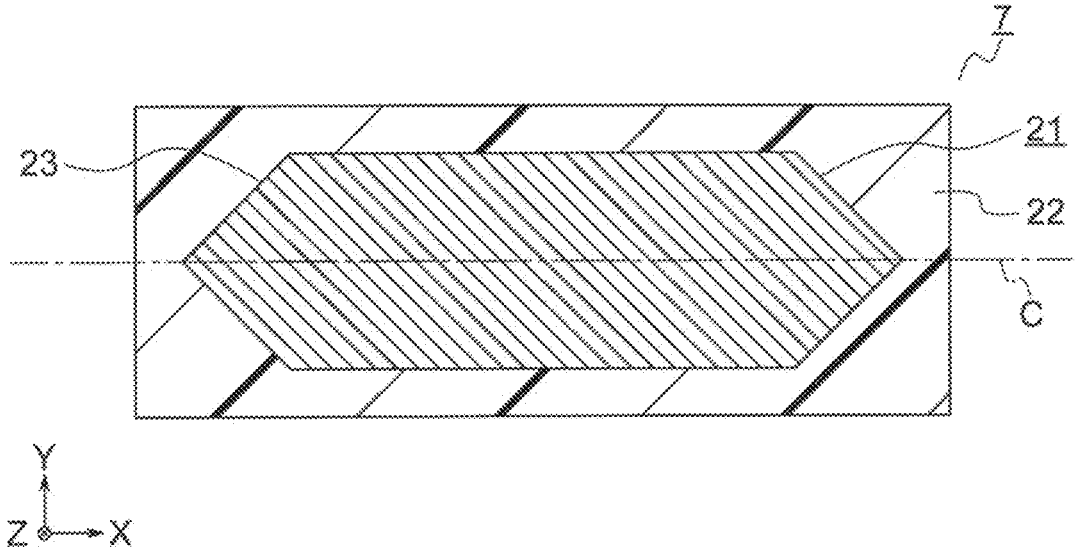
FIG. 31 is a sectional view for illustrating the suspension body for an elevator according to a seventeenth embodiment of this invention.

Next, FIG. 31 is a sectional view for illustrating the suspension body 7 for an elevator according to a seventeenth embodiment of this invention. In the seventeenth embodiment, the core 21 includes only the load bearing layer 23. Further, in the cross section perpendicular to the length direction of the core 21, the entire load bearing layer 23 is made of the same material and has the same fiber density. However, the width dimension of the load bearing layer 23 decreases continuously and gradually from the neutral plane C toward both ends of the core 21 in the thickness direction.

With this configuration, the value of E×W of the load bearing layer 23 at each end of the core 21 in the thickness direction is smaller than the value of E×W of the load bearing layer 23 at the neutral plane C of the core 21.

In FIG. 27 to FIG. 31, the neutral plane C is arranged at the center of the core 21 in the thickness direction, but the neutral plane C may be shifted from the center to any one side in the thickness direction.

Further, FIG. 27 to FIG. 31 are illustrations of examples of a method in which, in the cross section perpendicular to the length direction of the core 21, the value E×W of the load bearing layer 23 at each end of the core 21 in the thickness direction is set smaller than the value E×W of the load bearing layer 23 at the neutral plane C of the core 21. The sectional configurations are not limited thereto.

Moreover, in the sixteenth embodiment and the seventeenth embodiment, the value E×W of the load bearing layer 23 at each end of the core 21 in the thickness direction is smaller than the value E×W of the load bearing layer 23 at the neutral plane C of the core 21. However, only the value of E×W of the load bearing layer 23 at any one of both ends of the core 21 in the thickness direction may be set smaller than the value E×W of the load bearing layer 23 at the neutral plane C of the core 21.

Eighteenth Embodiment

Figure 32:
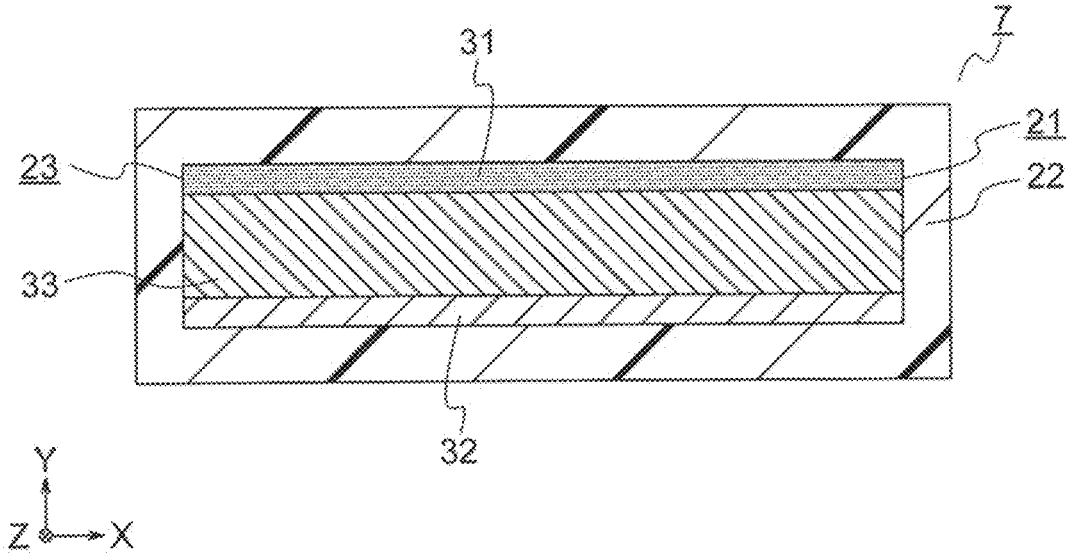
FIG. 32 is a sectional view for illustrating the suspension body for an elevator according to an eighteenth embodiment of this invention.

Next, FIG. 32 is a sectional view for illustrating the suspension body 7 for an elevator according to an eighteenth embodiment of this invention. In the eighteenth embodiment, the core 21 includes only the load bearing layer 23. The load bearing layer 23 includes the outermost layer 31, the innermost layer 32, and the intermediate bearing layer 33.

The fiber density of the high-strength fibers in the outermost layer 31 is lower than the fiber density of the high-strength fibers in the innermost layer 32. With this configuration, the values of E×W of the load bearing layer 23 at both ends of the core 21 in the thickness direction are different from each other.

Specifically, a value of E×B of the load bearing layer 23 at an end surface on a radially outer side of the driving sheave 6 when the suspension body 7 is bent along the driving sheave 6 is smaller than a value of E×B of the load bearing layer 23 at an end surface on a radially inner side thereof. Therefore, in the cross section perpendicular to the length direction of the core 21, the flexural rigidity per unit thickness of the load bearing layer 23 at the end portion on the radially outer side of the driving sheave 6 is lower than the flexural rigidity per unit thickness of the load bearing layer 23 at the end portion on the radially inner side thereof. The other configurations are the same as those of the sixteenth embodiment.

In the above-mentioned suspension body 7, when the suspension body 7 is bent along the driving sheave 6, compressive stress generated on the core 21 can be reduced.

Moreover, there is a difference in rigidity between one side and another side of the core 21 in the thickness direction. Thus, when the suspension body 7 receives the compressive load in the length direction from, for example, the hoisting machine brake, the suspension body 7 can be easily bent in one direction.

In the eighteenth embodiment, the fiber density of the outermost layer 31 is set lower than the fiber density of the innermost layer 32, but the modulus of elasticity of the outermost layer 31 may be set lower than the modulus of elasticity of the innermost layer 32.

Nineteenth Embodiment

Figure 33:
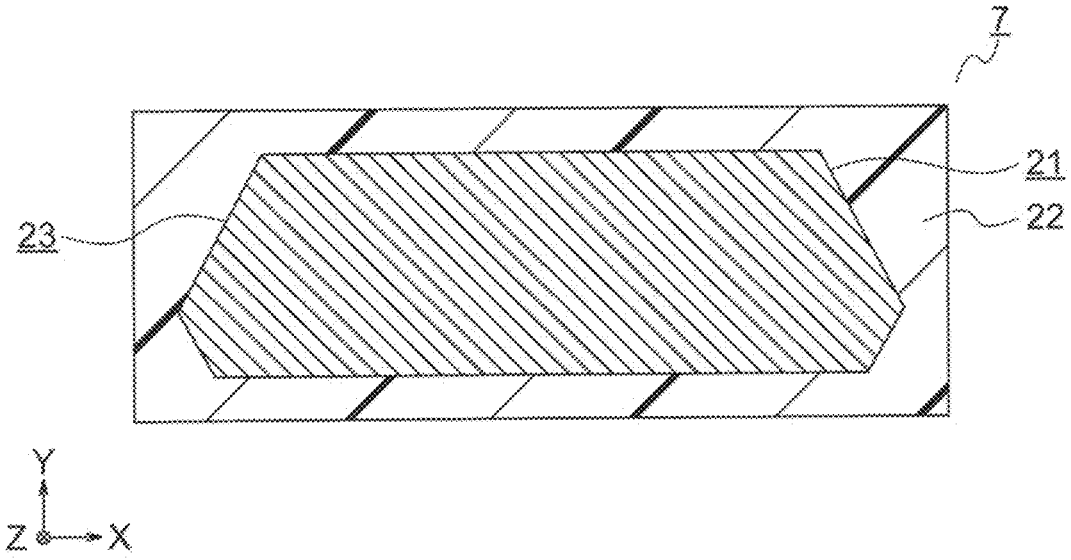
FIG. 33 is a sectional view for illustrating the suspension body for an elevator according to a nineteenth embodiment of this invention.

Next, FIG. 33 is a sectional view for illustrating the suspension body 7 for an elevator according to a nineteenth embodiment of this invention. In the nineteenth embodiment, in the cross section perpendicular to the length direction of the core 21, the entire load bearing layer 23 is made of the same material and has the same fiber density.

However, the width dimension of the load bearing layer 23 at the end surface on the radially outer side of the driving sheave 6 when the suspension body 7 is bent along the driving sheave 6 is smaller than the width dimension of the load bearing layer 23 at the end surface on the radially inner side thereof. With this configuration, the value of E×B of the load bearing layer 23 at the end surface on the radially outer side is smaller than the value of E×B of the load bearing layer 23 at the end surface on the radially inner side thereof.

Therefore, in the cross section perpendicular to the length direction of the core 21, the flexural rigidity per unit thickness of the load bearing layer 23 at the end portion on the radially outer side of the driving sheave 6 is lower than the flexural rigidity per unit thickness of the load bearing layer 23 at the end portion on the radially inner side thereof.

Further, the width dimension of the load bearing layer 23 continuously varies in the thickness direction of the core 21. The other configurations are the same as those of the eighteenth embodiment.

Even with this configuration, the flexibility in the length direction of the core 21 can be improved. Further, there is a difference in rigidity between one side and another side in the thickness direction of the core 21. Thus, when the suspension body 7 receives the compressive load in the length direction from, for example, the hoisting machine brake, the suspension body 7 can be easily bent in one direction.

Figure 34:
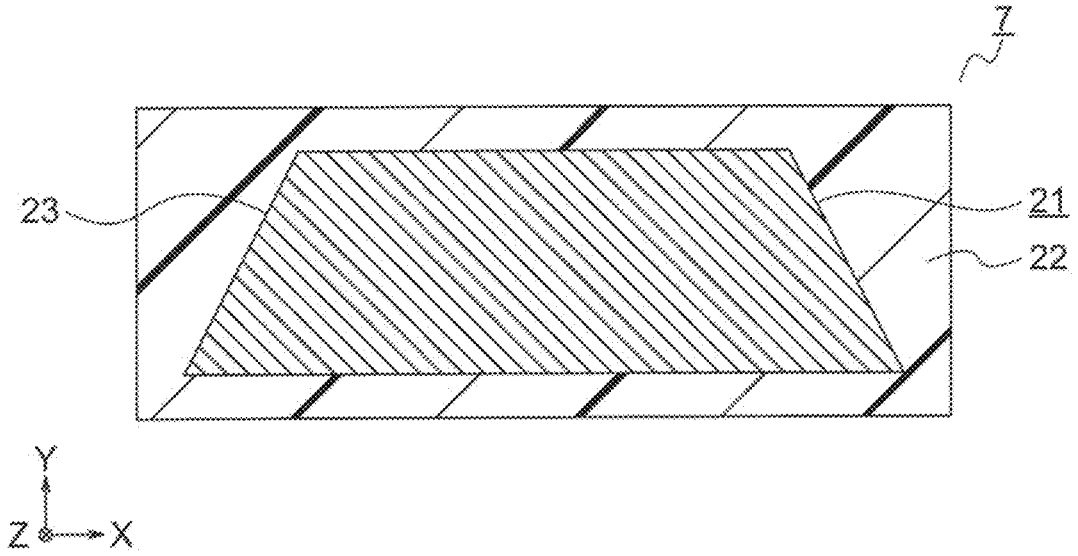
FIG. 34 is a sectional view for illustrating a modification example of the nineteenth embodiment.

FIG. 34 is a sectional view for illustrating a modification example of the nineteenth embodiment. In this modification example, the width dimension of the load bearing layer 23 decreases continuously and gradually from the radially inner side toward the radially outer side. Even with this sectional shape, values of E×B of the load bearing layer 23 at both end surfaces in the thickness direction of the core 21 can be different from each other.

The sectional shape of the load bearing layer 23 is not limited to that illustrated in FIG. 33 or FIG. 34.

Twentieth Embodiment

Figure 35:
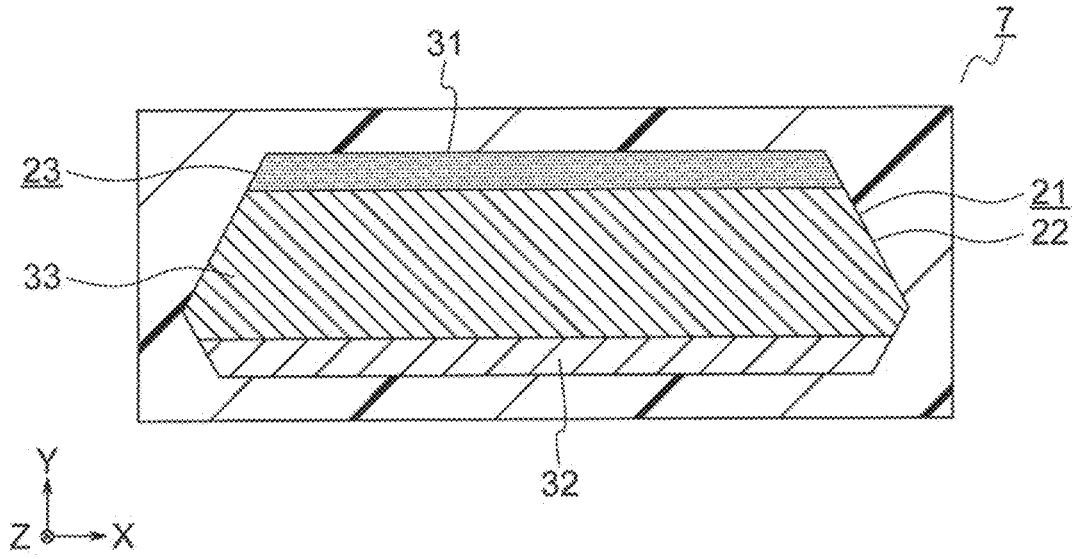
FIG. 35 is a sectional view for illustrating the suspension body for an elevator according to a twentieth embodiment of this invention.

Next, FIG. 35 is a sectional view for illustrating the suspension body 7 for an elevator according to a twentieth embodiment of this invention. The twentieth embodiment is a combination of the eighteenth embodiment and the nineteenth embodiment. That is, the load bearing layer 23 in the twentieth embodiment includes the outermost layer 31, the innermost layer 32, and the intermediate bearing layer 33. Further, the width dimension of the load bearing layer 23 varies in a manner similar to that in FIG. 33. The other configurations are the same as those of the eighteenth embodiment.

As described above, through combination of the eighteenth embodiment and the nineteenth embodiment, the effects greater than those of the eighteenth embodiment and the nineteenth embodiment can be attained.

The nineteenth embodiment and the modification example of the eighteenth embodiment may be combined.

Further, in the eighteenth embodiment to the twentieth embodiment, the load bearing layer 23 may be formed of two layers or four or more layers.

Moreover, when the load bearing layer 23 is formed of a plurality of layers, the intermediate layer 24 as described in the first embodiment to the fourth embodiment may be interposed.

Moreover, in the eighteenth embodiment to the twentieth embodiment, the value of E×B of the load bearing layer 23 at the end surface on the radially outer side is set smaller than the value of E×B of the load bearing layer 23 at the end surface on the radially inner side, but the values of E×B may be set in reverse. That is, the configurations illustrated in FIG. 32 to FIG. 35 may be inverted. Thus, in the cross section perpendicular to the length direction of the core 21, the flexural rigidity per unit thickness of the load bearing layer 23 at the end portion on the radially inner side of the driving sheave 6 may be set lower than the flexural rigidity per unit thickness of the load bearing layer 23 at the end portion on the radially outer side thereof. With this configuration, when the suspension body 7 is bent along the driving sheave 6, tensile stress generated on the core 21 can be reduced.

Twenty-First Embodiment

Figure 36:
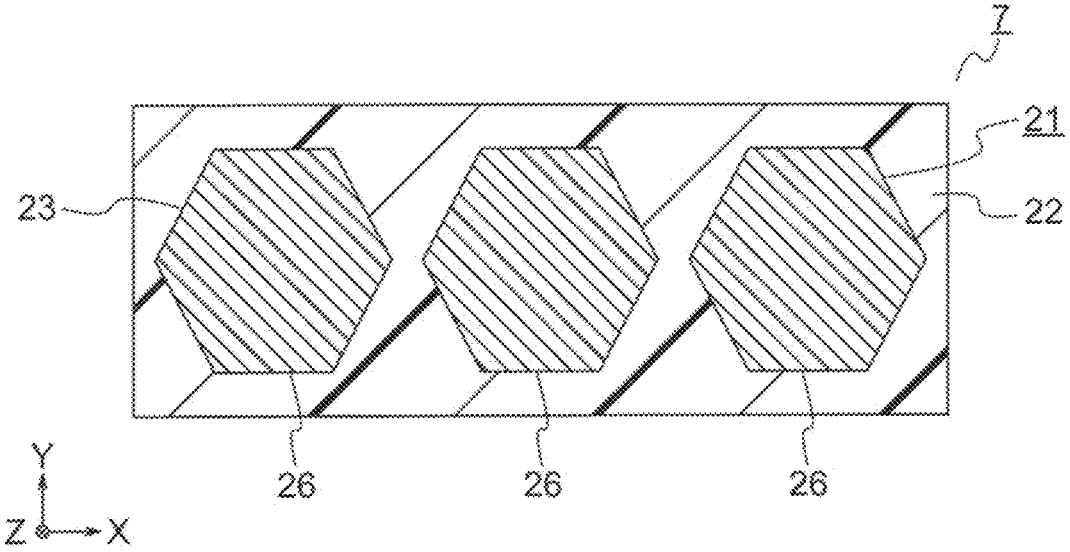
FIG. 36 is a sectional view for illustrating the suspension body for an elevator according to a twenty-first embodiment of this invention.

Next, FIG. 36 is a sectional view for illustrating the suspension body 7 for an elevator according to a twenty-first embodiment of this invention. In the twenty-first embodiment, the core 21 includes only the load bearing layer 23. However, similarly to the second modification example of the eighth embodiment, the core 21 is divided into three core segments 26. Further, the covering layer 22 enters a region between the core segments 26 adjacent to each other in the width direction of the suspension body 7. The other configurations and shapes of the core segments 26 are the same as those of the second modification example of the eighth embodiment.

In the above-mentioned suspension body 7, the resin of the covering layer 22 is interposed between the core segments 26, and hence the suspension body 7 is easily bent in the width direction thereof. Thus, when a surface of the driving sheave 6 to be brought into contact with the suspension body 7 is curved in the width direction of the suspension body 7, the suspension body 7 is easily bent along the driving sheave 6. Thus, when the suspension body 7 is bent, stress generated on the load bearing layer 23 can be reduced.

The number of segments of the core 21 may be any number equal to or more than two.

Further, also in embodiments other than the second embodiment and the eighth embodiment, the core 21 can be divided into the plurality of core segments 26.

Twenty-Second Embodiment

Figure 37:
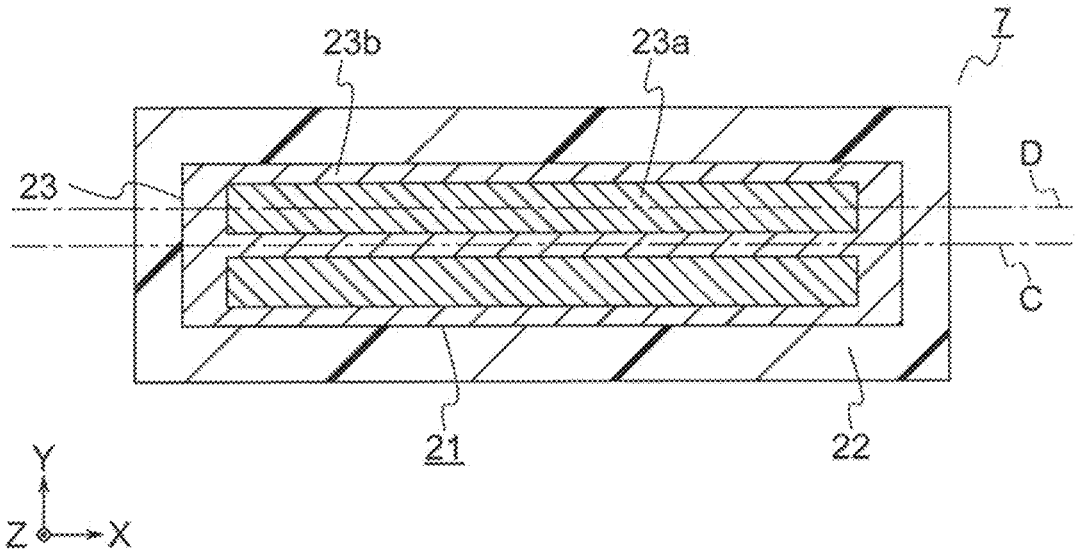
FIG. 37 is a sectional view for illustrating the suspension body for an elevator according to a twenty-second embodiment of this invention.

Next, FIG. 37 is a sectional view for illustrating the suspension body 7 for an elevator according to a twenty-second embodiment of this invention. In the twenty-second embodiment, the core 21 includes only the load bearing layer 23. The cross section of the load bearing layer 23 perpendicular to the length direction of the core 21 is formed of a combination of the plurality of first regions 23*a* and the second region 23*b*. The modulus of elasticity of the second region 23*b* in the length direction is lower than the modulus of elasticity of each of the first regions 23*a* in the length direction.

The first regions 23*a* and the second region 23*b* are combined so that a value of E×W, which is a product of a modulus of elasticity E and a width W of the second region 23*b* in each end of the core 21 in the thickness direction, is smaller than a value of E×W, which is a product of the modulus of elasticity E and the width W in a plane D that is located on an inner side of the core 21 in the thickness direction and includes the first region 23*a*.

In the above-mentioned suspension body 7, a portion of the core 21 on the front surface side, which is distant from the neutral plane C, has low flexural rigidity, and hence the flexibility in the length direction of the core 21 is improved.

Further, the second region 23*b* may have a configuration without the high-strength fibers. The second region 23*b* may be made of, for example, a thermoplastic resin, a thermosetting resin, or an elastomeric material, or may be formed of a lubricant prevented from adhering to the first region 23*a* or a sheet having a low frictional property. Further, a plurality of sheets can be arranged in layers, and a liquid lubricant, a semi-solid lubricant, and a solid lubricant may be used in combination. For example, a configuration in which the liquid lubricant is arranged on a surface of the sheet of the solid lubricant is conceivable. With this configuration, the flexural rigidity of the suspension body 7 can be further reduced.

The first regions 23*a* in the twenty-second embodiment illustrated in FIG. 37 are formed of two layers, but may be formed of three or more layers.

Figure 38:
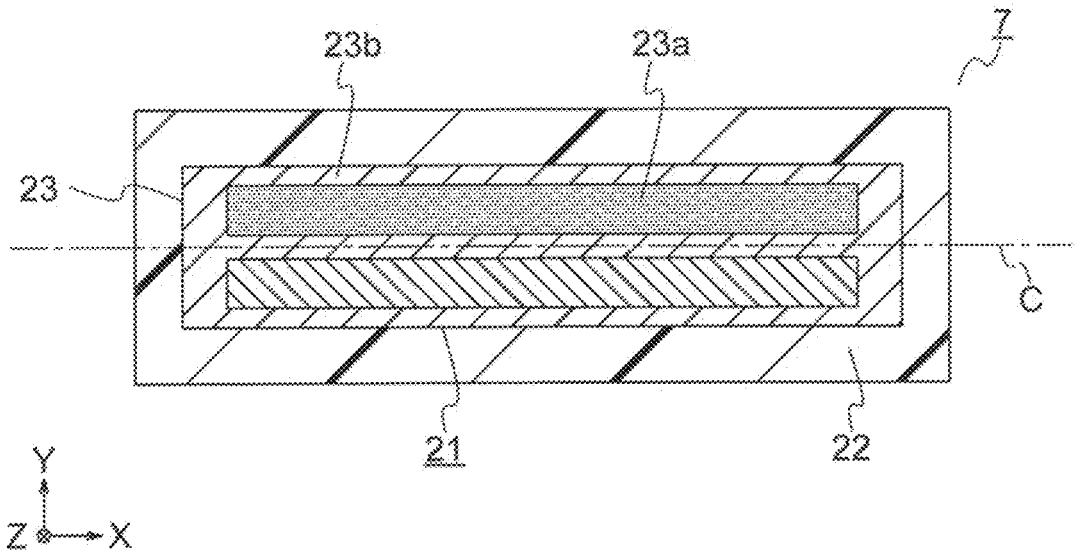
FIG. 38 is a sectional view for illustrating a first modification example of the twenty-second embodiment.

FIG. 38 is a sectional view for illustrating a first modification example of the twenty-second embodiment. In the first modification example, the modulus of elasticity in the length direction of the first region 23*a* on the outermost layer side is lower than the modulus of elasticity in the length direction of the first region 23*a* on the innermost layer side.

With such a configuration, the flexural rigidity of the first region 23*a* on the outermost layer side is lower than the flexural rigidity of the first region 23*a* on the innermost layer side, and there is a difference in rigidity between one side and another side in the thickness direction of the core 21. Thus, when the suspension body 7 receives the compressive load in the length direction from, for example, the hoisting machine brake, the suspension body 7 can be easily bent in one direction.

Figure 39:
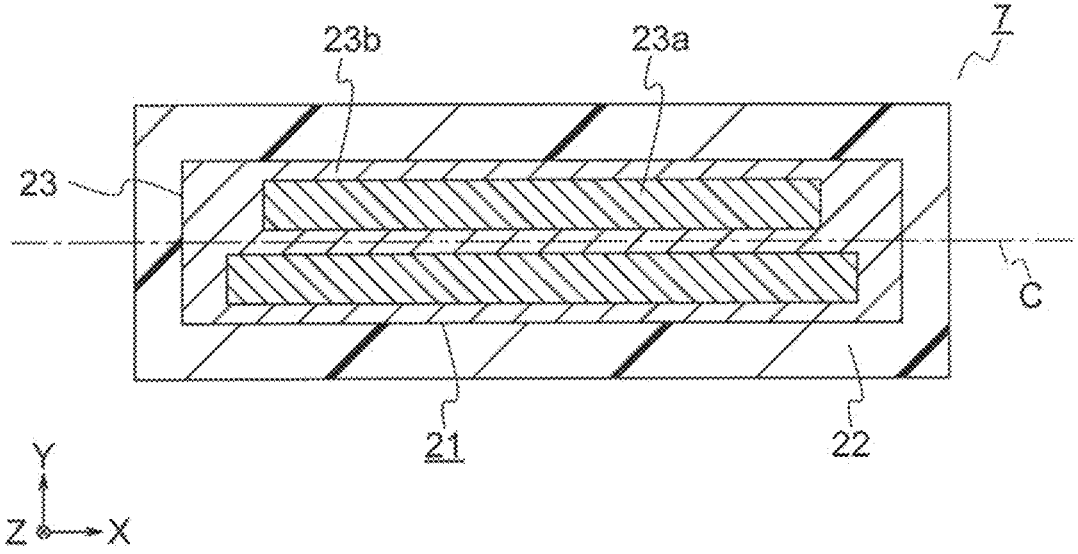
FIG. 39 is a sectional view for illustrating a second modification example of the twenty-second embodiment.

FIG. 39 is a sectional view for illustrating a second modification example of the twenty-second embodiment. In the second modification example, the width dimension of the first region 23*a* on the outermost layer side is smaller than the width dimension of the first region 23*a* on the innermost layer side.

The configurations illustrated in FIG. 38 and FIG. 39 may be combined.

Further, in FIG. 38 and FIG. 39, the flexural rigidity of the first region 23*a* on the outermost layer side is set lower than that on the innermost layer side, but the flexural rigidity of the first region 23*a* on the innermost layer side may be set lower than the flexural rigidity of the first region 23*a* on the outermost layer side. That is, the configurations illustrated in FIG. 38 and FIG. 39 may be inverted.

Twenty-Third Embodiment

Figure 40:
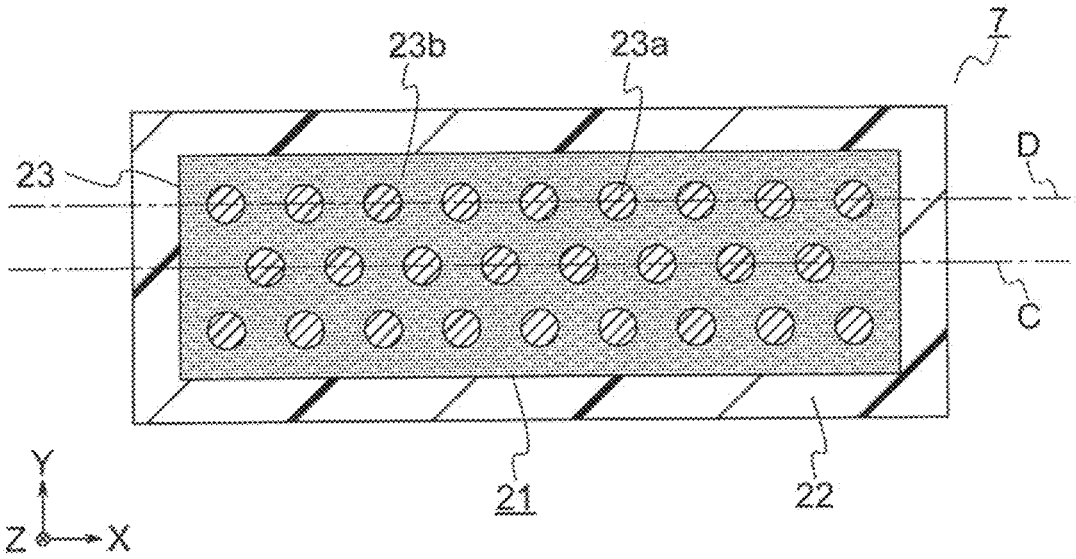
FIG. 40 is a sectional view for illustrating the suspension body for an elevator according to a twenty-third embodiment of this invention.

Next, FIG. 40 is a sectional view for illustrating the suspension body 7 for an elevator according to a twenty-third embodiment of this invention. In the twenty-third embodiment, the first regions 23*a* configured to bear the load are interspersed inside the core 21, and the second region 23*b* is formed so as to cover the first regions 23*a*.

The first regions 23*a* and the second region 23*b* are combined so that a value of E×W, which is a product of a modulus of elasticity E and a width W of the second region 23*b* in each end of the core 21 in the thickness direction, is smaller than a value of E×W, which is a product of the modulus of elasticity E and the width W in the plane D that is located on the inner side of the core 21 and includes the first regions 23*a*.

In the above-mentioned suspension body 7, the first regions 23*a* configured to bear the load are split into small circular pieces, and hence the flexibility in the length direction of the core 21 is improved.

Further, the second region 23*b* may have a configuration without the high-strength fibers. The second region 23*b* may be made of, for example, a thermoplastic resin, a thermosetting resin, or an elastomeric material, or may be formed of a lubricant prevented from adhering to the first regions 23*a*. With this configuration, the flexural rigidity of the suspension body 7 can be further reduced.

A configuration without the covering layer 22 may be adopted.

Further, the shape of each of the first regions 23*a* may be a rectangular shape or an elliptical shape other than the circular shape. Further, the high-strength fibers forming the first region 23*a* may be arranged along the length direction, or woven into a stranded wire.

Moreover, the number of the first regions 23*a* can be set suitably in accordance with the specifications of the suspension body 7.

Figure 41:
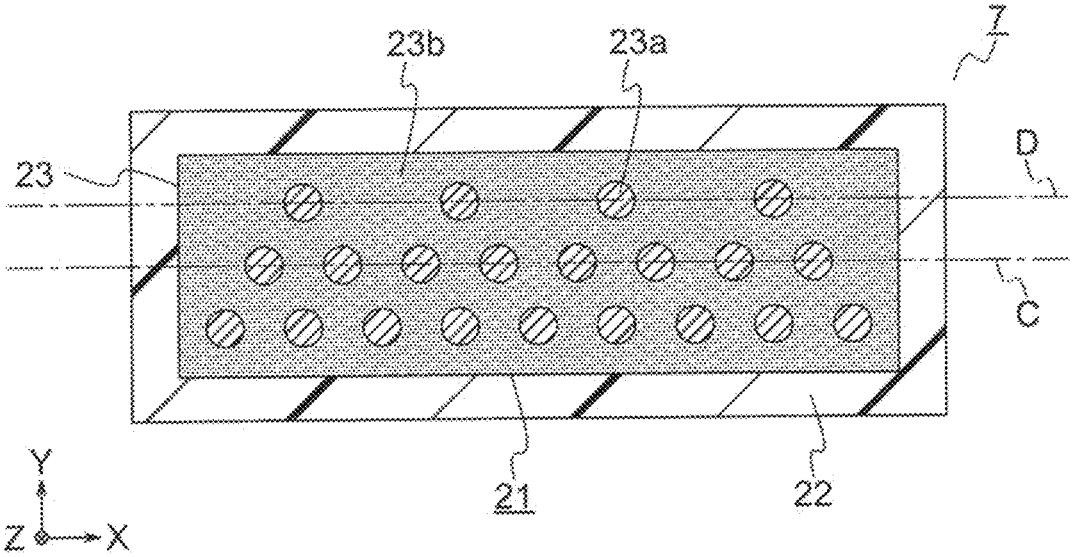
FIG. 41 is a sectional view for illustrating a first modification example of the twenty-third embodiment.

FIG. 41 is a sectional view for illustrating a first modification example of the twenty-third embodiment. In the first modification example, the number of the first regions 23*a* on the outermost layer side aligned in the width direction is smaller than the number of the first regions 23*a* on the innermost layer side aligned in the width direction.

With such a configuration, the flexural rigidity of the first regions 23*a* on the outermost layer side is lower than the flexural rigidity of the first regions 23*a* on the innermost layer side, and there is a difference in rigidity between one side and another side in the thickness direction of the core 21. Thus, when the suspension body 7 receives the compressive load in the length direction from, for example, the hoisting machine brake, the suspension body 7 can be easily bent in one direction.

Further, in FIG. 41, the flexural rigidity of the first regions 23*a* on the outermost layer side is set lower than that on the innermost layer side, but the flexural rigidity of the first regions 23*a* on the innermost layer side may be set lower than the flexural rigidity of the first regions 23*a* on the outermost layer side. That is, the configuration illustrated in FIG. 41 may be inverted.

Further, the region 23*b* may have a configuration without the high-strength fibers. The region 23*b* may be made of, for example, a thermoplastic resin, a thermosetting resin, or an elastomeric material, or may be formed of a lubricant prevented from adhering to the first regions 23*a*. With this configuration, the flexural rigidity of the suspension body 7 can be further reduced.

Figure 42:
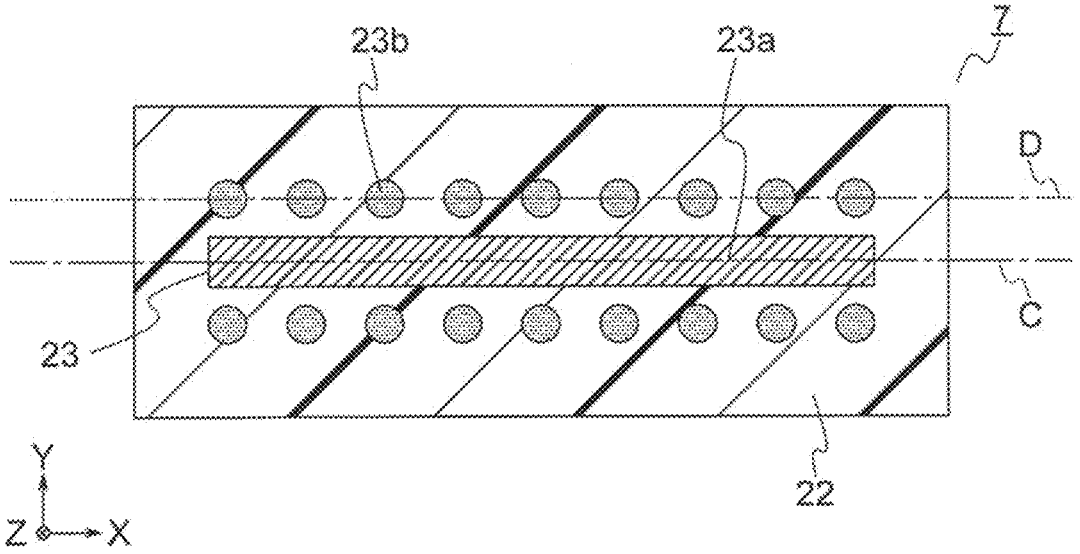
FIG. 42 is a sectional view for illustrating a second modification example of the twenty-third embodiment.

FIG. 42 is a sectional view for illustrating a second modification example of the twenty-third embodiment. In the second modification example, the first region 23*a* being the load bearing layer is present at the center portion in the thickness direction in the cross section of the suspension body 7, and the second regions 23*b* are interspersed on the front surface side of the suspension body 7.

With such a configuration, the flexural rigidity at the plane D formed of the regions 23*b* on the front surface side is lower than the flexural rigidity of the first region 23*a* at the neutral plane C, and hence the flexibility of the suspension body 7 is improved.

Twenty-Fourth Embodiment

Figure 43:
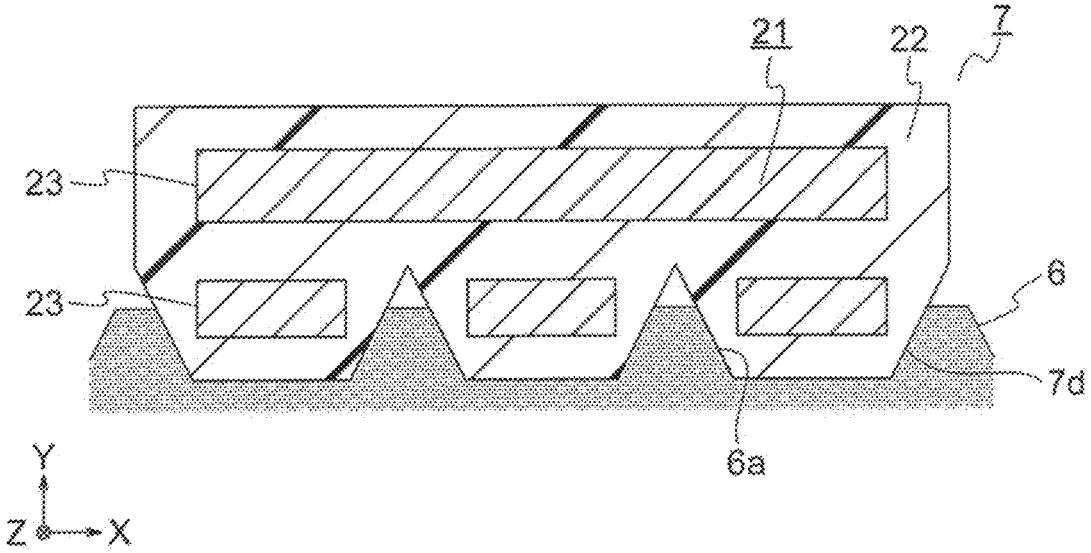
FIG. 43 is a sectional view for illustrating the suspension body for an elevator according to a twenty-fourth embodiment of this invention.

Next, FIG. 43 is a sectional view for illustrating the suspension body 7 for an elevator according to a twenty-fourth embodiment of this invention. In the twenty-fourth embodiment, on a surface of the suspension body 7 to be brought into contact with the driving sheave 6, a plurality of surface protrusions 7*d* are formed to be aligned in the width direction of the suspension body 7. A sectional shape of each of the surface protrusions 7*d* is a V-shape, specifically, a trapezoid in which a lower base to be brought into contact with the driving sheave 6 is shorter than an upper base. Grooves 6*a* configured to engage with the surface protrusions 7*d* are formed in the driving sheave 6.

The core 21 configured to bear the load includes the plurality of load bearing layers 23. The load bearing layers 23 are divided into two layers in the thickness direction of the suspension body 7. The load bearing layer 23 on the radially outer side of the driving sheave 6 is arranged continuously in the width direction of the suspension body 7. The load bearing layer 23 on the radially inner side of the driving sheave 6 is divided into a plurality of pieces in the width direction of the suspension body 7, and the plurality of pieces are arranged so as to be dispersed in the surface protrusions 7*d*, respectively.

In the above-mentioned suspension body 7, when tension acts on the suspension body 7 under a state in which the surface protrusions 7*d* and the grooves 6*a* engage with each other, a contact frictional force is increased. Thus, higher power can be transmitted as compared to a case in which the suspension body 7 has a flat surface.

Further, the surface protrusions 7*d* of the suspension body 7 and the grooves 6*a* of the driving sheave 6 engage with each other, and hence shifting of the suspension body 7 in the width direction of the driving sheave 6 can be prevented.

Moreover, the core 21 is present in the surface protrusions 7*d*, and hence the rigidity of the surface protrusions 7*d* against shifting in the width direction is improved.

Moreover, there is a difference in rigidity between one side and another side in the thickness direction of the core 21. Thus, when the suspension body 7 receives the compressive load in the length direction from, for example, the hoisting machine brake, the suspension body 7 can be easily bent in one direction.

In the example illustrated in FIG. 43, the core 21 is present in the surface protrusions 7*d*. However, even when the core 21 is not present in the surface protrusions 7*d*, the same effects can be attained.

Further, the number of the surface protrusions 7*d* is not limited to three.

Moreover, the sectional shape of each of the surface protrusions 7*d* is not limited to the V-shape.

Moreover, the number of the load bearing layers 23 is not limited to two.

Further, the core 21 illustrated in FIG. 43 includes only the load bearing layers 23. However, the embodiment illustrated in FIG. 43 may be carried out in combination with any of the above-mentioned embodiments as appropriate, and the effects of the respective embodiments can be attained.

Twenty-Fifth Embodiment

Figure 44:
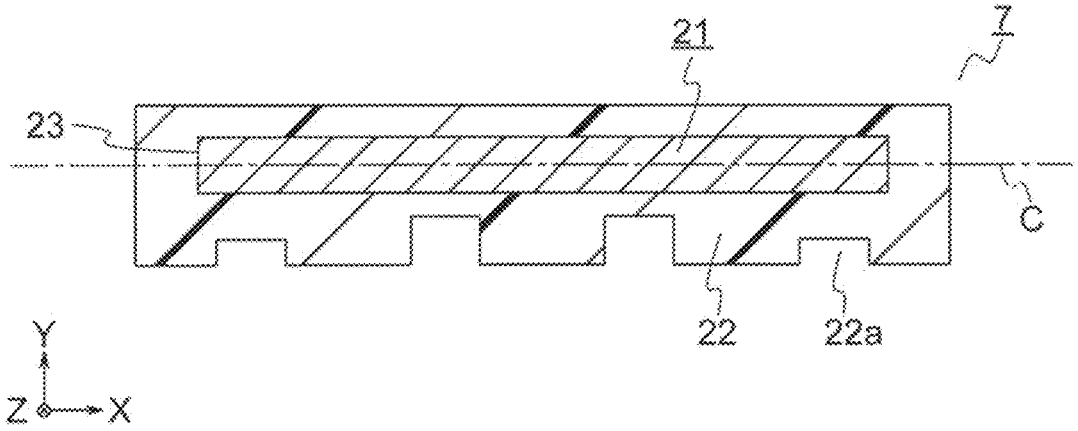
FIG. 44 is a sectional view for illustrating the suspension body for an elevator according to a twenty-fifth embodiment of this invention.

Next, FIG. 44 is a sectional view for illustrating the suspension body 7 for an elevator according to a twenty-fifth embodiment of this invention. In the twenty-fifth embodiment, the suspension body 7 includes the core 21 and the covering layer 22. The core 21 is configured to bear the load and arranged inside the suspension body 7. A plurality of grooves 22*a* having different depths are formed in an inner-peripheral-side surface of the covering layer 22 to be brought into contact with the driving sheave 6. The grooves 22*a* are formed along the length direction of the suspension body 7.

In the above-mentioned suspension body 7, through contact between a relatively flat surface of the driving sheave 6 and the inner-peripheral-side surface of the suspension body 7, wear of the inner-peripheral-side surface of the suspension body 7 can be visually checked. In particular, through combination of the grooves 22*a* having different depths, a progress status of wear is more easily checked.

In FIG. 44, the grooves 22*a* have two kinds of depths. However, the number of kinds of depths of the grooves 22*a* is not limited to two, and may be one or three or more.

Further, the direction of the grooves 22*a* is not limited to a direction parallel to the length direction of the suspension body 7. For example, the grooves 22*a* may extend at an angle of 45° or 90° with respect to the length direction.

Moreover, the sectional shape of each of the grooves 22*a* is not limited to the rectangular shape, and may be, for example, a V-shape or a semicircular shape. However, when the sectional shape of each of the grooves 22*a* is rectangular as illustrated in FIG. 44, the grooves 22*a* have the same contact area with respect to the driving sheave 6 even when wear progresses. As a result, wear progresses at a constant speed. Accordingly, progress of wear is easily estimated.

Twenty-Sixth Embodiment

Figure 45:
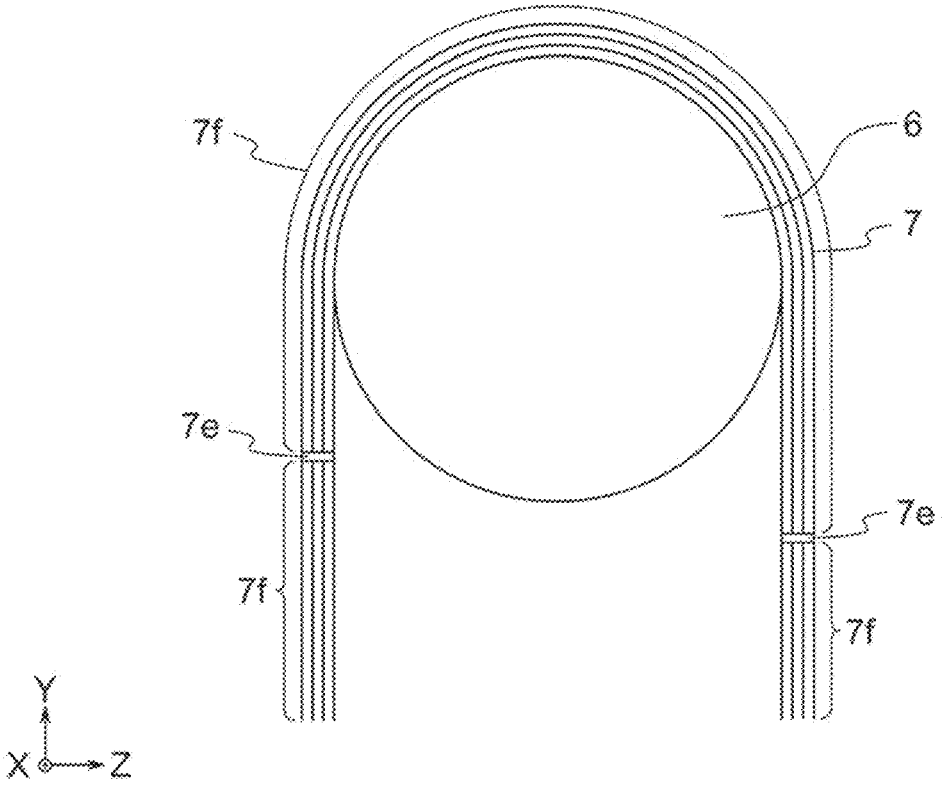
FIG. 45 is a side view for illustrating a state in which the suspension body for an elevator according to a twenty-sixth embodiment of this invention is wound around a driving sheave.

Next, FIG. 45 is a side view for illustrating a state in which the suspension body 7 according to a twenty-sixth embodiment of this invention is wound around the driving sheave 6. The suspension body 7 according to the twenty-sixth embodiment is characterized in that an internal adhesion state differs depending on a position thereof in the length direction of the suspension body 7. That is, the suspension body 7 includes a plurality of adhesion portions 7*e* and a plurality of non-adhesion portions 7*f*.

Figure 46:
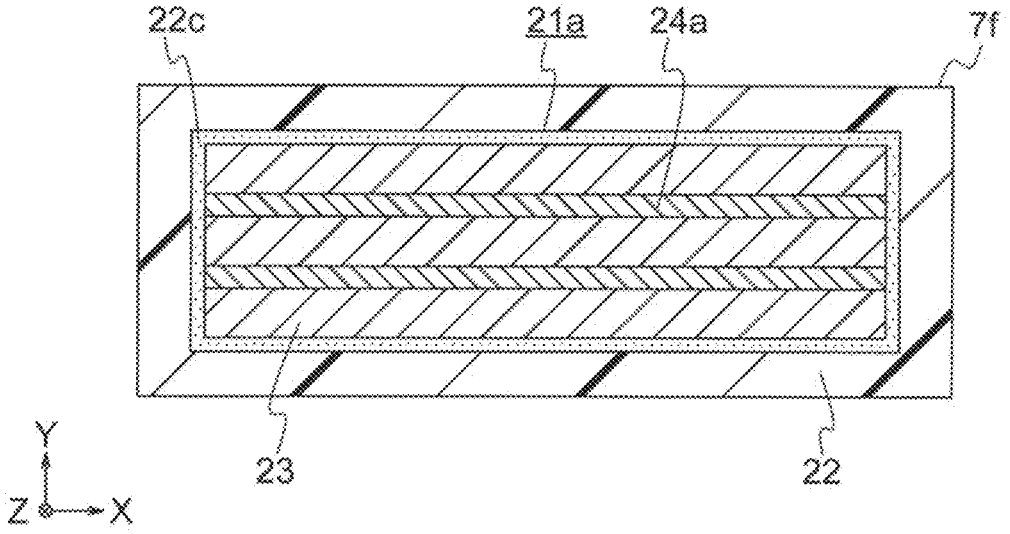
FIG. 46 is a sectional view for illustrating a non-adhesion portion in FIG. 45.
Figure 47:
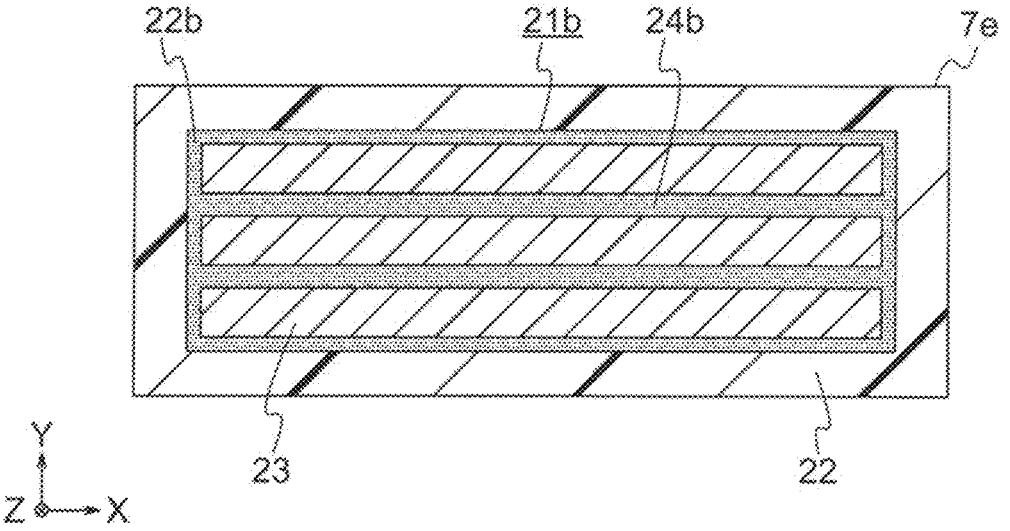
FIG. 47 is a sectional view for illustrating an adhesion portion in FIG. 45.

FIG. 46 is a sectional view for illustrating the non-adhesion portion 7*f*, and FIG. 47 is a sectional view for illustrating the adhesion portion 7*e*. In FIG. 46, the non-adhesion portion 7*f* includes, in addition to a core 21*a* including three load bearing layers 23 and two intermediate layers 24*a*, a core covering layer 22*c* interposed between the core 21*a* and the covering layer 22.

Particularly in this example, the intermediate layers 24*a* and the core covering layer 22*c* are each formed of the lubricant, and hence slipping easily occurs in a region between adjacent layers. The intermediate layers 24*a* and the core covering layer 22*c* may be each made of, for example, a thermoplastic resin, a thermosetting resin, or an elastomeric material, or may be formed of a lubricant prevented from adhering to the load bearing layer 23 or a sheet having a low frictional property. Further, a plurality of sheets can be arranged in layers, and a liquid lubricant, a semi-solid lubricant, and a solid lubricant may be used in combination. For example, a configuration in which the liquid lubricant is arranged on a surface of the sheet of the solid lubricant is conceivable.

Meanwhile, in FIG. 47, the adhesion portion 7*e* includes, in addition to a core 21*b* including three load bearing layers 23 and two intermediate layers 24*b*, a core covering layer 22*b* interposed between the core 21*b* and the covering layer 22.

The intermediate layers 24*b* and the core covering layer 22*b* are each made of a solid material that bonds interlayer regions. The solid material may be the same material as that for the load bearing layer 23 or the covering layer 22, or may be a different material.

In this configuration, owing to the adhesion portions 7*e*, the entire suspension body 7 can have the hard and integrated structure, and at the same time, shifting between the load bearing layers 23 can be allowed at portions bent along the driving sheave 6. Thus, readiness of bending can be achieved.

Figure 48:
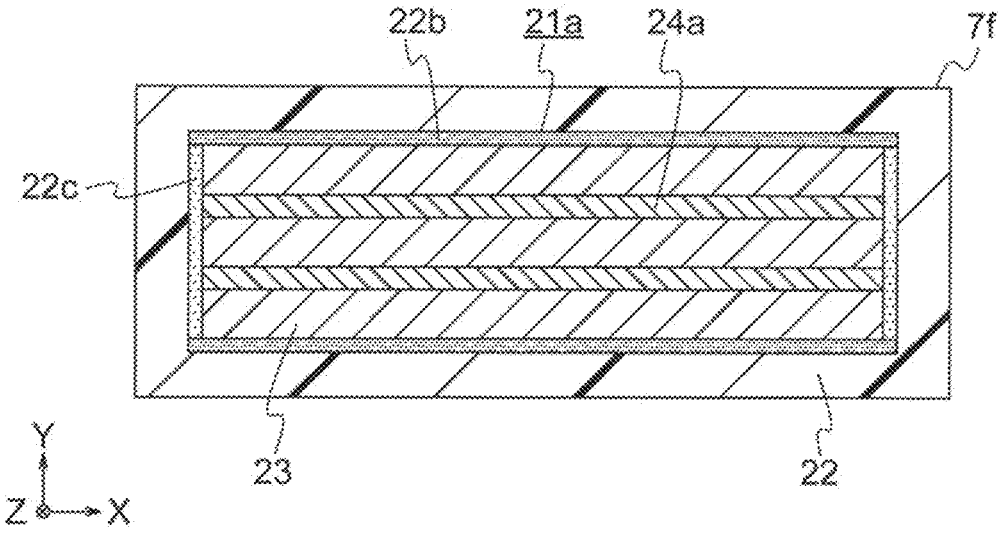
FIG. 48 is a sectional view for illustrating the non-adhesion portion in a modification example of the twenty-sixth embodiment.

FIG. 48 is a sectional view for illustrating the non-adhesion portion 7*f* in a modification example of the twenty-sixth embodiment. In this example, the core covering layers 22*b* are provided on both surfaces of the core 21*a* in the thickness direction, respectively, and the core covering layers 22*c* are provided on both surfaces of the core 21*a* in the width direction, respectively. That is, upper and lower surfaces of the core 21*a* are bonded, and both side surfaces of the core 21*a* are not bonded.

In this structure, no slipping occurs between the covering layer 22 and the load bearing layer 23. Thus, while further maintaining an external shape, shifting between the load bearing layers 23 is allowed at portions bent along the driving sheave 6, thereby being capable of achieving readiness of bending.

The neutral plane C, which is a plane prevented from expanding and contracting when the suspension body 7 is bent, is located at the center of the core 21 in the thickness direction as illustrated in FIG. 12 to FIG. 18, FIG. 27 to FIG. 31, FIG. 37 to FIG. 42, and FIG. 46 to FIG. 48. With this configuration, a behavior of the suspension body 7 when tension acts on the suspension body 7 can be stabilized.

Moreover, as described in some of the above-mentioned embodiments, when the difference in rigidity is set between one end and another end of the core 21 in the thickness direction, it is suitable to wind the suspension body 7 around the driving sheave 6 in a direction in which the suspension body 7 is easily bent when the suspension body 7 is bent along the outer peripheral surface of the driving sheave 6. In this manner, workability when the suspension body 7 is wound around the driving sheave 6 can be improved.

Further, the configuration of the elevator, to which the suspension body 7 according to the embodiments described above is applied, is not limited to the configuration illustrated in FIG. 1. For example, the suspension body 7 is applicable also to a machine room-less elevator, an elevator using a 2:1 roping method, a double-deck elevator, and a multi-car elevator. The multi-car elevator is an elevator using a system in which an upper car and a lower car arranged directly below the upper car are vertically moved in the common hoistway independently.

Twenty-Seventh Embodiment

Next, description is made of a twenty-seventh embodiment of this invention. An entire configuration of an elevator according to the twenty-seventh embodiment is the same as that illustrated in FIG. 1. In the twenty-seventh embodiment, as the suspension body 7 illustrated in FIG. 1, there is used a belt-like suspension body including a core having a belt-like shape, and a covering layer that is made of a resin and covers the core. The core includes a load bearing layer formed of an impregnation resin and a plurality of high-strength fibers. The sectional structure of the suspension body 7 may be any structure in the first embodiment to the twenty-sixth embodiment or another structure.

Figure 49:
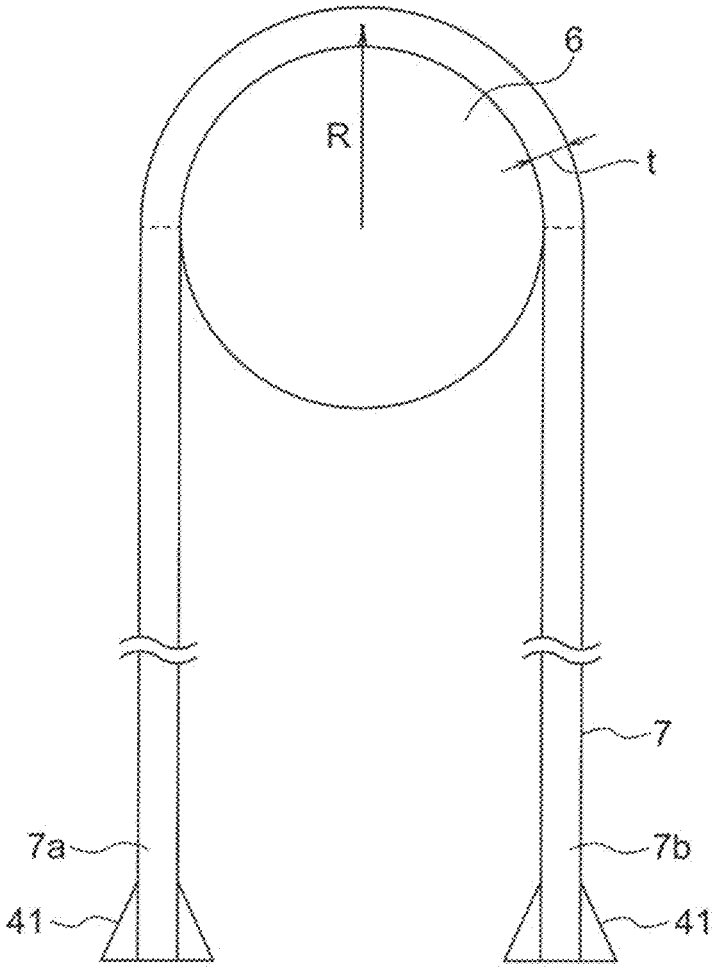
FIG. 49 is a configuration view for illustrating a main part of an elevator according to a twenty-seventh embodiment of this invention.

Further, in the twenty-seventh embodiment, as illustrated in FIG. 49, a pair of end holding devices 41 is provided at both end portions of the suspension body 7. The end holding devices 41 are configured to retain and hold the both end portions of the suspension body 7 so as to prevent the load bearing layer from shifting in the length direction of the suspension body 7 inside the suspension body 7.

Figure 50:
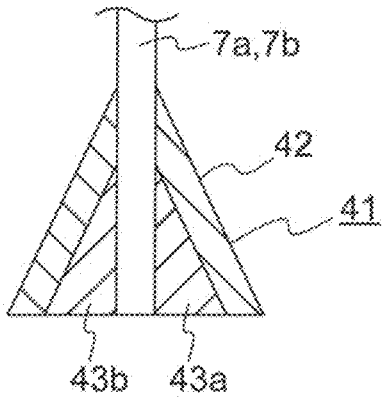
FIG. 50 is a sectional view for illustrating an end holding device in FIG. 49.

FIG. 50 is a sectional view for illustrating the end holding device 41 in FIG. 49. The end holding device 41 includes a socket 42 and a pair of wedges 43*a* and 43*b*. The end portion of the suspension body 7 is inserted through the socket 42. The wedges 43*a* and 43*b* are driven between the socket 42 and the end portion of the suspension body 7. Under this state, the suspension body 7 is connected to the car 8 and the counterweight 9.

Moreover, in the twenty-seventh embodiment, a radius of the driving sheave 6 is set so as to satisfy the following conditions.

Condition 1: Under a state in which loads of the car 8 and the counterweight 9 are applied to the suspension body 7, and the suspension body 7 is bent along the driving sheave 6, maximum tensile stress generated on the load bearing layer in the length direction of the suspension body 7 is lower than tensile strength of the suspension body 7 in the length direction.

Condition 2: Under a state in which the loads of the car 8 and the counterweight 9 are applied to the suspension body 7, and the suspension body 7 is bent along the driving sheave 6, maximum compressive stress generated on the load bearing layer in the length direction of the suspension body 7 is lower than compressive strength of the suspension body 7 in the length direction.

Here, t represents a thickness of the suspension body 7 in a state of being wound around the driving sheave 6, and R represents a distance from the center of the driving sheave 6 to the center of the suspension body 7 in the thickness direction.

Figure 51:
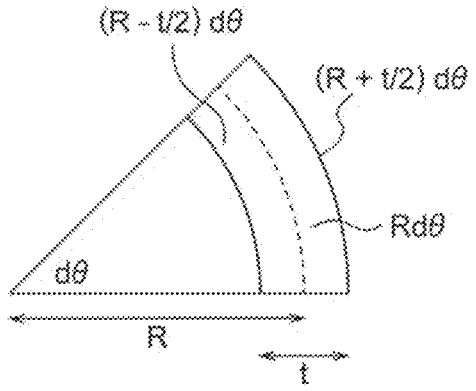
FIG. 51 is an explanatory view for illustrating a change in shape at a portion of the suspension body in FIG. 49 wound around the driving sheave.

FIG. 51 is an explanatory view for illustrating a change in shape at a portion of the suspension body 7 in FIG. 49 wound around the driving sheave 6. Under a state in which the sectional structure of the suspension body 7 is symmetrical with respect to the center in the thickness direction, and no tensile load acts, a position apart from the center of the driving sheave 6 by the distance R corresponds to a position at a so-called neutral plane (or neutral axis) at which no tensile force and no compressive force act in the length direction of the suspension body 7.

In contrast, when the tensile load is applied, in terms of a unit winding angle $d\theta$, the portion of the suspension body 7 held in contact with the driving sheave 6 is compressed and thus represented by $(R-t/2)\,d\theta$. Meanwhile, the portion of the suspension body 7 that is not held in contact with the driving sheave 6 is represented by $(R+t/2)d\theta$.

Therefore, a difference between a length of an inner peripheral surface held in contact with the driving sheave 6 and a length of an outer peripheral surface that is not held in contact with the driving sheave 6 is determined by the thickness t×the unit winding angle $d\theta$. Further, shear strain is determined by the unit winding angle $d\theta$.

Figure 52:
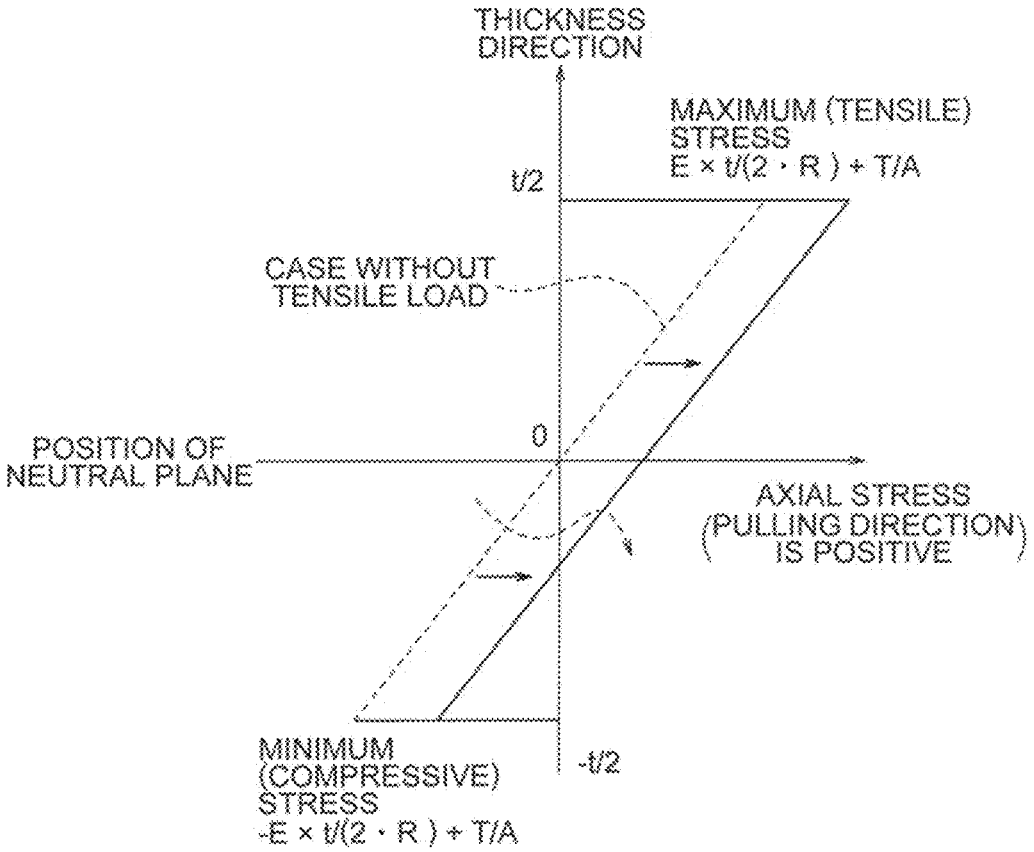
FIG. 52 is an explanatory view for illustrating a condition of stress applied in the length direction on the portion of the suspension body in FIG. 49 wound around the driving sheave.

FIG. 52 is an explanatory view for illustrating a condition of stress applied in the length direction on the portion of the suspension body 7 in FIG. 49 wound around the driving sheave 6. E represents a Young's modulus of a strength member of the suspension body 7, A represents a sectional area of the load bearing layer perpendicular to the length direction of the suspension body 7, and T represents tensile load acting on the suspension body 7.

The stress generated by the change in shape illustrated in FIG. 51 is determined by a product of the strain $t/(2\cdot R)$ and the Young's modulus E, and it is required to consider further application of the stress T/A due to the tensile load. Assuming that the stress in a pulling direction is positive, the portion of the suspension body 7 held in contact with the driving sheave 6 is represented by $-E\times t/(2\cdot R)+T/A$. Further, the portion of the suspension body 7 that is not held in contact with the driving sheave 6 is represented by $E\times t/(2\cdot R)+T/A$.

In the twenty-seventh embodiment, the both end portions of the suspension body 7 are held by the end holding devices 41, and hence shifting of the load bearing layer in the suspension body 7 is not allowed for the stress generated on the suspension body 7. Thus, it is desired that the radius of the driving sheave 6 be determined in strict consideration of the sectional area A and the thickness t of the suspension body 7 and a maximum tension load.

That is, in order to prevent breakage of the load bearing layer, it is desired that the radius of the driving sheave 6 be determined so that compressive strength of the load bearing layer satisfies $Spress<-E\times t/(2\cdot R)+T/A$ (Condition 1), and that tensile strength of the load bearing layer satisfies $Spull>E\times t/(2\cdot R)+T/A$ (Condition 2).

As described in the first embodiment to the fourth embodiment, when the load bearing layer 23 is divided into the plurality of segment layers 25, a thickness dimension of the segment layer 25 having the largest thickness dimension may be set to t.

With this configuration, while preventing generation of excessive stress on the load bearing layer 23 when the suspension body 7 is bent and thus preventing breakage of the load bearing layer, a bend radius of the suspension body 7 can be reduced, and the radius of the driving sheave 6 can be reduced.

It is preferred that the tensile load T be estimated higher with the assumption not only about a static condition but also about a case in which the load is increased extremely when a user gets on the car 8 or sudden braking occurs.

Specifically, the tensile load T is determined through estimation of the load applied to the suspension body 7 under a condition that the maximum loading passenger weight is added to the weight of the car 8 and sudden deceleration is performed at 1G, which is the maximum acceleration of a traction drive-type elevator. Further, it is preferred that the radius of the driving sheave 6 be determined within a range in which the maximum tensile stress at this application does not exceed the tensile strength.

Further, in this case, it is preferred that the tensile strength and the compressive strength be set equal to or lower than the half of ideal strength in consideration of reduction in strength of the load bearing layer over time.

Moreover, in general, as the radius of the driving sheave 6 becomes smaller, required driving torque of the hoisting machine motor may become lower. This is thus economical. In particular, when the radius of the driving sheave 6 is equal to or smaller than 200 mm, a general-purpose motor can be used. Accordingly, it is preferred that the thickness t of the suspension body 7 be determined in consideration of the tensile load T so that the radius of the driving sheave 6 can be set equal to or smaller than 200 mm.

Figure 53:
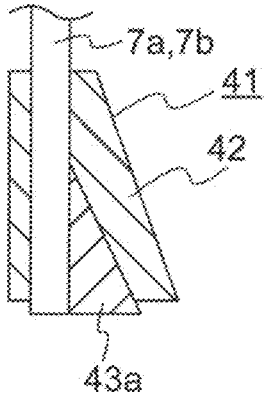
FIG. 53 is a sectional view for illustrating a modification example of the end holding device in FIG. 49.

FIG. 53 is a sectional view for illustrating a modification example of the end holding device 41 in FIG. 49. In FIG. 50, a double wedge-type device using the two wedges 43*a* and 43*b* is illustrated. However, the end holding device 41 in FIG. 53 is a single wedge-type device using only one wedge 43*a*. The wedge 43*a* is driven between the socket 42 and a surface of one of both ends of the suspension body 7 in the thickness direction, which is located on the radially outer side of the driving sheave 6.

Twenty-Eighth Embodiment

Figure 54:
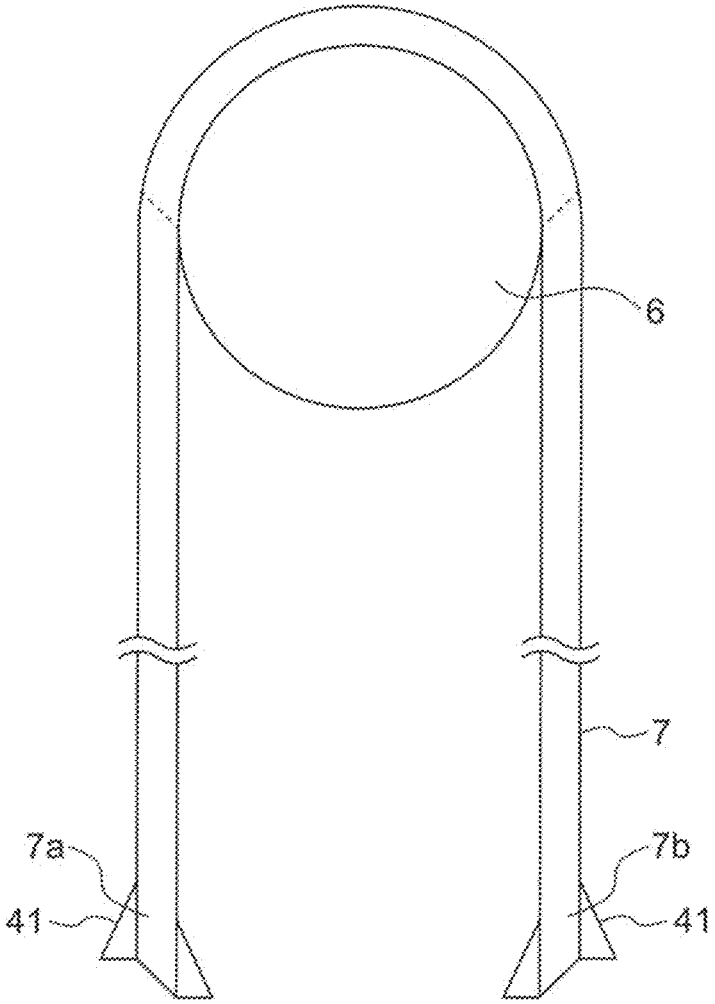
FIG. 54 is a configuration view for illustrating a main part of an elevator according to a twenty-eighth embodiment of this invention.
Figure 55:
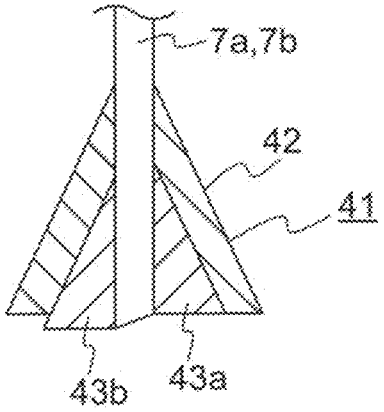
FIG. 55 is a sectional view for illustrating the end holding device in FIG. 54.

Next, FIG. 54 is a configuration view for illustrating a main part of an elevator according to a twenty-eighth embodiment of this invention. FIG. 55 is a sectional view for illustrating the end holding device 41 in FIG. 54. The end holding device 41 in the twenty-eighth embodiment is configured to retain and hold each end portion of the suspension body 7 under a state in which one end and another end of the suspension body 7 in the thickness direction are shifted from each other in the length direction of the suspension body 7.

Specifically, at each end portion of the suspension body 7, the end holding device 41 is configured to retain each end portion of the suspension body 7 so that one end of the suspension body 7 in the thickness direction, namely, an end portion to be brought into contact with the driving sheave 6 protrudes more than another end of the suspension body 7 in the thickness direction. In other words, the end holding device 41 is configured to retain each end portion of the suspension body 7 so that an outer surface of the suspension body 7 in a radial direction of the driving sheave 6 comes close to the driving sheave 6. The other configurations are the same as those of the twenty-seventh embodiment.

In such an elevator, stress generated by the tensile load on the suspension body 7 at the outer periphery of the driving sheave 6 can be reduced. Thus, the bend radius of the suspension body 7 can be reduced, and the radius of the driving sheave 6 can be reduced within a range in which the tensile stress and the compressive stress generated on the suspension body 7 do not exceed the critical strength.

Figure 56:
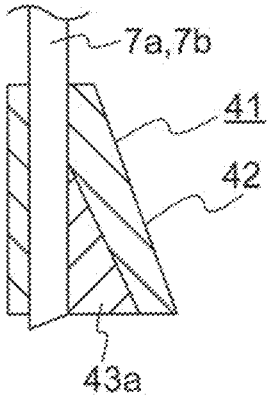
FIG. 56 is a sectional view for illustrating a modification example of the end holding device in FIG. 54.

FIG. 56 is a sectional view for illustrating a modification example of the end holding device 41 in FIG. 54. In FIG. 55, a double wedge-type device using the two wedges 43*a* and 43*b* is illustrated. However, the end holding device 41 in FIG. 56 is a single wedge-type device using only one wedge 43*a*. The wedge 43*a* is driven between the socket 42 and a surface of one of both ends of the suspension body 7 in the thickness direction, which is located on the radially outer side of the driving sheave 6.

In the twenty-eighth embodiment, at both end portions of the suspension body 7, one end and another end of the suspension body 7 in the thickness direction are shifted from each other in the length direction of the suspension body 7, but one end and another end of the suspension body 7 in the thickness direction may be shifted from each other at only any one of the both end portions.

Twenty-Ninth Embodiment

Figure 57:
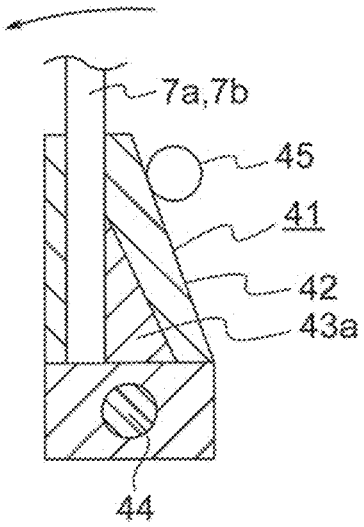
FIG. 57 is a sectional view for illustrating the end holding device of an elevator according to a twenty-ninth embodiment of this invention.

Next, description is made of a twenty-ninth embodiment of this invention. An entire configuration of an elevator according to the twenty-ninth embodiment is the same as that illustrated in FIG. 1. FIG. 57 is a sectional view for illustrating the end holding device 41 in the twenty-ninth embodiment. The end holding device 41 in the twenty-ninth embodiment has the same configuration as that illustrated in FIG. 53, but is coupled to the car 8 or the counterweight 9 so as to be rotatable about a shaft 44 parallel to the width direction of the suspension body 7. That is, the end holding device 41 can be inclined in the thickness direction of the suspension body 7.

Figure 58:
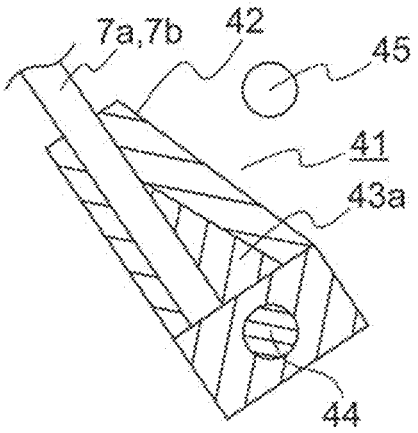
FIG. 58 is a sectional view for illustrating a state in which the end holding device in FIG. 57 has rotated.

When stress is generated by the tensile load on the portion of the suspension body 7 wound around the driving sheave 6, a bending moment M acts on each end portion of the suspension body 7. At this time, as illustrated in FIG. 58, the end holding device 41 rotates in a direction of releasing the stress. The car 8 and the counterweight 9 each include a stopper 45 configured to inhibit the end holding device 41 from rotating in a direction opposite to the direction of releasing the stress. The other configurations are the same as those of the twenty-seventh embodiment.

Even with this configuration, stress generated by the tensile load on the suspension body 7 at the outer periphery of the driving sheave 6 can be reduced. Thus, the bend radius of the suspension body 7 can be reduced, and the radius of the driving sheave 6 can be reduced within a range in which the tensile stress and the compressive stress generated on the suspension body 7 do not exceed the critical strength.

Further, when the large bending moment M is applied, the end holding device 41 can be inclined. Accordingly, only an amount of shifting transmitted to the end portion of the suspension body 7 can be efficiently eliminated.

The configuration in the twenty-ninth embodiment may be applied to only any one of the car 8 side and the counterweight 9 side.

Thirtieth Embodiment

Figure 59:
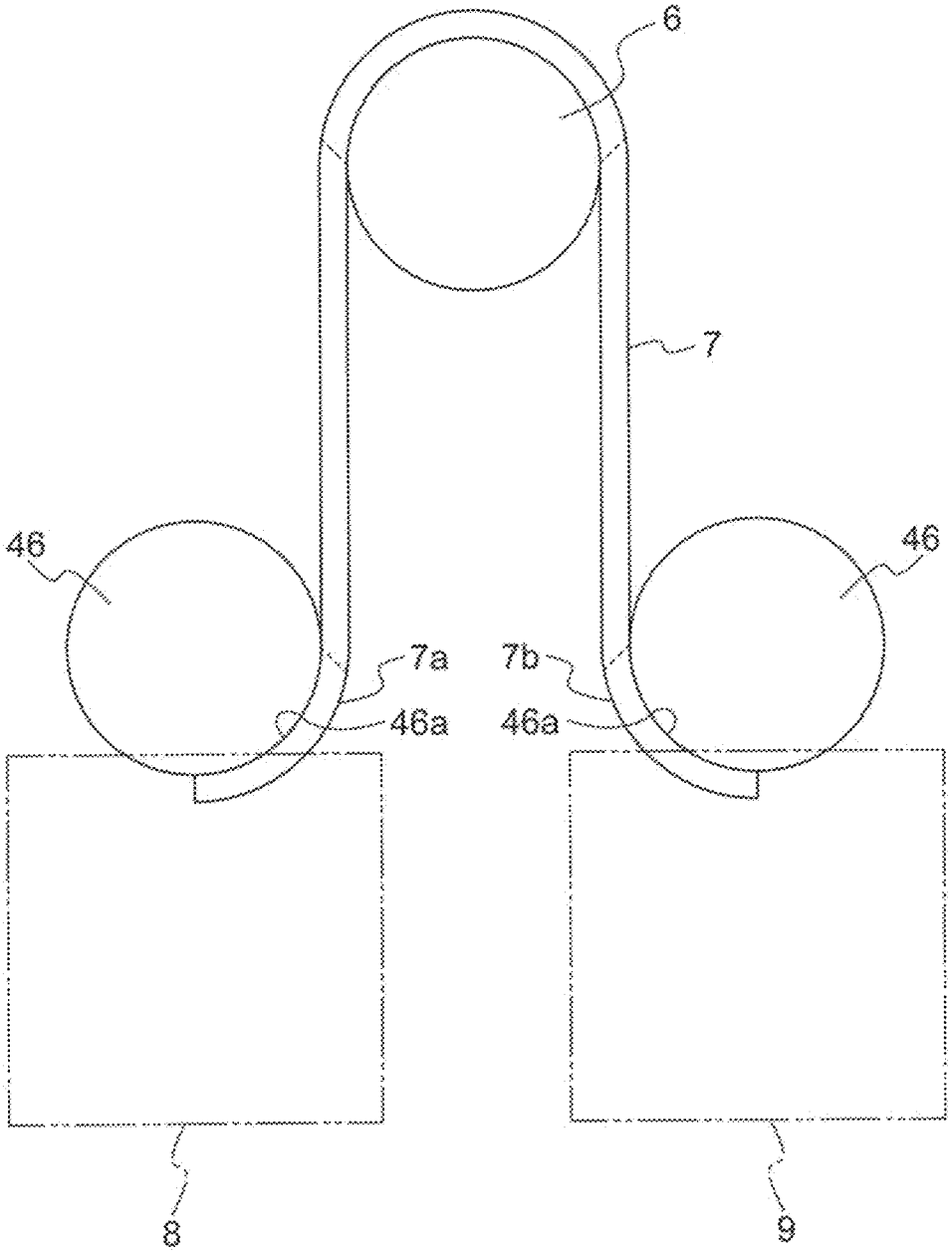
FIG. 59 is a configuration view for illustrating a main part of an elevator according to a thirtieth embodiment of this invention.

Next, FIG. 59 is a configuration view for illustrating a main part of an elevator according to a thirtieth embodiment of this invention. A cylindrical guide body 46 is fixed to each of the car 8 and the counterweight 9. The first end portion 7*a* and the second end portion 7*b* of the suspension body 7 are each bent along an arc 46*a* of the outer peripheral surface of the guide body 46. Further, a distal end of the first end portion 7*a* and a distal end of the second end portion 7*b* are each fastened to the guide body 46 by, for example, a gripper (not shown).

In this example, a curvature radius of the arc 46*a* is equal to a curvature radius of a surface of the driving sheave 6 with which the suspension body 7 is held in contact. Further, a direction of bending the suspension body 7 along the arc 46*a* in the thickness direction is opposite to a direction of bending the suspension body 7 along the driving sheave 6.

Moreover, a winding angle range of the suspension body 7 on each guide body 46 is a half of a winding angle range of the suspension body 7 on the driving sheave 6. That is, a total of the winding angle ranges of the suspension body 7 on both of the guide bodies 46 is equal to the winding angle range of the suspension body 7 on the driving sheave 6. The other configurations are the same as those of the twenty-seventh embodiment.

Even with this configuration, stress generated by the tensile load on the suspension body 7 at the outer periphery of the driving sheave 6 can be reduced.

The shifting transmitted to the end portion of the suspension body 7 corresponds to the winding angle range of the suspension body 7 on the driving sheave 6 at the maximum. Thus, the total of the winding angle ranges of the suspension body 7 on the arcs 46*a* may be somewhat smaller than the winding angle range of the suspension body 7 on the driving sheave 6.

Thirty-First Embodiment

Figure 60:
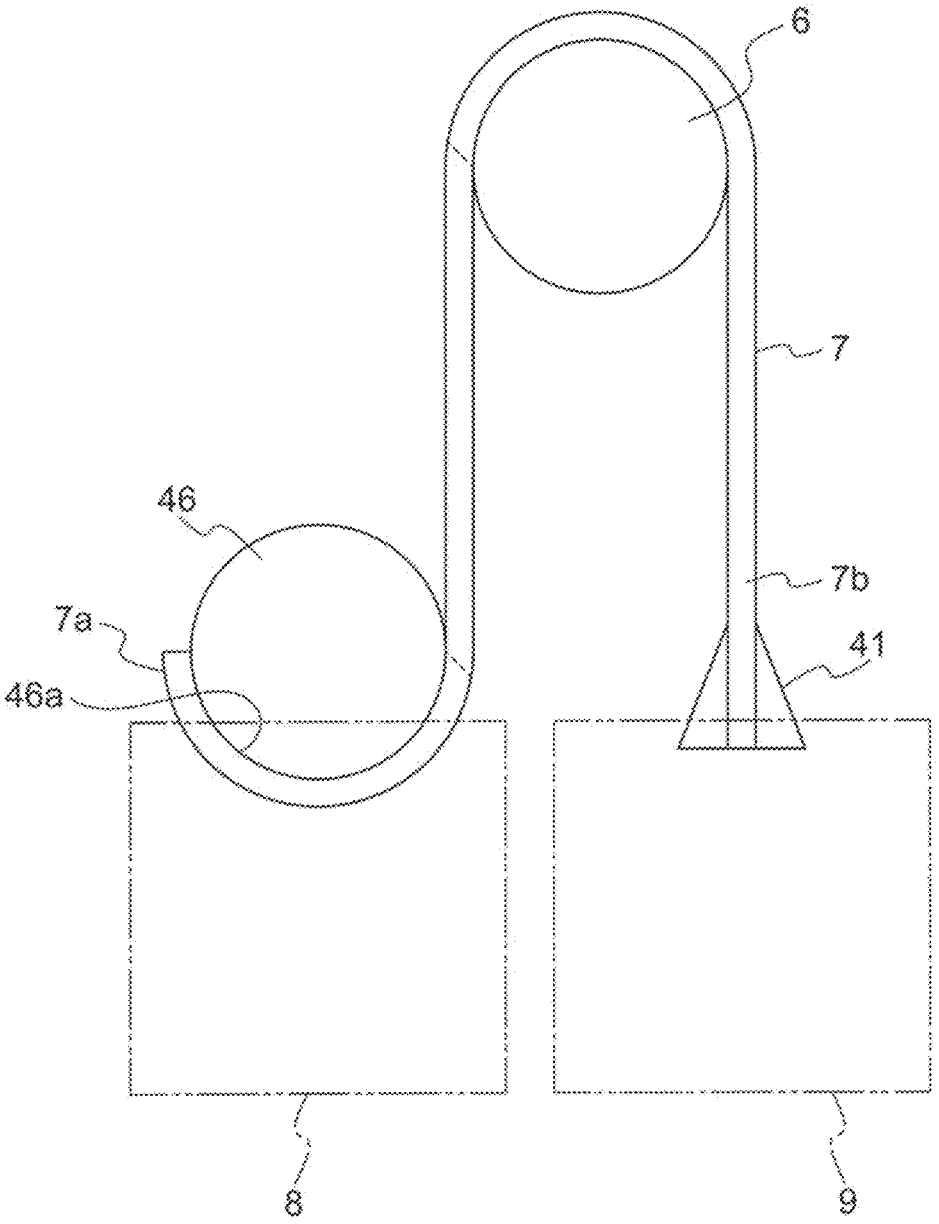
FIG. 60 is a configuration view for illustrating a main part of an elevator according to a thirty-first embodiment of this invention.

Next, FIG. 60 is a configuration view for illustrating a main part of an elevator according to a thirty-first embodiment of this invention. In the thirty-first embodiment, the guide body 46 is provided only on the car 8. The winding angle range of the first end portion 7*a* on the guide body 46 is equal to the winding angle range of the suspension body 7 on the driving sheave 6.

Similarly to the twenty-seventh embodiment, the second end portion 7*b* is retained and held by the end holding device 41. That is, in the thirty-first embodiment, all the amount of shifting caused when the suspension body 7 is bent along the driving sheave concentrated on the first end portion 7*a*. The other configurations are the same as those of the twenty-seventh embodiment.

Even with this configuration, stress generated by the tensile load on the suspension body 7 at the outer periphery of the driving sheave 6 can be reduced.

Thirty-Second Embodiment

Figure 61:
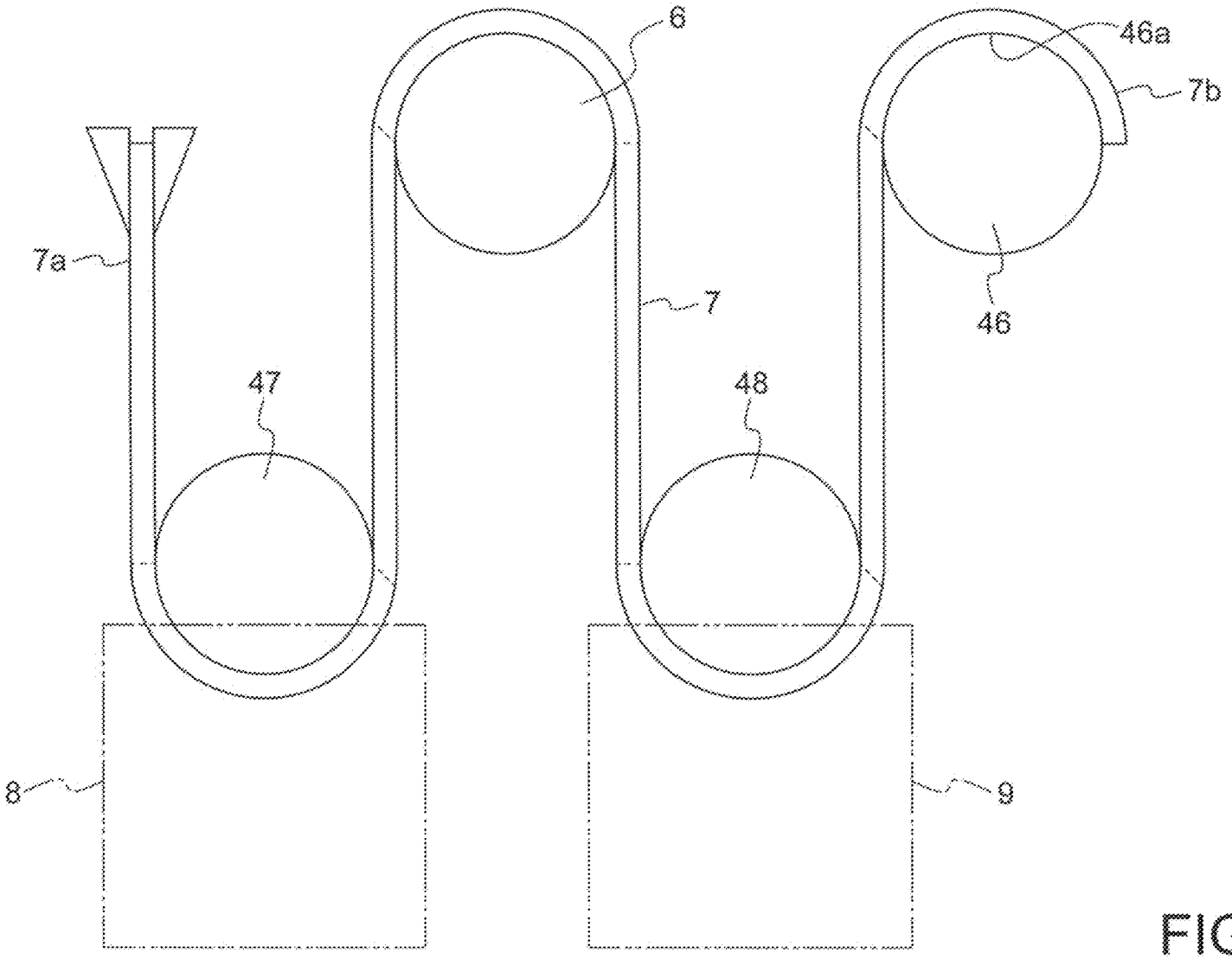
FIG. 61 is a configuration view for illustrating a main part of an elevator according to a thirty-second embodiment of this invention.

Next, FIG. 61 is a configuration view for illustrating a main part of an elevator according to a thirty-second embodiment of this invention. In the thirty-second embodiment, a case of an elevator using the 2:1 roping method is described. A car suspension sheave 47 is provided on the car 8. A counterweight suspension sheave 48 is provided on the counterweight 9.

The suspension body 7 is wound around the car suspension sheave 47, the driving sheave 6, and the counterweight suspension sheave 48 in the stated order from the first end portion 7*a* side.

Similarly to the twenty-seventh embodiment, the first end portion 7*a* is retained and held by the end holding device 41 in the upper part of the hoistway 1. In the upper part of the hoistway 1, the guide body 46 is provided. The second end portion 7*b* is bent along the arc 46*a* of the outer peripheral surface of the guide body 46. The distal end of the second end portion 7*b* is fastened to the guide body 46.

The direction of bending the suspension body 7 along the arc 46*a* in the thickness direction is opposite to a direction of bending the suspension body 7 along the counterweight suspension sheave 48. The other configurations are the same as those of the thirty-first embodiment.

Even with this configuration, stress generated by the tensile load on the suspension body 7 at the outer periphery of the driving sheave 6 can be reduced.

In the 2:1 roping method, the amount of shifting is eliminated by bending the suspension body 7 reversely, and hence it is desired that the amount of shifting at the end potion of the suspension body 7 be determined in consideration of the offset. In the example illustrated in FIG. 61, with respect to a range of 180° in which the suspension body 7 is bent along the driving sheave 6, the suspension body 7 is bent reversely along the car suspension sheave 47 and the counterweight suspension sheave 48 in a total range of 360°. Thus, in total, the suspension body 7 is bent along the guide body 46 only in a range of 180° in a direction reverse to the direction of bending along the driving sheave 6.

In the thirtieth embodiment to the thirty-second embodiment, it is only required that the guide body 46 have the arc 46*a* at the portion around which the suspension body 7 is wound. It is not always required that the guide body 46 be cylindrical.

Thirty-Third Embodiment

Figure 62:
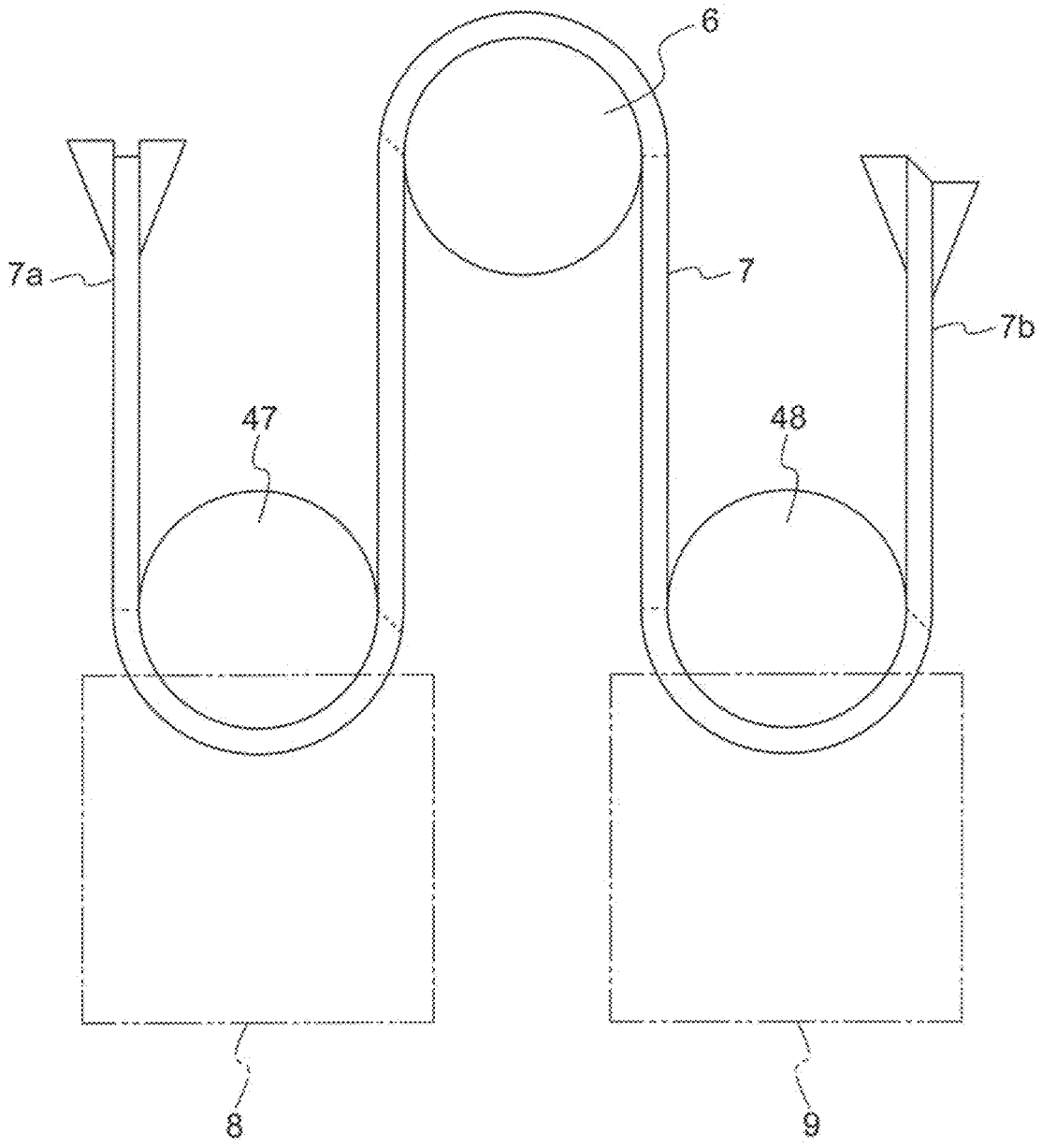
FIG. 62 is a configuration view for illustrating a main part of an elevator according to a thirty-third embodiment of this invention.

Next, FIG. 62 is a configuration view for illustrating a main part of an elevator according to a thirty-third embodiment of this invention. In the thirty-third embodiment, instead of the guide body 46 in the thirty-second embodiment, the end holding device 41 in the twenty-eighth embodiment is provided on the second end portion 7*b*. The other configurations are the same as those of the thirty-second embodiment.

Even with this configuration, stress generated by the tensile load on the suspension body 7 at the outer periphery of the driving sheave 6 can be reduced.

In the thirty-second embodiment and the thirty-third embodiment, the first end portion 7*a* and the second end portion 7*b* may be interchanged.

Further, in the twenty-eighth embodiment to the thirty-third embodiment, the sectional structure of the suspension body 7 may be any structure in the first embodiment to the twenty-sixth embodiment or another structure.

Thirty-Fourth Embodiment

Figure 63:
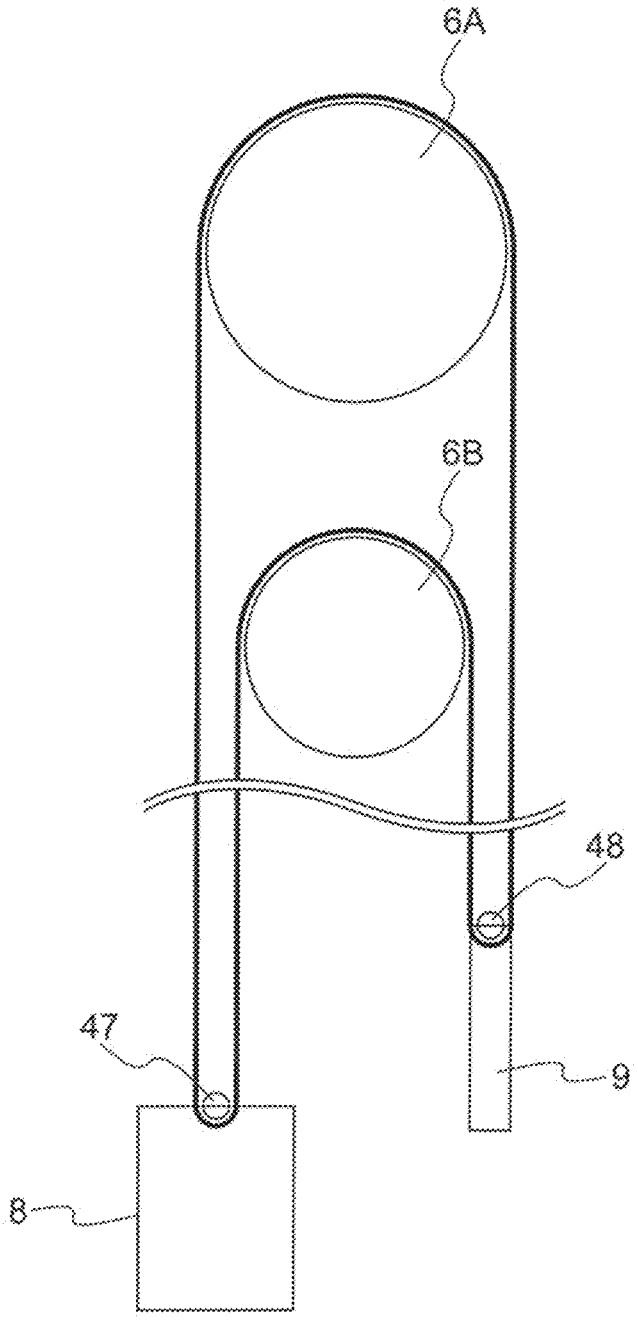
FIG. 63 is a configuration view for illustrating a main part of an elevator according to a thirty-fourth embodiment of this invention.

FIG. 63 is a configuration view for illustrating a main part of an elevator according to a thirty-fourth embodiment of this invention. In the thirty-fourth embodiment, the suspension body 7 has an endless ring shape, namely, a loop shape. Further, two driving sheaves 6A and 6B are used. The car suspension sheave 47 is provided on the car 8. The counterweight suspension sheave 48 is provided on the counterweight 9.

The suspension body 7 is wound around the car suspension sheave 47, the driving sheaves 6A and 6B, and the counterweight suspension sheave 48.

With this configuration, stress concentration on the end portions of the suspension body 7 due to end holding can be eliminated. The suspension body 7 produced into a ring shape in advance is used, and hence is wound with a bending angle of 360°. A direction of bending the suspension body 7 along the driving sheave 6A, the car suspension sheave 47, or the counterweight suspension sheave 48 is reverse to a direction of bending the suspension body 7 along the driving sheave 6B. The bending angle in the former direction corresponds to 180°×3=540°, and the bending angle in the latter direction corresponds to 180°. When the bending angle of 360° in an initial state is considered, the amount of shifting caused by bending is eliminated by the offset.

Now, description is made of a manufacturing method for the suspension body 7 including the intermediate layer 24 as described in the first embodiment to the fourth embodiment and the sixth embodiment to the fifteenth embodiment.

Thirty-Fifth Embodiment

Figure 64:
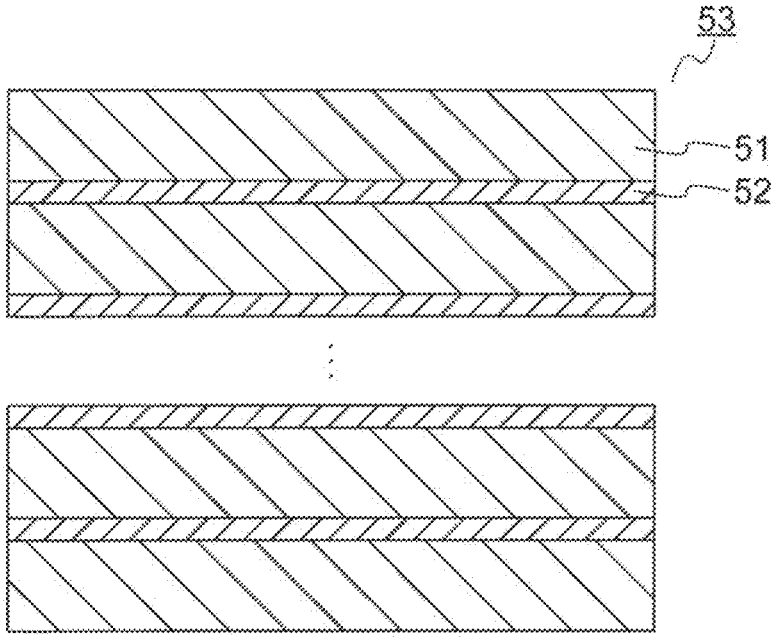
FIG. 64 is a sectional view for illustrating a state during manufacture of the suspension body for an elevator according to a thirty-fifth embodiment of this invention.

FIG. 64 is a sectional view for illustrating a state during manufacture of the suspension body 7 for an elevator according to a thirty-fifth embodiment of this invention, and illustrating a cross section corresponding to the cross section of the suspension body 7 perpendicular to the length direction thereof. In the manufacturing method according to the thirty-fifth embodiment, a plurality of high-strength fiber layers 51 and at least one low-elasticity fiber layer 52 are alternately laminated in the thickness direction of the suspension body to form a laminated body 53.

Figure 65:
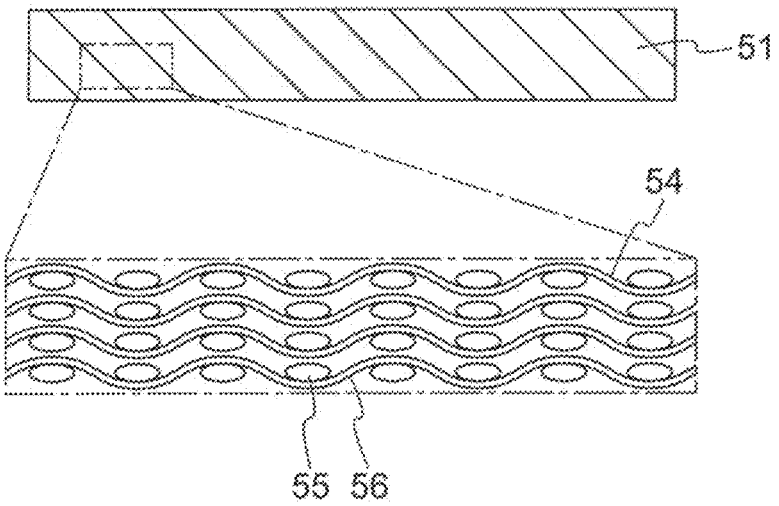
FIG. 65 is a partial enlarged sectional view for illustrating a high-strength fiber layer in FIG. 64.

FIG. 65 is a partial enlarged sectional view for illustrating the high-strength fiber layer 51 in FIG. 64. Each high-strength fiber layer 51 is formed by laminating a plurality of high-strength fiber fabrics 54 formed of the high-strength fibers as described in the first embodiment. The high-strength fiber layer 51 may be formed of only a single high-strength fiber fabric 54.

Each high-strength fiber fabric 54 is a unidirectional fiber fabric obtained by providing wefts 56 passing over and under high-strength fiber threads 55 shaped into a plurality of bundles. The wefts 56 may be made of any kinds of fibers. Further, in FIG. 65, an aligned state of the high-strength fiber threads 55 is illustrated, but the high-strength fiber threads 55 may be staggered.

The low-elasticity fiber layer 52 is formed by laminating a plurality of low-elasticity fiber fabrics having a modulus of elasticity lower than that of the high-strength fiber fabric 54. The low-elasticity fiber layer 52 may be formed of only a single low-elasticity fiber fabric.

As fibers to be used for the low-elasticity fiber fabric, namely, the intermediate-layer fibers in the thirty-fifth embodiment, glass fibers or polyester fibers are exemplified. Further, a form of the low-elasticity fiber fabric is, for example, a fabric, a nonwoven fabric, or a knitted fabric.

Figure 66:
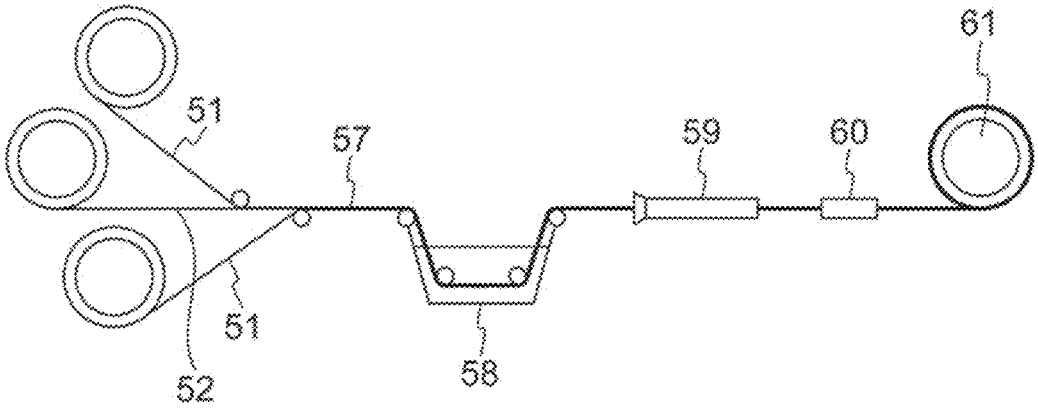
FIG. 66 is a schematic configuration view for illustrating a first manufacturing apparatus for the suspension body according to the thirty-fifth embodiment.

FIG. 66 is a schematic configuration view for illustrating a first manufacturing apparatus for the suspension body 7 according to the thirty-fifth embodiment, which is an apparatus configured to manufacture the core 21 in the first embodiment. The manufacturing apparatus in FIG. 66 includes a laminating unit 57, a resin bath 58, a hot forming device 59, a drawing device 60, and a reeling device 61. In FIG. 66, for ease of description, only two high-strength fiber layers 51 and one low-elasticity fiber layer 52 are illustrated.

The high-strength fiber layers 51 and the low-elasticity fiber layer 52 unwound from rolls are laminated in the laminating unit 57 so as to form the laminated body 53. Lamination of the high-strength fiber fabrics 54 forming each high-strength fiber layer 51, and lamination of the low-elasticity fiber fabrics forming each low-elasticity fiber layer 52 may be performed in the laminating unit 57.

The laminated body 53 formed in the laminating unit 57 is drawn into the resin bath 58 by the drawing device 60. The resin bath 58 contains an uncured thermosetting resin. As thermosetting resin, thermosetting resin to be used for the intermediate layers 24 and the segment layers 25 in the first embodiment is used. In the resin bath 58, the uncured thermosetting resin is impregnated into the laminated body 53. It is required that narrow spaces between fibers be impregnated with thermosetting resin, and hence it is desired that thermosetting resin in the resin bath 58 have low viscosity.

After that, the laminated body 53 is drawn into the hot forming device 59 by the drawing device 60. In the hot forming device 59, the laminated body 53 is heated so that thermosetting resin is cured. In this manner, the high-strength fiber layers 51 and the low-elasticity fiber layer 52 are integrated with each other, thereby forming the core 21 in the first embodiment. The core 21 is reeled by the reeling device 61.

Figure 67:
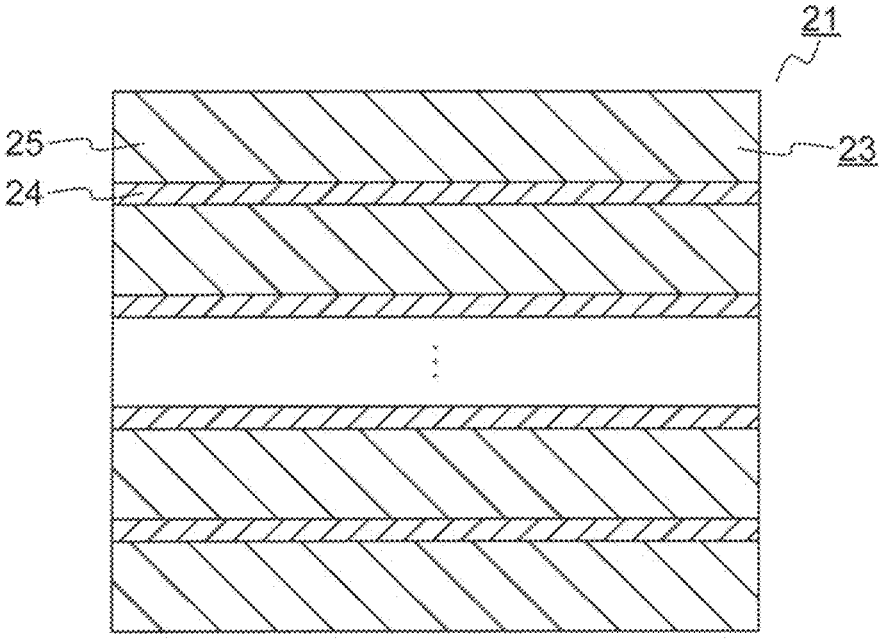
FIG. 67 is a sectional view for illustrating a core of the suspension body manufactured by the first manufacturing apparatus in FIG. 66.

FIG. 67 is a sectional view for illustrating the core 21 of the suspension body 7 manufactured by the first manufacturing apparatus in FIG. 66, and illustrating the cross section of the core 21 perpendicular to the length direction. The segment layers 25 in the thirty-fifth embodiment are each made of FRP (fiberglass reinforced plastics) including the high-strength fiber fabric 54. Further, the intermediate layers 24 are each made of the FRP including the low-elasticity fiber fabric. Moreover, a resin forming the segment layers 25 is the same as a resin forming the intermediate layers 24.

The outer periphery of the core 21 illustrated in FIG. 67 is covered with the covering layer 22 made of a resin. Thus, the suspension body 7 is completed. As the resin forming the covering layer 22, the resin exemplified in the first embodiment can be used.

The covering layer 22 is formed by covering the outer periphery of the core 21 with a resin through continuous press forming, intermittent press forming, or laminate forming, and then trimming unnecessary portions.

Figure 68:
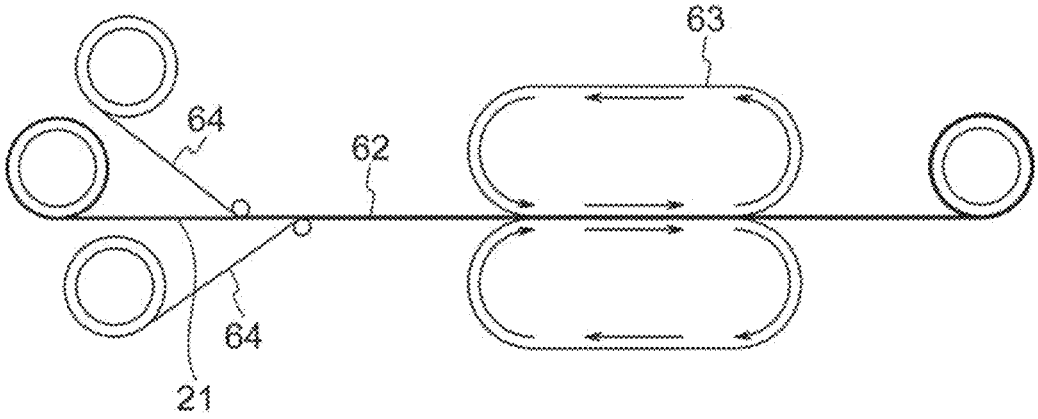
FIG. 68 is a schematic configuration view for illustrating a second manufacturing apparatus for the suspension body according to the thirty-fifth embodiment.

FIG. 68 is a schematic configuration view for illustrating a second manufacturing apparatus for the suspension body 7 according to the thirty-fifth embodiment, which is an apparatus configured to form the covering layer 22. The second manufacturing apparatus includes a sheet arranging unit 62 and a pressure forming device 63. In the sheet arranging unit 62, a plurality of thermoplastic sheets 64, which form the covering layer 22 and are made of a thermoplastic resin, are arranged so as to surround the core 21.

After that, the core 21 and the thermoplastic sheets 64 are transferred to the pressure forming device 63 and are subjected to pressure forming. In FIG. 68, a double belt press is illustrated as the pressure forming device 63, but the pressure forming device 63 is not limited thereto. As long as pressure required for integration of the thermoplastic sheets 64 and the core 21 can be applied continuously or intermittently, for example, an intermittent press or a laminator may be employed.

Figure 69:
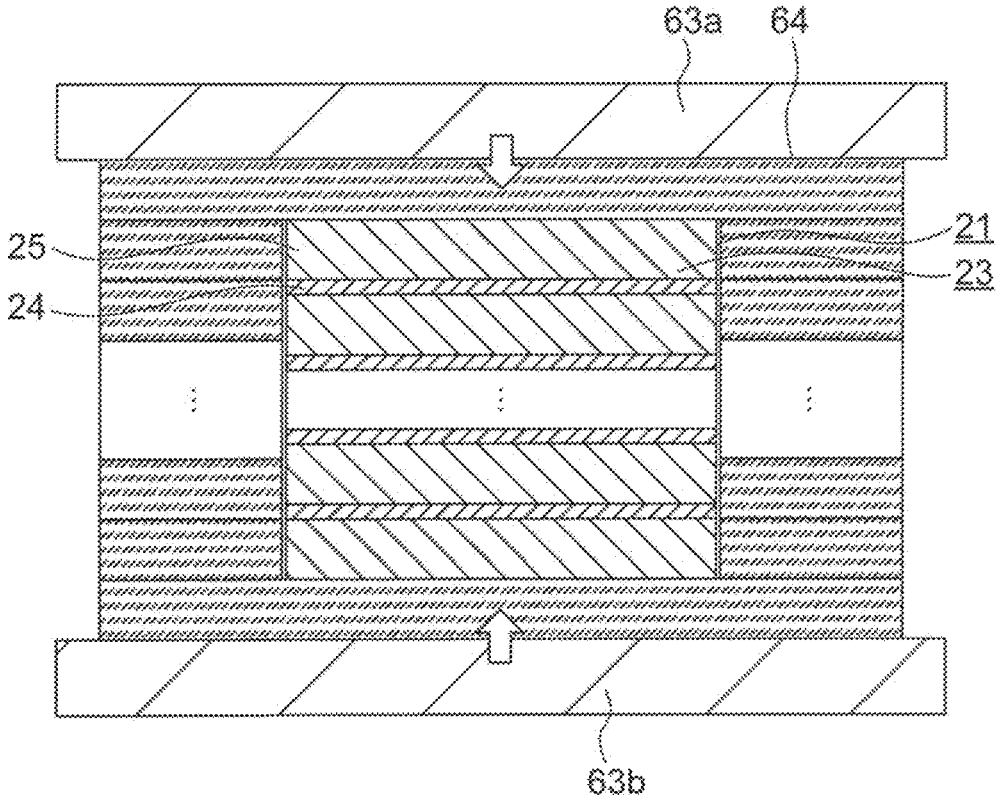
FIG. 69 is a sectional view for illustrating a state in which a pressure forming device in FIG. 68 applies pressure to the core and thermoplastic sheets.

FIG. 69 is a sectional view for illustrating a state in which the pressure forming device 63 in FIG. 68 applies pressure to the core 21 and the thermoplastic sheets 64, and illustrating the cross section perpendicular to the length direction of the core 21. The thermoplastic sheets 64 are arranged on both sides of the core 21 in the thickness direction (up-and-down direction in FIG. 69) and on both sides of the core 21 in the width direction (right-and-left direction in FIG. 69).

The pressure forming device 63 includes a pair of forming dies 63*a* and 63*b* configured to sandwich the core 21 and the thermoplastic sheets 64 from the both sides of the core 21 in the thickness direction. The forming dies 63*a* and 63*b* apply pressure in directions indicated by the arrows in FIG. 69.

Figure 70:
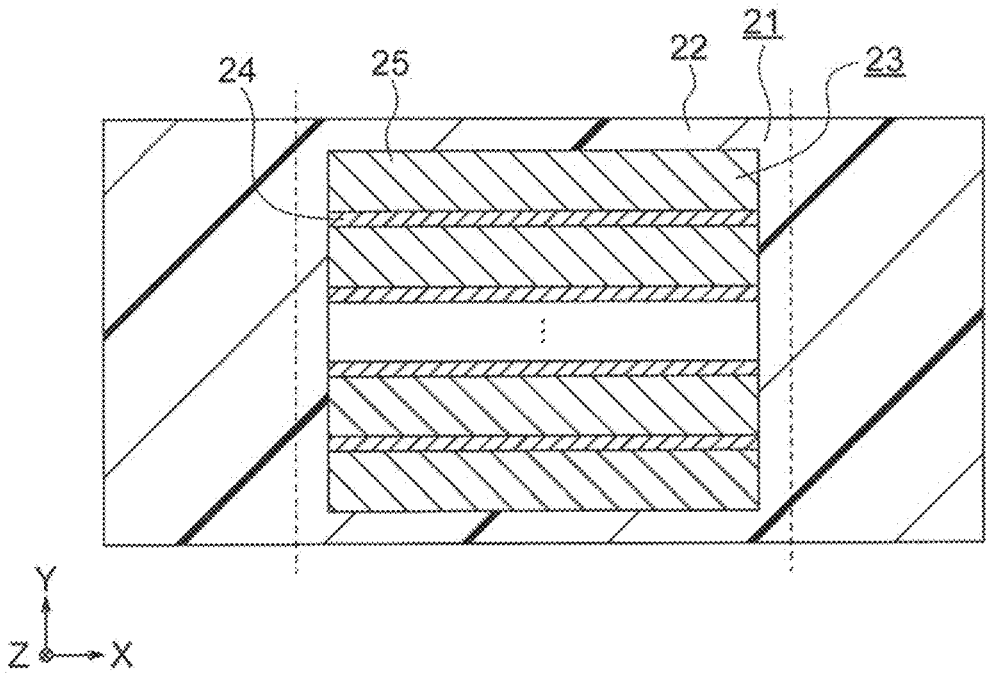
FIG. 70 is a sectional view for illustrating the suspension body before completion, which has been subjected to pressure forming by the pressure forming device in FIG. 69.

FIG. 70 is a sectional view for illustrating the suspension body 7, which has not been completed, subjected to pressure forming by the pressure forming device 63 in FIG. 69. After the suspension body 7 passes through the pressure forming device 63, the covering layer 22 protrudes to the both sides of the suspension body 7 in the width direction more than necessary. Thus, the unnecessary portions are trimmed along the broken lines in FIG. 70. In this manner, the suspension body 7 is completed.

According to this manufacturing method, the suspension body 7, in which the load bearing layer 23 is divided in the thickness direction of the core 21 and the intermediate layer 24 is interposed between the adjacent segment layers 25, can be easily manufactured. With this method, bendability of the core 21 can be improved, thereby being capable of relieving stress concentration on the segment layers 25, which are respectively located at the innermost layer and the outermost layer.

Thirty-Sixth Embodiment

Figure 71:
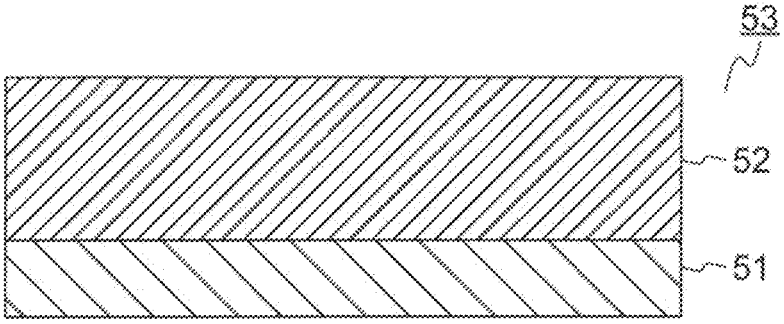
FIG. 71 is a sectional view for illustrating a state during manufacture of the suspension body for an elevator according to a thirty-sixth embodiment of this invention.

Next, FIG. 71 is a sectional view for illustrating a state during manufacture of the suspension body 7 for an elevator according to a thirty-sixth embodiment of this invention, and illustrating a cross section corresponding to the cross section of the suspension body 7 perpendicular to the length direction thereof. In the manufacturing method for the suspension body 7 according to the thirty-sixth embodiment, a plurality of high-strength fiber layers 51 are laminated on one side of the suspension body in the thickness direction, and at least one low-elasticity fiber layer 52 is laminated on another side of the suspension body. In this manner, the laminated body 53 is formed. The other processes of the manufacturing method are the same as those of the thirty-fifth embodiment.

Figure 72:
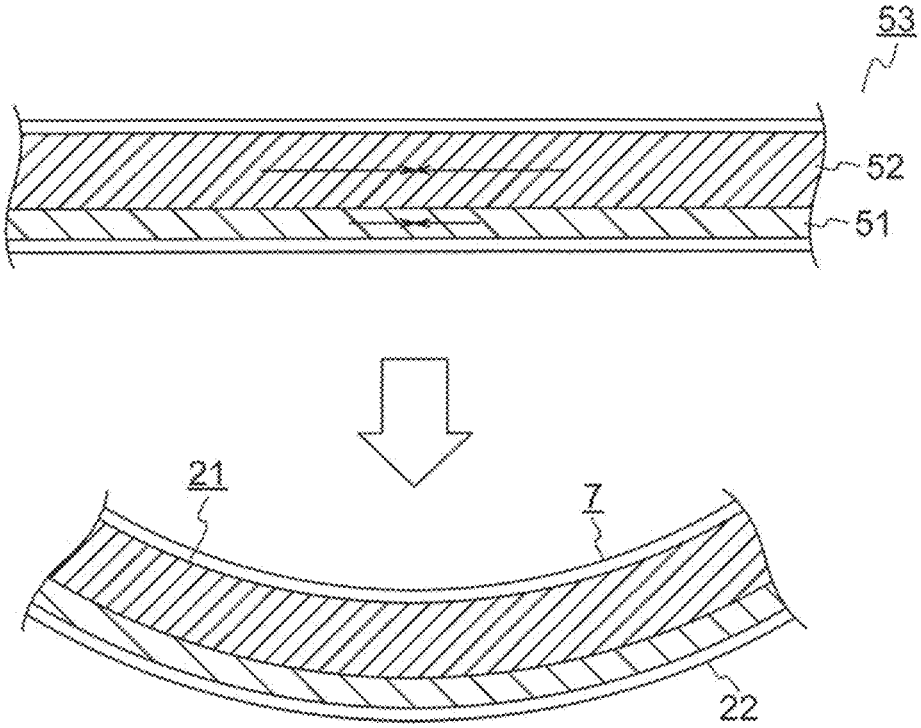
FIG. 72 is an explanatory view for illustrating a change of a laminated body in FIG. 71 due to heat curing.

According to this manufacturing method, when cure shrinkage occurs as a result of curing of a resin, there is a difference in shrinkage ratio in the length direction between the high-strength fiber layers 51 and the low-elasticity fiber layer 52, and thus the low-elasticity fiber layer 52 shrinks more significantly than the high-strength fiber layers 51. As a result, as illustrated in FIG. 72, the suspension body 7 is formed so as to bend to the low-elasticity fiber layer 52. The suspension body 7 is manufactured so as to bend in advance, thereby being capable of improving flexibility.

Thirty-Seventh Embodiment

Figure 73:
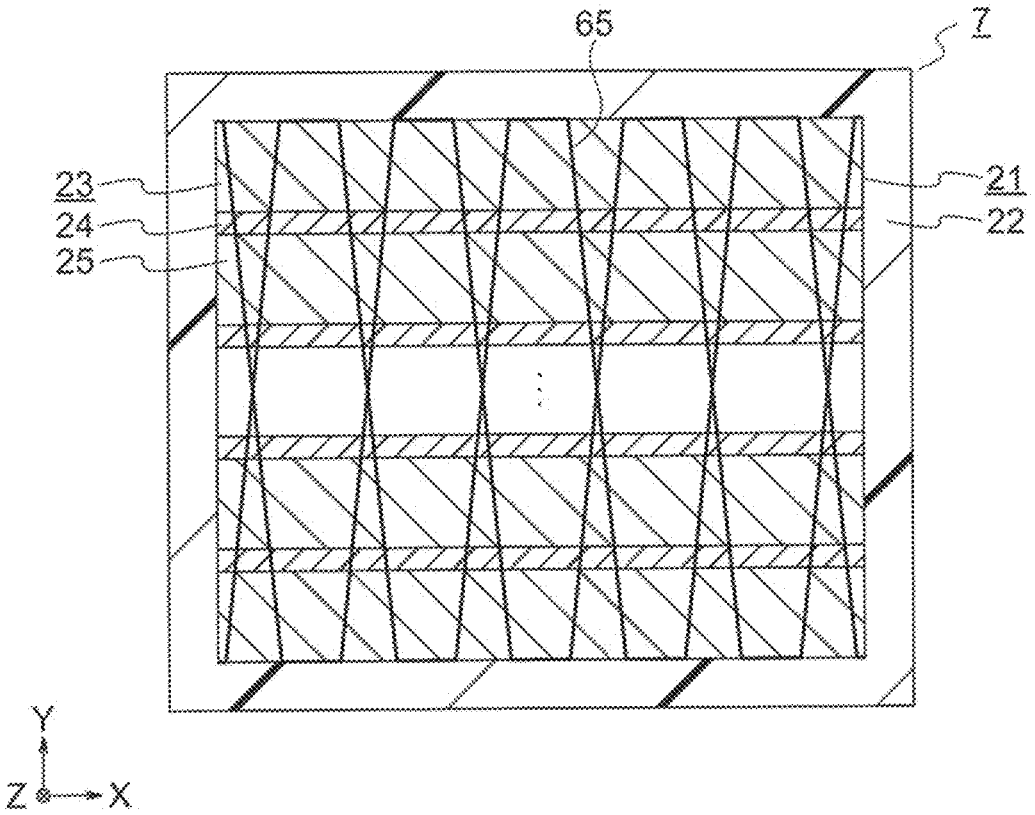
FIG. 73 is a sectional view for illustrating the suspension body manufactured by a manufacturing method according to a thirty-seventh embodiment of this invention.
Figure 74:
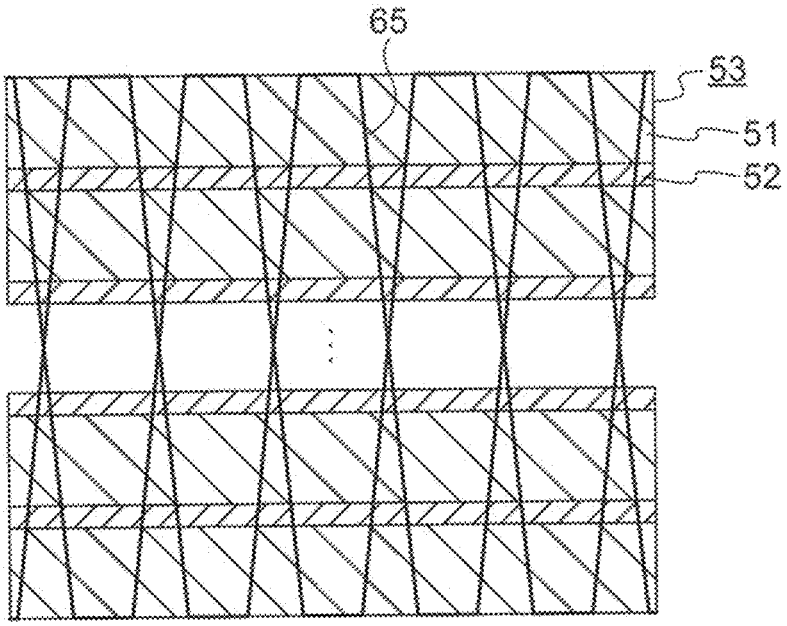
FIG. 74 is a sectional view for illustrating a state during manufacture of the suspension body in FIG. 73.

Next, FIG. 73 is a sectional view for illustrating the suspension body 7 manufactured by the manufacturing method according to a thirty-seventh embodiment of this invention. FIG. 74 is a sectional view for illustrating a state during manufacture of the suspension body 7 in FIG. 73. FIG. 73 and FIG. 74 are each an illustration of a cross section perpendicular to the length direction of the core 21.

In the manufacturing method for the suspension body 7 according to the thirty-seventh embodiment, after the laminated body 53 is formed and before an uncured thermosetting resin is impregnated into the laminated body 53, the laminated body 53 is integrated through stitching. That is, the high-strength fiber layers 51 and the low-elasticity fiber layers 52 are tied up with a stitching material 65 such as a thread. The other processes of the manufacturing method are the same as those of the thirty-fifth embodiment.

According to this manufacturing method, lateral shifting of the high-strength fiber layers 51 and the low-elasticity fiber layers 52 is prevented, thereby being capable of improving formability. When there is fiber shifting, a portion having the fiber shifting does not bear the load, with the result that strength of the suspension body 7 may be reduced. Through suppression of the fiber shifting, the suspension body 7 having sufficient strength can be obtained. Further, the fiber shifting can be suppressed through stitching. Moreover, in a resin impregnation step, a thermosetting resin is easily impregnated through the stitching material 65 in the thickness direction of the laminated body 53.

Thirty-Eighth Embodiment

Figure 75:
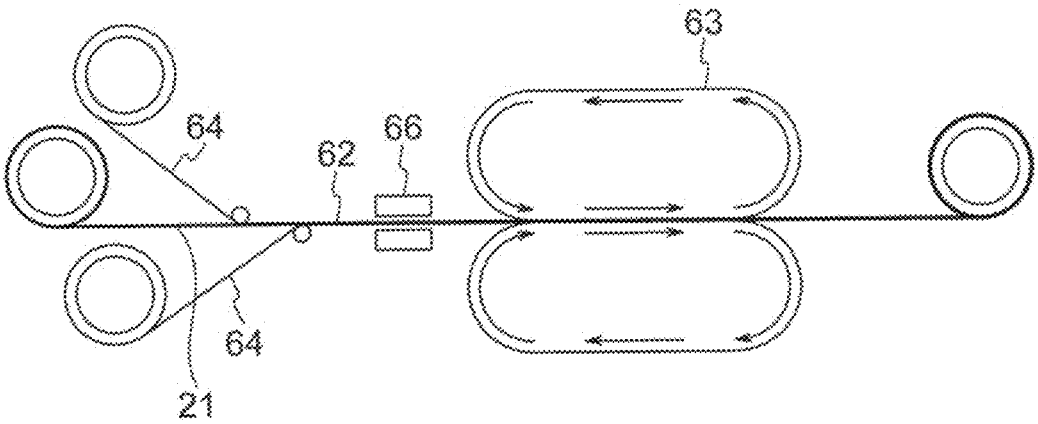
FIG. 75 is a schematic configuration view for illustrating a part of a manufacturing apparatus for the suspension body according to a thirty-eighth embodiment of this invention.

Next, FIG. 75 is a schematic configuration view for illustrating apart of a manufacturing apparatus for the suspension body 7 according to a thirty-eighth embodiment of this invention. The manufacturing apparatus in FIG. 75 corresponds to the second manufacturing apparatus in the thirty-fifth embodiment, but is different from the second manufacturing apparatus in the thirty-fifth embodiment in that a heating device 66 is arranged between the sheet arranging unit 62 and the pressure forming device 63.

As the heating device 66, there is used a device capable of achieving rapid heating within a certain period of time, such as an ultrasonic heating device, a radical heater, or a far-infrared heater.

In the manufacturing method according to the thirty-eighth embodiment, after the thermoplastic sheets 64 are arranged around the core 21, the thermoplastic sheets 64 are preheated by the heating device 66, and then the core 21 and the thermoplastic sheets 64 are subjected to pressure forming. The other processes of the manufacturing method are the same as those of the thirty-fifth embodiment or the thirtieth embodiment.

In this manufacturing method, prior to a pressure forming step, the thermoplastic sheets 64 are softened, thereby being capable of improving formability.

Thirty-Ninth Embodiment

Figure 76:
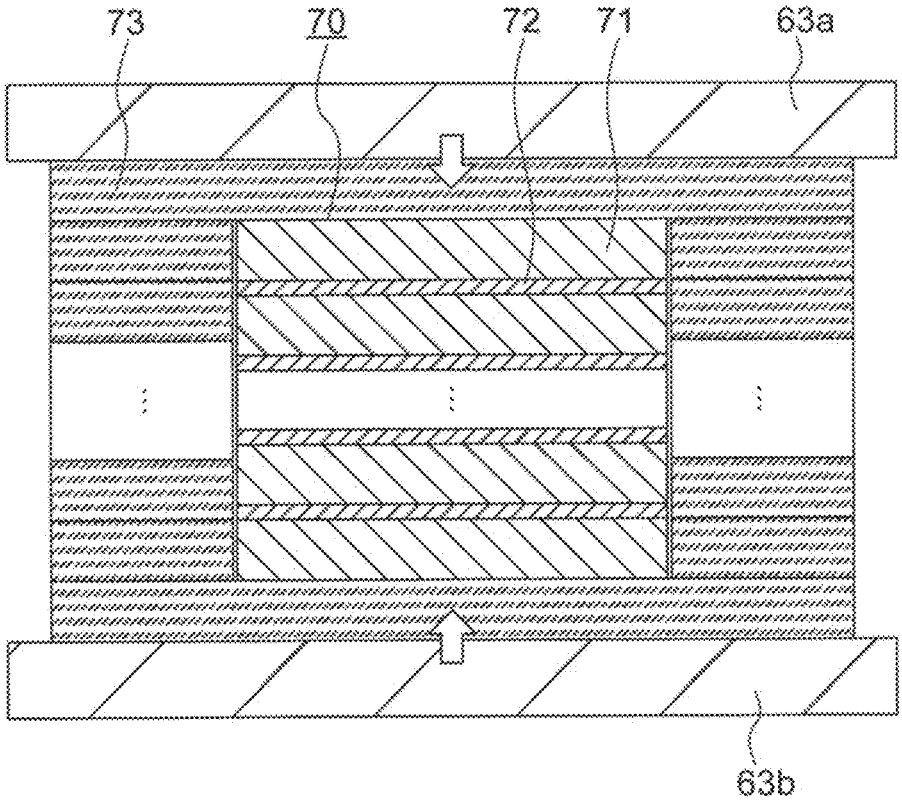
FIG. 76 is a sectional view for illustrating a state during manufacture of the suspension body by a manufacturing method according to a thirty-ninth embodiment of this invention.

Next, FIG. 76 is a sectional view for illustrating a state during manufacture of the suspension body 7 by the manufacturing method according to a thirty-ninth embodiment of this invention, and illustrating a cross section corresponding to the cross section in FIG. 69 in the thirty-fifth embodiment. In the manufacturing method according to the thirty-ninth embodiment, as a material for the segment layers 25, a unidirectional FRP plate 71 is used. As a material for the unidirectional FRP plate 71, thermosetting resin and the plurality of high-strength fibers described in the first embodiment are used.

Further, as a material for the intermediate layers 24, there are used a plurality of intermediate-layer thermoplastic sheets 72 each made of a thermoplastic resin or thermoplastic elastomer described in the first embodiment. Moreover, as a material for the covering layers 22, there are used a plurality of covering-layer thermoplastic sheets 73 each made of a thermoplastic resin described in the first embodiment.

Each unidirectional FRP plate 71 is manufactured through pultrusion molding. As illustrated in FIG. 76, the unidirectional FRP plates 71 and at least one intermediate-layer thermoplastic sheet 72 are alternately laminated to form a laminated body 70.

After that, the covering-layer thermoplastic sheets 73 are arranged so as to surround the laminated body 70, and the laminated body 70 and the covering-layer thermoplastic sheets 73 are subjected to pressure forming. In this manner, the laminated body 70 is integrated to form the core 21, and the covering-layer thermoplastic sheets 73 are integrated to form the covering layer 22. Then, as illustrated in FIG. 70, the unnecessary portions of the covering layer 22 are trimmed. In this manner, the suspension body 7 is completed. The other processes of the manufacturing method are the same as those of the thirty-fifth embodiment.

According to this manufacturing method, the suspension body 7, in which the load bearing layer 23 is divided in the thickness direction of the core 21 and the intermediate layer 24 is interposed between the adjacent segment layers 25, can be easily manufactured. With this method, bendability of the core 21 can be improved, thereby being capable of relieving stress concentration on the segment layers 25, which are respectively located at the innermost layer and the outermost layer.

Further, when the unidirectional FRP plate 71 is formed in advance so that a thermosetting resin is cured, shifting of the high-strength fiber layers in the segment layers 25 can be prevented. Moreover, through use of the intermediate-layer thermoplastic sheet 72 having elasticity lower than that of the low-elasticity fiber layer 52 in the thirty-fifth embodiment, an effect of shear deformation of the intermediate layer 24 can be improved.

Fortieth Embodiment

Figure 77:
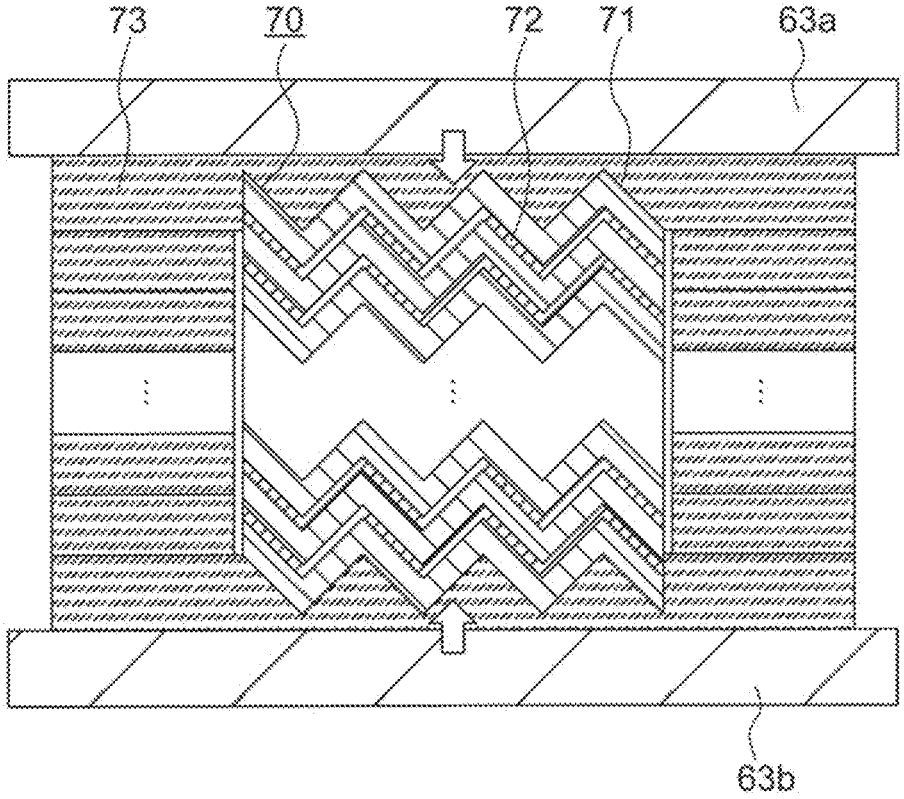
FIG. 77 is a sectional view for illustrating a state during manufacture of the suspension body by a manufacturing method according to a fortieth embodiment of this invention.

Next, FIG. 77 is a sectional view for illustrating a state during manufacture of the suspension body 7 by the manufacturing method according to a fortieth embodiment of this invention, and illustrating a cross section corresponding to the cross section in FIG. 69 in the thirty-fifth embodiment. The fortieth embodiment is different from the thirty-ninth embodiment in that the unidirectional FRP plate 71 has projections and recesses in the width direction.

In the fortieth embodiment, when the unidirectional FRP plate 71 is formed, there are used forming dies each having a sectional shape having projections and recesses in the width direction. The other processes of the manufacturing method are the same as those of the thirty-ninth embodiment.

Figure 78:
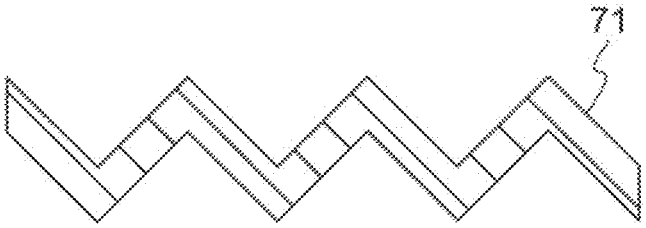
FIG. 78 is a sectional view for illustrating a unidirectional FRP plate in FIG. 77.

FIG. 78 is a sectional view for illustrating the unidirectional FRP plate 71 in FIG. 77. In FIG. 78, projections and recesses in a triangular wave pattern are formed in the unidirectional FRP plate 71. It is only required that projections and recesses be shaped so as to engage with each other, and the pattern of projections and recesses is not limited thereto. For example, the pattern of projections and recesses may be a sinusoidal wave pattern, a trapezoidal wave pattern, or a rectangular wave pattern.

Figure 79:
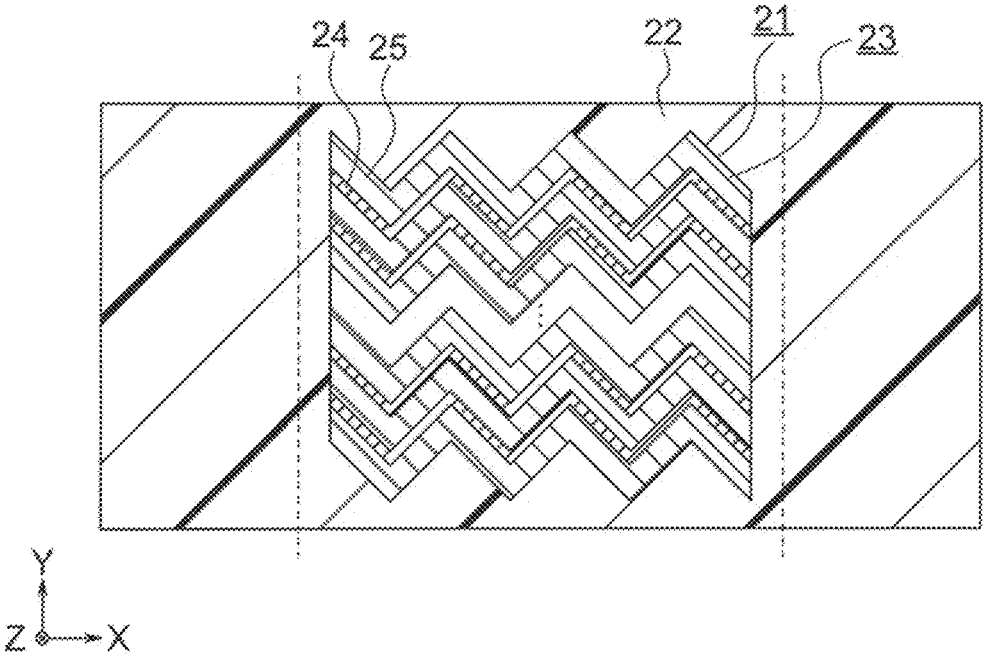
FIG. 79 is a sectional view for illustrating the suspension body before completion, which has been subjected to pressure forming by a pressure forming step in FIG. 77.

FIG. 79 is a sectional view for illustrating the suspension body 7 before completion, which has been subjected to pressure forming by the pressure forming step in FIG. 77. Through trimming of surplus portions of the covering layer 22 from the state in FIG. 79, the suspension body 7 illustrated in FIG. 80 is manufactured.

Figure 80:
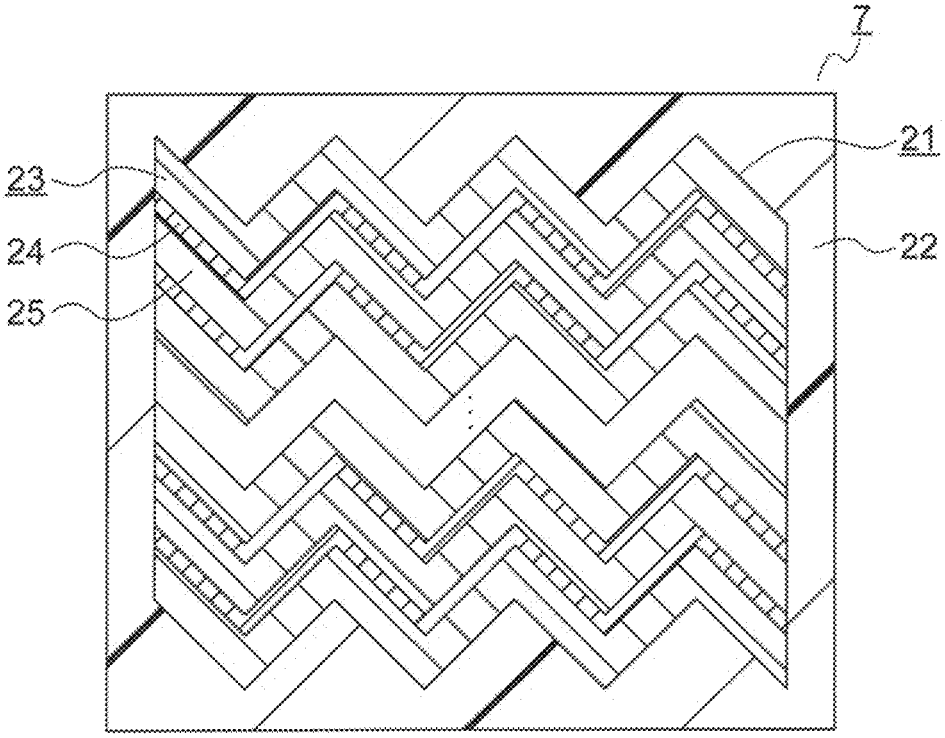
FIG. 80 is a sectional view for illustrating the suspension body manufactured by the manufacturing method according to the fortieth embodiment.

In FIG. 80, in the cross section perpendicular to the length direction of the core 21, projections and recesses are formed in a joint surface between the segment layer 25 and the intermediate layer 24.

In this manufacturing method, when the laminated body 70 and the covering-layer thermoplastic sheets 73 are subjected to pressure forming, the unidirectional FRP plates 71 engage with each other at projections and recesses in the width direction through intermediation of the intermediate-layer thermoplastic sheet 72, thereby being capable of preventing shifting in the width direction. In this manner, the width dimension of the suspension body 7 can be set within a proper range.

Forty-First Embodiment

Figure 81:
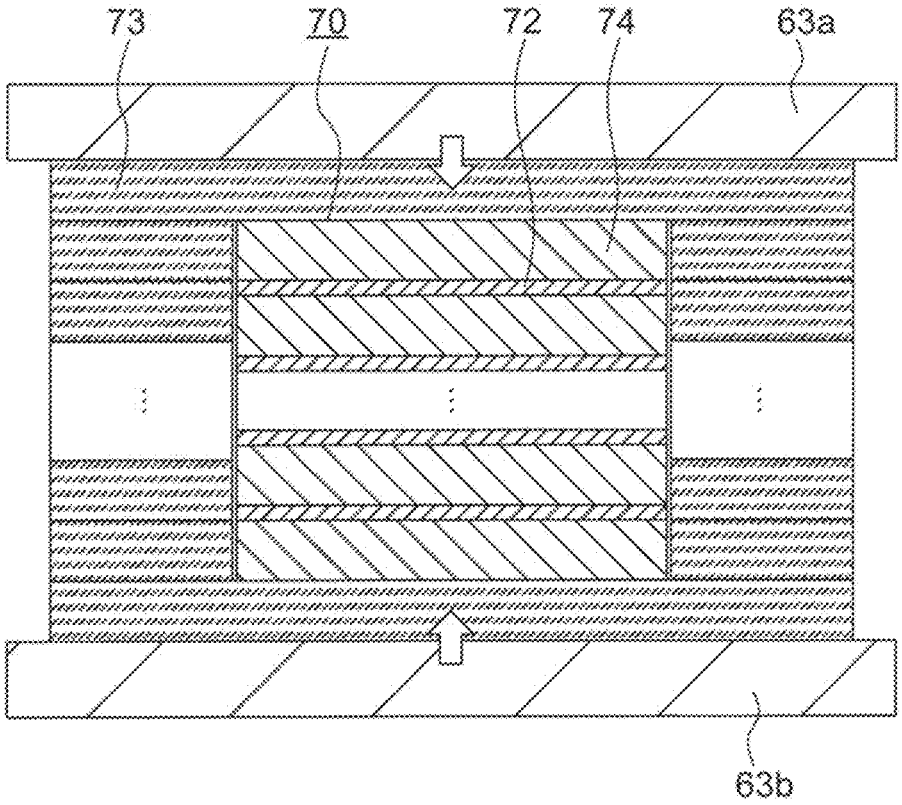
FIG. 81 is a sectional view for illustrating a state during manufacture of the suspension body by a manufacturing method according to a forty-first embodiment of this invention.

Next, FIG. 81 is a sectional view for illustrating a state during manufacture of the suspension body 7 by the manufacturing method according to a forty-first embodiment of this invention, and illustrating the cross section corresponding to the cross section in FIG. 69 in the thirty-fifth embodiment. In the unidirectional FRP plate 71 in the thirty-ninth embodiment, all of the high-strength fibers are arranged along the length direction, and a thermosetting resin is used as a resin. However, in an FRP sheet 74 in the forty-first embodiment, a part of the high-strength fibers may be oriented in a direction oblique to the length direction, and a thermoplastic resin is used as a resin. The other processes of the manufacturing method are the same as those of the thirty-ninth embodiment.

In this manufacturing method, as a material for the FRP sheet 74, a thermoplastic resin is used, and hence the FRP sheet 74 and the intermediate-layer thermoplastic sheet 72 have high affinities for each other at the time of pressure forming. Thus, interlaminar strength between the segment layer 25 and the intermediate layer 24 can be improved. In particular, when the same kind of resin as that for the intermediate-layer thermoplastic sheet is used as a thermoplastic resin for the FRP sheet 74, interlaminar strength can be further improved.

Further, a thermoplastic resin is used in the entire suspension body 7. Thus, after the covering layer 22 is formed, the end portion 7*a* or 7*b* of the suspension body 7 can be preheated so as to be formed into a freely selected shape, for example, a shape suitable for clasping of the end portion 7*a* or 7*b*.

Figure 82:
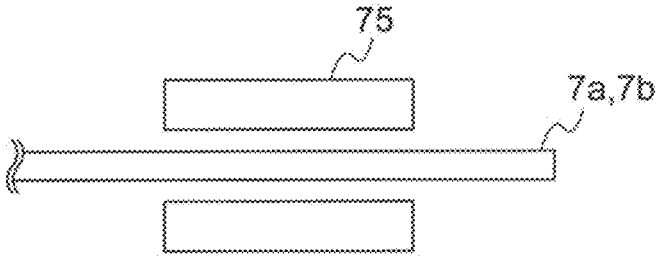
FIG. 82 is a side view for illustrating a step of preheating an end portion of the suspension body according to the forty-first embodiment.

FIG. 82 is a side view for illustrating a step of preheating the end portion 7*a* or 7*b* of the suspension body 7 according to the forty-first embodiment. As a heating device 75, similarly to the heating device 66, there is used a device capable of achieving rapid heating within a certain period of time, such as an ultrasonic heating device, a radical heater, or a far-infrared heater.

Figure 83:
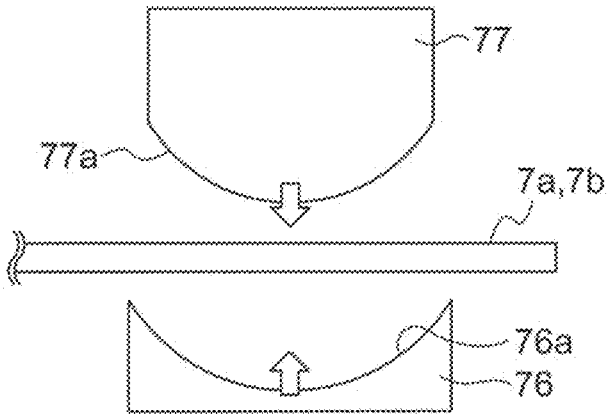
FIG. 83 is a side view for illustrating a first example of a step of performing pressure forming on the end portion of the suspension body after performing the preheating in FIG. 82.

FIG. 83 is a side view for illustrating a first example of a step of performing pressure forming on the end portion 7*a* or 7*b* of the suspension body 7 after performing the preheating in FIG. 82. In the first example, the end portion 7*a* or 7*b* is arranged between a first forming die 76, which includes a first forming surface 76*a* dented in an arc shape, and a second forming die 77, which includes a second forming surface 77*a* projecting in an arc shape.

Figure 84:
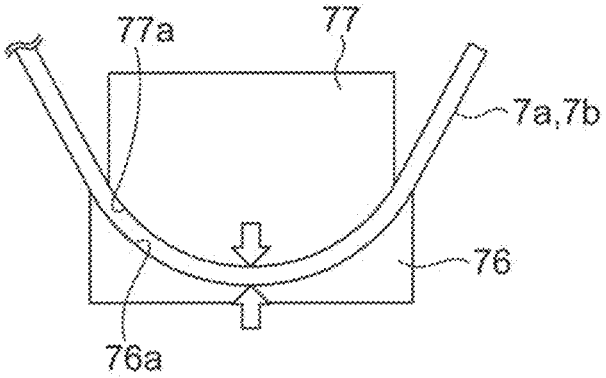
FIG. 84 is a side view for illustrating a state in which the end portion of the suspension body is sandwiched between a first forming die and a second forming die in FIG. 83.
Figure 85:
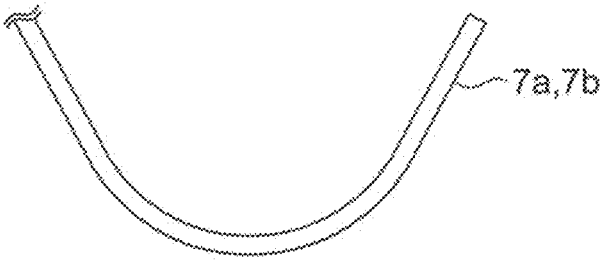
FIG. 85 is a side view for illustrating the curved end portion of the suspension body formed through the step in FIG. 84.

FIG. 84 is a side view for illustrating a state in which the end portion 7*a* or 7*b* is sandwiched between the first forming die 76 and the second forming die 77 in FIG. 83. As illustrated in FIG. 84, after pressure is applied to the end portion 7*a* or 7*b* by the first forming die 76 and the second forming die 77, the end portion 7*a* or 7*b* is taken out of the forming dies 76 and 77. In this manner, as illustrated in FIG. 85, the end portion 7*a* or 7*b* can be curved into an arc shape.

Figure 86:
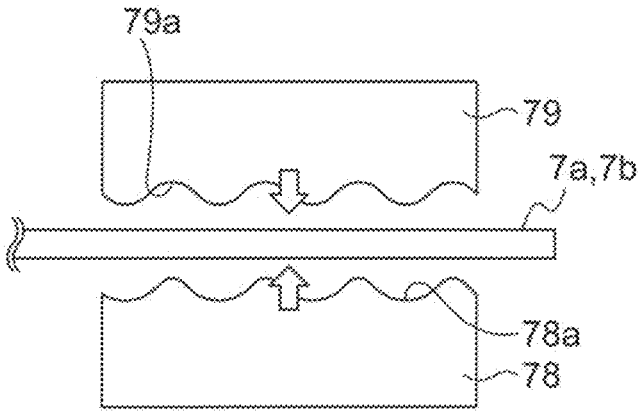
FIG. 86 is a side view for illustrating a second example of the step of performing pressure forming on the end portion of the suspension body after performing the preheating in FIG. 82.

FIG. 86 is a side view for illustrating a second example of a step of performing pressure forming on the end portion 7*a* or 7*b* of the suspension body 7 after performing the preheating in FIG. 82. In the second example, the end portion 7*a* or 7*b* is arranged between a first forming die 78, which includes a first forming surface 78*a* being a corrugated projection/recess surface, and a second forming die 79, which includes a second forming surface 79*a* being a corrugated projection/recess surface.

Figure 87:
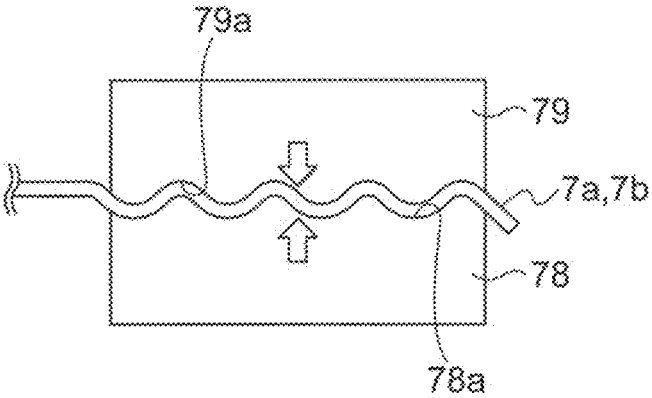
FIG. 87 is a side view for illustrating a state in which the end portion of the suspension body is sandwiched between a first forming die and a second forming die in FIG. 86.
Figure 88:
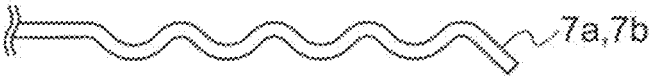
FIG. 88 is a side view for illustrating the end portion of the suspension body deformed through the step in FIG. 87.

FIG. 87 is a side view for illustrating a state in which the end portion 7*a* or 7*b* is sandwiched between the first forming die 78 and the second forming die 79 in FIG. 86. As illustrated in FIG. 87, after pressure is applied to the end portion 7*a* or 7*b* by the first forming die 78 and the second forming die 79, the end portion 7*a* or 7*b* is taken out of the forming dies 78 and 79. In this manner, as illustrated in FIG. 88, the end portion 7*a* or 7*b* can be deformed into a corrugated shape.

In the manufacturing method according to the thirty-ninth embodiment to the forty-first embodiment, preheating may be performed similarly to the thirty-eighth embodiment. That is, after the covering-layer thermoplastic sheets 73 are arranged around the laminated body 70 and then the covering-layer thermoplastic sheets 73 are preheated, the laminated body 70 and the covering-layer thermoplastic sheets 73 may be subjected to pressure forming. In this manner, formability can be improved.

Further, when preheating is performed, preheating may be performed also on the laminated body 70.

Further, the manufacturing method according to the thirty-fifth embodiment to the forty-first embodiment is applicable also to the suspension body 7 as described in the second embodiment to the fourth embodiment and the sixth embodiment to the fifteenth embodiment.

Forty-Second Embodiment

Figure 89:
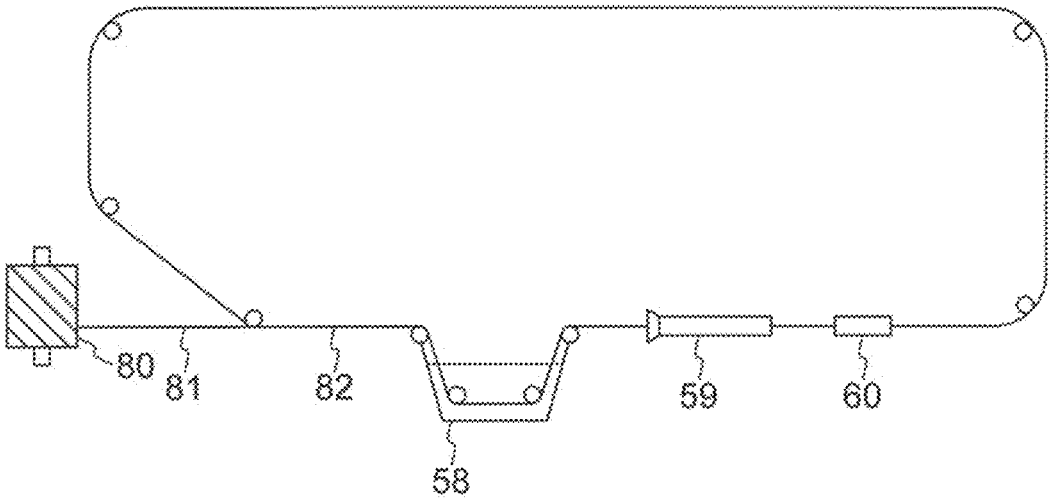
FIG. 89 is a schematic configuration view for illustrating a first manufacturing apparatus for the suspension body for an elevator according to a forty-second embodiment of this invention.

Next, description is made of the manufacturing method for the suspension body 7 including the intermediate layer 24 as described in the thirty-fourth embodiment. FIG. 89 is a schematic configuration view for illustrating a first manufacturing apparatus for the suspension body 7 for an elevator according to a forty-second embodiment of this invention, which is an apparatus configured to manufacture the core 21 in the thirty-fourth embodiment. The manufacturing apparatus in FIG. 89 corresponds to the first manufacturing apparatus in the thirty-fifth embodiment, but is different from that in the thirty-fifth embodiment in that the reeling device 61 is not provided.

In the manufacturing method according to the forty-second embodiment, a high-strength fiber thread 81 pulled out from a bobbin 80 is returned to a bundle portion 82 after passing through the drawing device 60, and a required amount of fibers is bundled, thereby forming a bundle body. Then, an uncured thermosetting resin is impregnated into the bundle body, and the uncured thermosetting resin is heated and cured, thereby forming the core 21. The other processes of the manufacturing method are the same as those of the thirty-fifth embodiment or the thirty-seventh embodiment.

In order to maintain a uniform peripheral length when the high-strength fiber thread 81 having passed through the drawing device 60 is returned to the bundle portion 82, it is desired that uniform tension be applied to the high-strength fiber thread 81 by, for example, a pulley. Through continuous application of the uniform tension on the high-strength fiber thread 81, the peripheral length is maintained to a length of the shortest path starting from the bundle portion 82 and returning to the bundle portion 82 via the drawing device 60.

According to this manufacturing method, the suspension body 7 having an endless ring shape described in the thirty-fourth embodiment can be manufactured. End portions of the high-strength fiber thread 81 are integrally formed as a bundle body of the high-strength fiber thread, and hence the suspension body 7 has no end portion.

Forty-Third Embodiment

Figure 90:
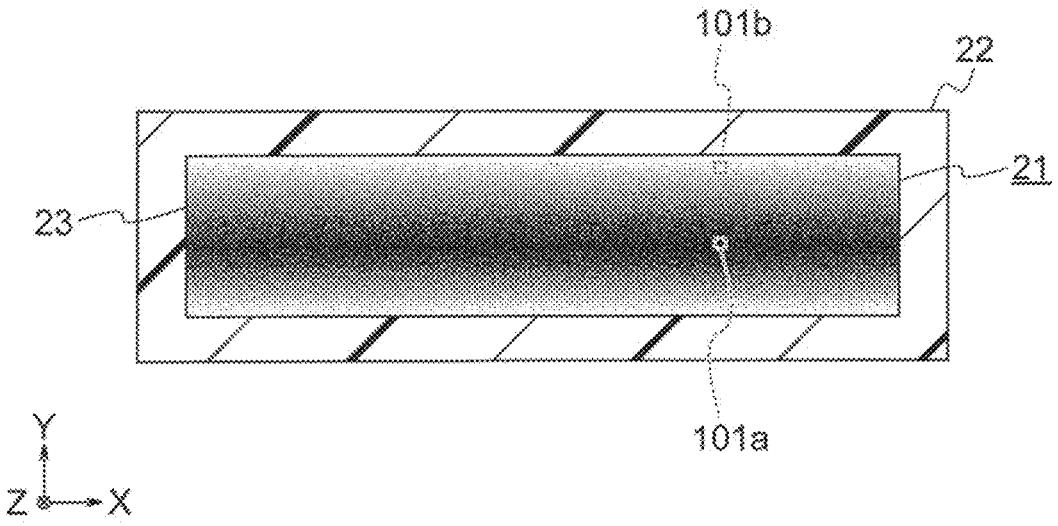
FIG. 90 is a sectional view for illustrating the suspension body for an elevator according to a forty-third embodiment of this invention.
Figure 91:
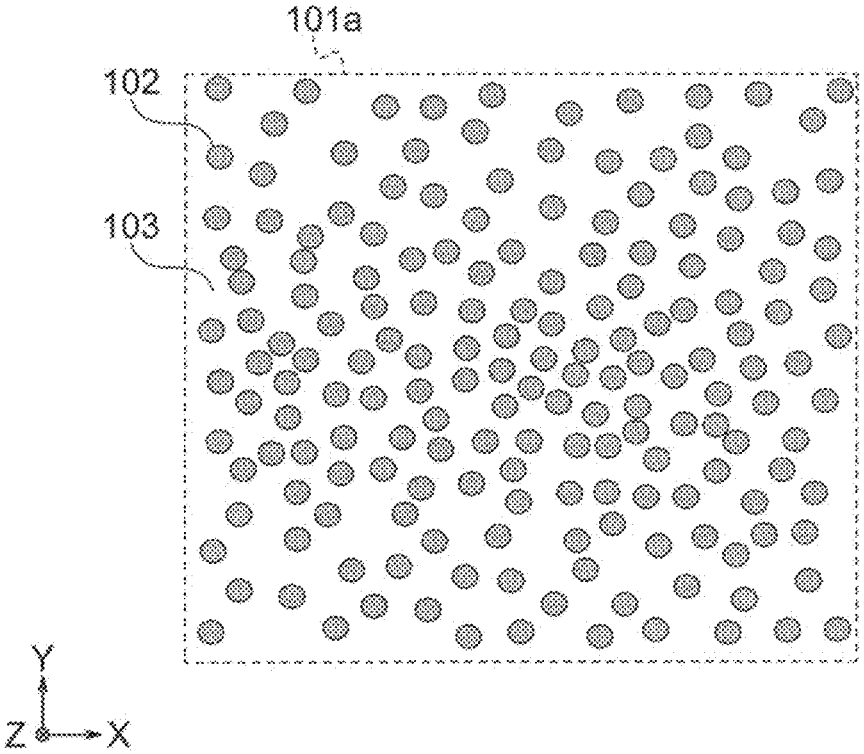
FIG. 91 is an enlarged sectional view for illustrating a portion 101*a* in FIG. 90.
Figure 92:
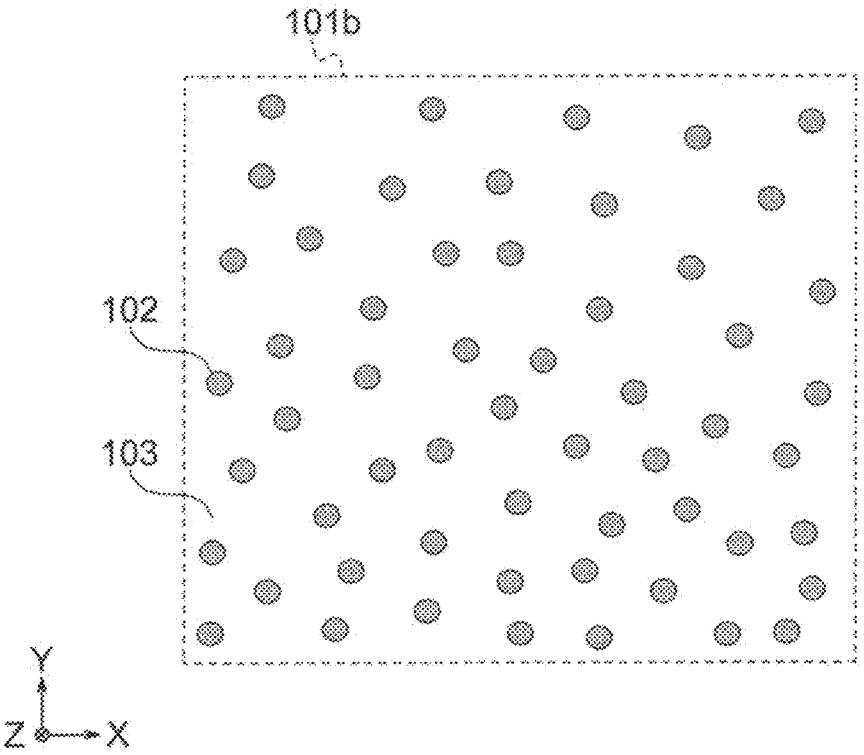
FIG. 92 is an enlarged sectional view for illustrating a portion 101*b* in FIG. 90.

Next, FIG. 90 is a sectional view for illustrating the suspension body for an elevator according to a forty-third embodiment of this invention. FIG. 91 is an enlarged sectional view for illustrating a portion 101*a* in FIG. 90. FIG. 92 is an enlarged sectional view for illustrating a portion 101*b* in FIG. 90. The portion 101*a* in FIG. 90 is located at the center portion of the load bearing layer 23 in the thickness direction. Further, the portion 101*b* in FIG. 90 is located at the end portion of the load bearing layer 23 in the thickness direction.

The core 21 in the forty-third embodiment includes only the load bearing layer 23. The load bearing layer 23 is formed of an impregnation resin 103 and a plurality of high-strength fibers 102. Further, a density of the high-strength fibers 102 in the center portion of the load bearing layer 23 in the thickness direction is higher than a density of the high-strength fibers 102 in each end portion of the load bearing layer 23 in the thickness direction.

In all of the embodiments, the density of the high-strength fibers 102 means a ratio of the high-strength fibers forming the load bearing layer 23. That is, a volume content of the high-strength fibers 102 forming a fixed amount of the load bearing layer 23, or a ratio of a sectional area of the high-strength fibers 102 occupying the cross section perpendicular to the length direction of the core 21 corresponds to the density of the high-strength fibers 102.

In the forty-third embodiment, the density of the high-strength fibers 102 decreases continuously from the center portion of the load bearing layer 23 in the thickness direction toward both end portions of the load bearing layer 23 in the thickness direction. Further, in the forty-third embodiment, through variation of the number of the high-strength fibers 102 occupying the sectional area perpendicular to the length direction of the core 21, the density of the high-strength fibers 102 is varied. The other configurations are the same as those of the eleventh embodiment.

Here, tensile rigidity of the high-strength fibers 102 in the Z-axis direction is higher than tensile rigidity of the impregnation resin 103 in the Z-axis direction. This is because, in the entire FRP, the high-strength fibers 102 mainly have a function of increasing strength and rigidity, and the impregnation resin 103 mainly has a function of integrating the high-strength fibers 102.

The load bearing layer 23 in this embodiment is characterized in that tensile rigidity in the Z-axis direction is high at the center portion in the Y-axis direction, and that the tensile rigidity decreases at a portion farther from the center portion in the Y-axis direction. Thus, when the cross section of the load bearing layer 23 is the same shape and a content of the high-strength fibers 102 is the same, a sectional secondary moment in bending with respect to the X-axis, namely, bending about the X-axis becomes lower as compared to a case in which the high-strength fibers 102 are evenly dispersed in the impregnation resin 103.

With this configuration, the suspension body is easily bent with respect to the X-axis, and a winding start portion and a winding end portion of the suspension body wound around the driving sheave 6 are less liable to loosen up. Thus, the suspension body is less liable to slip off the driving sheave 6 when the suspension body is transferred by the driving sheave 6.

Further, it is desired that, in the load bearing layer 23 in the forty-third embodiment, the center portion of the load bearing layer 23 in the thickness direction be located close to a position on the neutral axis at which the suspension body is not subjected to compression and tension under a state in which the suspension body is wound around the driving sheave 6. Thus, the tension acts on the suspension body in a state of being applied to the elevator, and hence it is desired that the center portion of the load bearing layer 23 be located on a side closer to a contact surface with the driving sheave 6 than to the center portion of the suspension body in the thickness direction.

Further, the contact surface of the suspension body with the driving sheave 6 can be increased, thereby being capable of increasing a transmittable drive force owing to a frictional force acting on the contact surface. Further, the suspension body is easily bent, and hence is easily handled during work such as storage, transport, installation, or replacement.

Here, the Young's modulus of the impregnation resin 103 affects readiness of bending of the entire load bearing layer 23. That is, when the Young's modulus of the impregnation resin 103 is set low, the readiness of bending is improved. Ideally, it is preferred that the Young's modulus of the impregnation resin 103 be set equal to or lower than 6 GPa.

Meanwhile, when bending with respect to the X-axis is caused to act on the load bearing layer 23, the high-strength fibers 102 are partially subjected to tension in the Z-axis direction, and are partially subjected to compression in the Z-axis direction. In contrast, when the Young's modulus of the impregnation resin 103 is set excessively low, the high-strength fibers 102 are easily moved in a direction perpendicular to the Z-axis direction in a case in which the high-strength fibers 102 are compressed. Then, separation occurs between the high-strength fibers 102 and the impregnation resin 103, with the result that a phenomenon of breakage of the load bearing layer 23 is liable to occur. Thus, it is desired that the Young's modulus of the impregnation resin 103 be set equal to or higher than 0.1 GPa.

As described above, it is preferred that the Young's modulus of the impregnation resin 103 be set equal to or lower than 6 GPa and equal to or higher than 0.1 GPa. In particular, as characteristics capable of properly balancing readiness of bending and unbreakableness, it is preferred to select the impregnation resin 103 having the Young's modulus of equal to or lower than 2 GPa, more preferably, the Young's modulus of equal to or lower than 1.5 GPa. This holds true for all other embodiments relating to the suspension body using the impregnation resin 103.

Further, it is preferred that, in a portion of the load bearing layer 23 having the highest density of the high-strength fibers 102, namely, the center portion of the load bearing layer 23 in the thickness direction, a volume content of the high-strength fibers 102 be set equal to or larger than 60%, more preferably, equal to or larger than 70%.

Further, it is preferred that, in a portion of the load bearing layer 23 having the lowest density of the high-strength fibers 102, namely, each end portion of the load bearing layer 23 in the thickness direction, the volume content of the high-strength fibers 102 be set equal to or lower than 50%, more preferably, equal to or lower than 40%.

This is because, when the density of the high-strength fibers 102 is excessively high, the effect of integrating the high-strength fibers 102 by the impregnation resin 103 is reduced, with the result that fatigue due to bending is liable to progress. The center portion in the thickness direction, which is subjected to low stress when the core 21 is bent in a longitudinal direction thereof, is formed to have a high carbon fiber density enabling impregnation in manufacture. Meanwhile, the end portion, which is subjected to a large change in stress due to bending, is formed to have a carbon fiber density capable of sufficiently attaining the integrating effect. Thus, optimization of fatigue and strength can be achieved.

Figure 93:
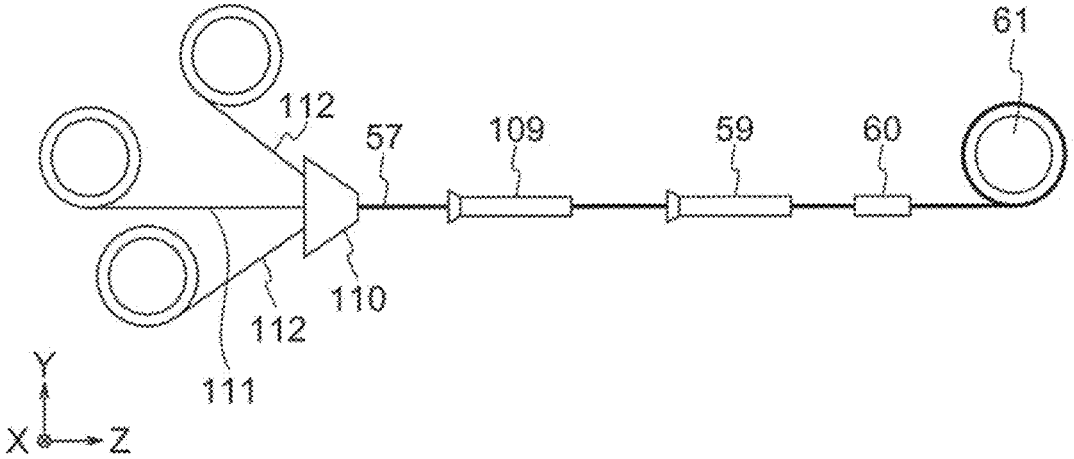
FIG. 93 is a schematic configuration view for illustrating a manufacturing apparatus for the suspension body according to the forty-third embodiment.
Figure 94:
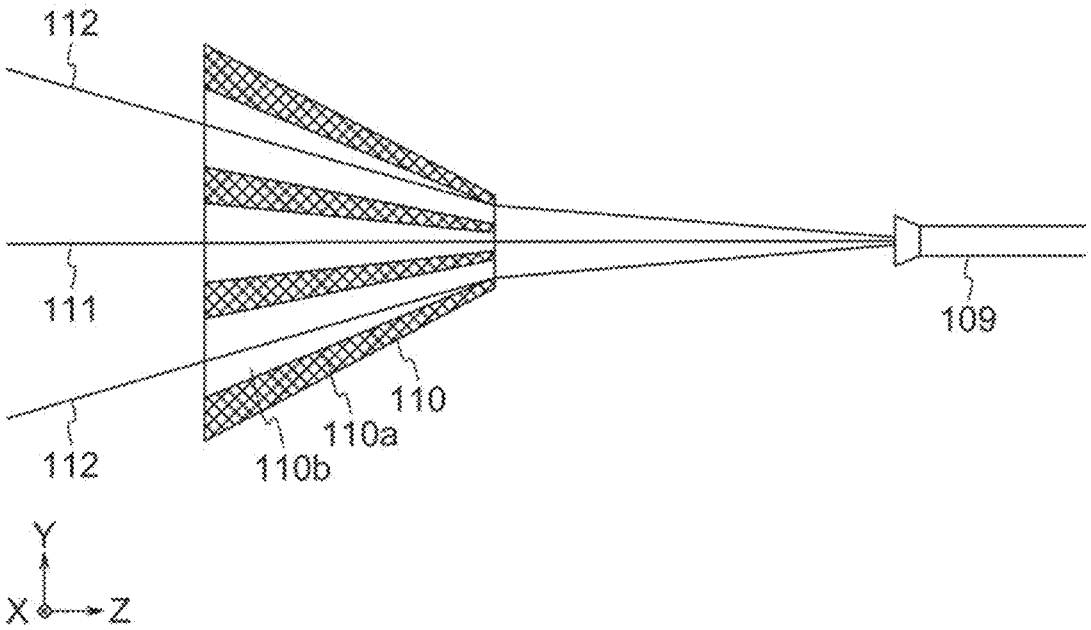
FIG. 94 is a sectional view for illustrating a main part of FIG. 93.

FIG. 93 is a schematic configuration view for illustrating a manufacturing apparatus for the suspension body according to this embodiment. FIG. 94 is a sectional view for illustrating a main part of FIG. 93. In the apparatus in FIG. 93, a first high-strength fiber group 111 and a plurality of second high-strength fiber groups 112 are paid out from corresponding bobbins, respectively. A fiber density of the first high-strength fiber group 111 is higher than a fiber density of the second high-strength fiber groups 112.

In FIG. 93, for ease of description, the two kinds of high-strength fiber groups 111 and 112 are illustrated. However, more bobbins may be arranged, and three or more kinds of high-strength fiber groups different in fiber density may be paid out. In this manner, the density of the high-strength fibers 102 can be continuously varied.

The high-strength fiber groups 111 and 112 paid out from the bobbins are caused to pass through a fiber positioning unit 110. As illustrated in FIG. 94, the fiber positioning unit 110 has a plurality of holes 110*b* configured to allow individual passage of the high-strength fiber groups 111 and 112. A guide wall 110*a* configured to guide the high-strength fiber group 111 individually is formed around each of the holes 110*b*.

The high-strength fiber groups 111 and 112 are caused to pass through the fiber positioning unit 110, and thus are brought close to each other while maintaining mutual relative positions. Further, the high-strength fiber groups 111 and 112 are caused to pass through an injection device 109 after passing through the fiber positioning unit 110.

In the injection device 109, the impregnation resin 103 is impregnated into a bundle of the high-strength fiber groups 111 and 112. The other configurations of the manufacturing apparatus and the other processes of the manufacturing method are the same as those of the thirty-fifth embodiment.

As described above, the manufacturing method for the suspension body according to the forty-third embodiment includes first to fifth steps. The first step is a step of paying out the plurality of high-strength fiber groups 111 and 112 different in fiber density from the corresponding bobbins, respectively. The second step is a step of forming the bundle of the high-strength fiber groups 111 and 112 by bringing the high-strength fiber groups 111 and 112 close to each other while maintaining the mutual relative positions.

The third step is a step of impregnating the impregnation resin 103 into the bundle of the high-strength fiber groups 111 and 112. The fourth step is a step of forming the core 21 by performing hot forming on the bundle of the high-strength fiber groups 111 and 112 impregnated with a resin. The fifth step is a step of forming the covering layer 22 covering at least a part of the outer periphery of the core 21.

With this manufacturing method, the suspension body having the sectional structure as illustrated in FIG. 90 can be efficiently manufactured.

Forty-Fourth Embodiment

Figure 95:
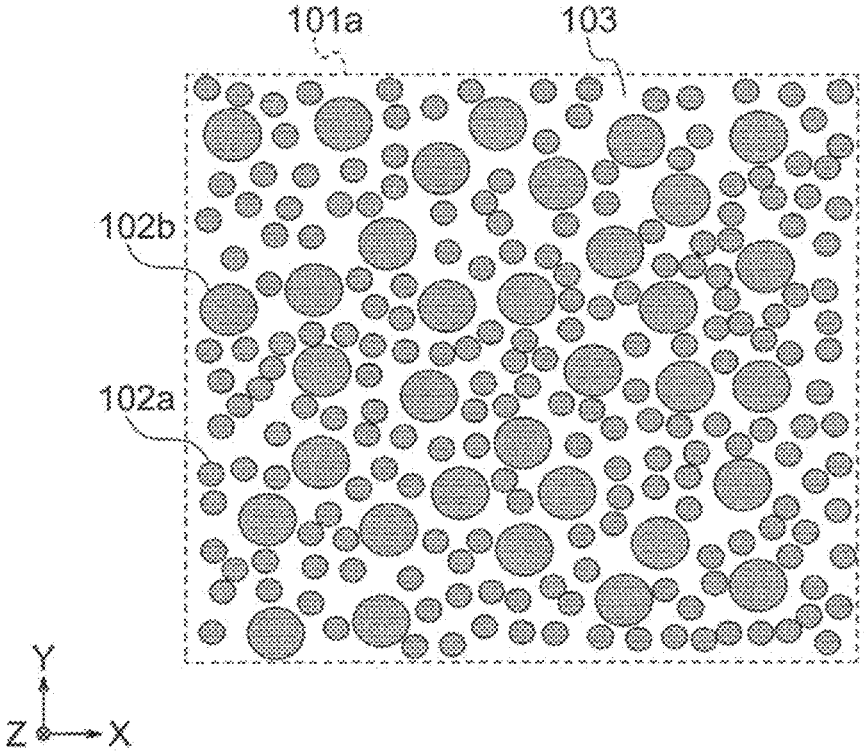
FIG. 95 is an enlarged sectional view for illustrating a center portion of a load bearing layer in a thickness direction thereof according to a forty-fourth embodiment of this invention.
Figure 96:
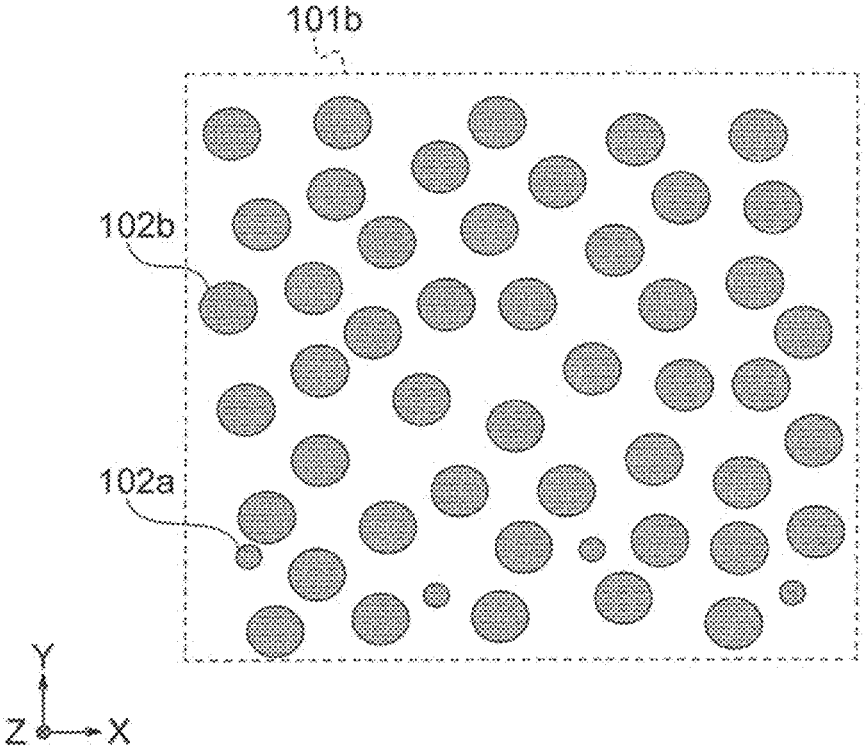
FIG. 96 is an enlarged sectional view for illustrating the end portion of the load bearing layer in the thickness direction according to the forty-fourth embodiment.

Next, FIG. 95 is an enlarged sectional view for illustrating the center portion of the load bearing layer 23 in the thickness direction according to a forty-fourth embodiment of this invention. FIG. 96 is an enlarged sectional view for illustrating the end portion of the load bearing layer 23 in the thickness direction according to the forty-fourth embodiment. FIG. 95 is an illustration of a portion corresponding to the portion 101*a* in FIG. 90. FIG. 96 is an illustration of a portion corresponding to the portion 101*b* in FIG. 90.

In the forty-fourth embodiment, a plurality of kinds of high-strength fibers 102 having different diameters are used. That is, as the high-strength fibers 102, a plurality of first high-strength fibers 102*a* and a plurality of second high-strength fibers 102*b* are used. A diameter of the second high-strength fibers 102*b* is larger than a diameter of the first high-strength fibers 102*a*. A material for the second high-strength fibers 102*b* is the same as a material for the first high-strength fibers 102*a*.

In the center portion of the load bearing layer 23 in the thickness direction, the first high-strength fibers 102*a* are arranged among the second high-strength fibers 102*b*. In contrast, in each end portion of the load bearing layer 23 in the thickness direction, no first high-strength fibers 102*a* are arranged among the second high-strength fibers 102*b*, or the number of the first high-strength fibers 102*a* arranged among the second high-strength fibers 102*b* is reduced.

With this configuration, the density of the high-strength fibers 102 in the center portion of the load bearing layer 23 in the thickness direction is higher than the density of the high-strength fibers 102 in each end portion of the load bearing layer 23 in the thickness direction.

Further, through continuous variation of the number of the first high-strength fibers 102*a* along the thickness direction of the load bearing layer 23, the density of the high-strength fibers 102 can be decreased continuously from the center portion of the load bearing layer 23 in the thickness direction toward each end portion of the load bearing layer 23 in the thickness direction. The other configurations are the same as those of the forty-third embodiment.

Further, when the load bearing layer 23 in the forty-fourth embodiment is manufactured, it is only required that the density of the first high-strength fibers 102*a* in the high-strength fiber groups 112 paid out from the upper and lower bobbins in FIG. 93 be set low, and that the density of the first high-strength fibers 102*a* in the high-strength fiber group 111 paid out from the center bobbin be set high.

Even with this configuration, the same effects as those of the forty-third embodiment can be attained. Further, the high-strength fibers 102*a* and 102*b* having different sizes are used, and hence gathering of the high-strength fibers 102*a* and 102*b* is less liable to occur at the time of resin impregnation. Thus, a target density distribution can be achieved with better accuracy.

Forty-Fifth Embodiment

Figure 97:
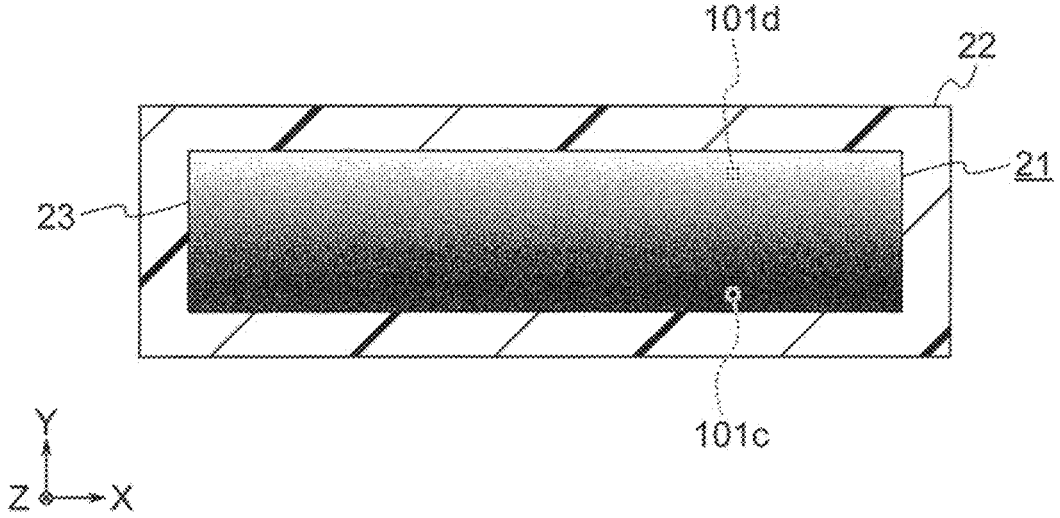
FIG. 97 is a sectional view for illustrating the suspension body for an elevator according to a forty-fifth embodiment of this invention.
Figure 98:
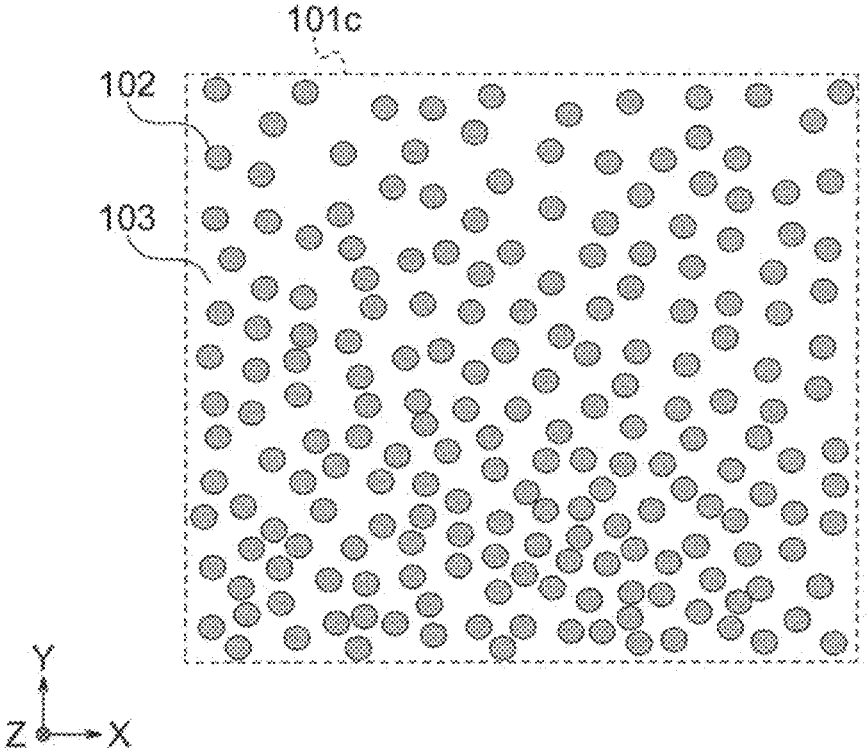
FIG. 98 is an enlarged sectional view for illustrating a portion 101*c* in FIG. 97.
Figure 99:
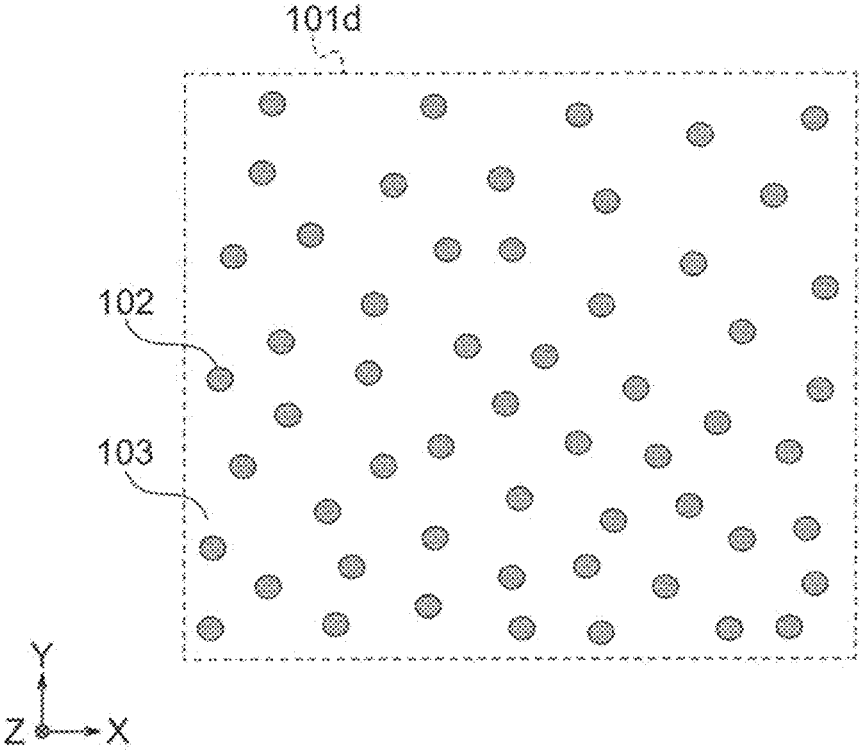
FIG. 99 is an enlarged sectional view for illustrating a portion 101*d* in FIG. 97.

Next, FIG. 97 is a sectional view for illustrating the suspension body for an elevator according to a forty-fifth embodiment of this invention. FIG. 98 is an enlarged sectional view for illustrating a portion 101*c* in FIG. 97. FIG. 99 is an enlarged sectional view for illustrating a portion 101*d* in FIG. 97. The portion 101*c* in FIG. 97 is located at the first end portion of the load bearing layer 23 in the thickness direction. Further, the portion 101*d* in FIG. 97 is located at the second end portion of the load bearing layer 23 in the thickness direction.

In the forty-fifth embodiment, the density of the high-strength fibers 102 in the first end portion of the load bearing layer 23 in the thickness direction is higher than the density of the high-strength fibers 102 in the second end portion of the load bearing layer 23 in the thickness direction. Further, the density of the high-strength fibers 102 decreases continuously from the first end portion toward the second end portion of the load bearing layer 23 in the thickness direction.

Further, it is preferred that, in a portion of the load bearing layer 23 having the highest density of the high-strength fibers 102, namely, the first end portion of the load bearing layer in the thickness direction, the volume content of the high-strength fibers 102 be set equal to or larger than 60%, more preferably, equal to or larger than 70%.

Further, it is preferred that, in a portion of the load bearing layer 23 having the lowest density of the high-strength fibers 102, namely, the second end portion of the load bearing layer in the thickness direction, the volume content of the high-strength fibers 102 be set equal to or smaller than 50%, more preferably, equal to or smaller than 40%. The other configurations and the other processes of the manufacturing method are the same as those of the forty-third embodiment.

With regard to this suspension body, the neutral plane in the cross section under bending can be shifted, thereby being capable of improving readiness of bending.

In order to vary the density of the high-strength fibers 102 as described in the forty-fifth embodiment, the same method as that of the forty-fourth embodiment may be applied.

Forty-Sixth Embodiment

Figure 100:
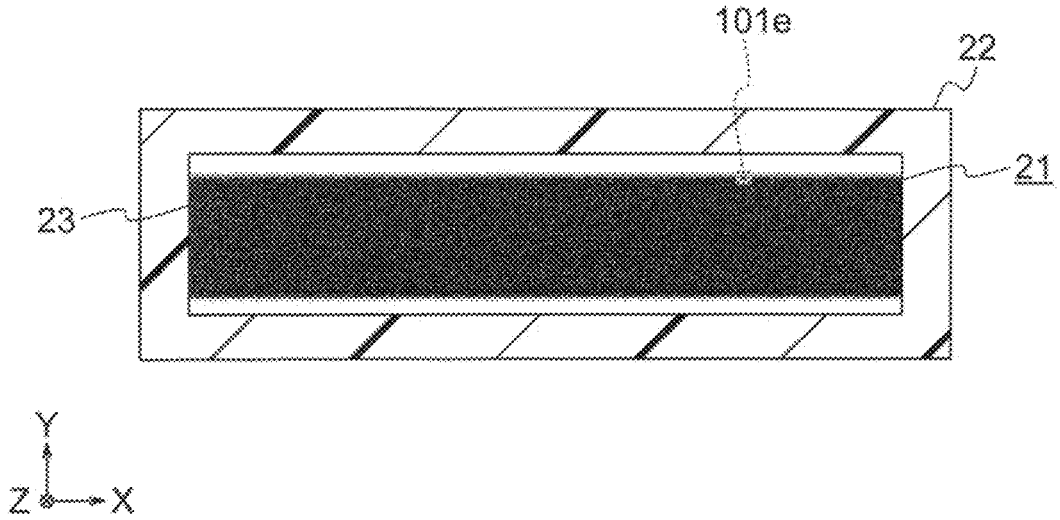
FIG. 100 is a sectional view for illustrating the suspension body for an elevator according to a forty-sixth embodiment of this invention.
Figure 101:
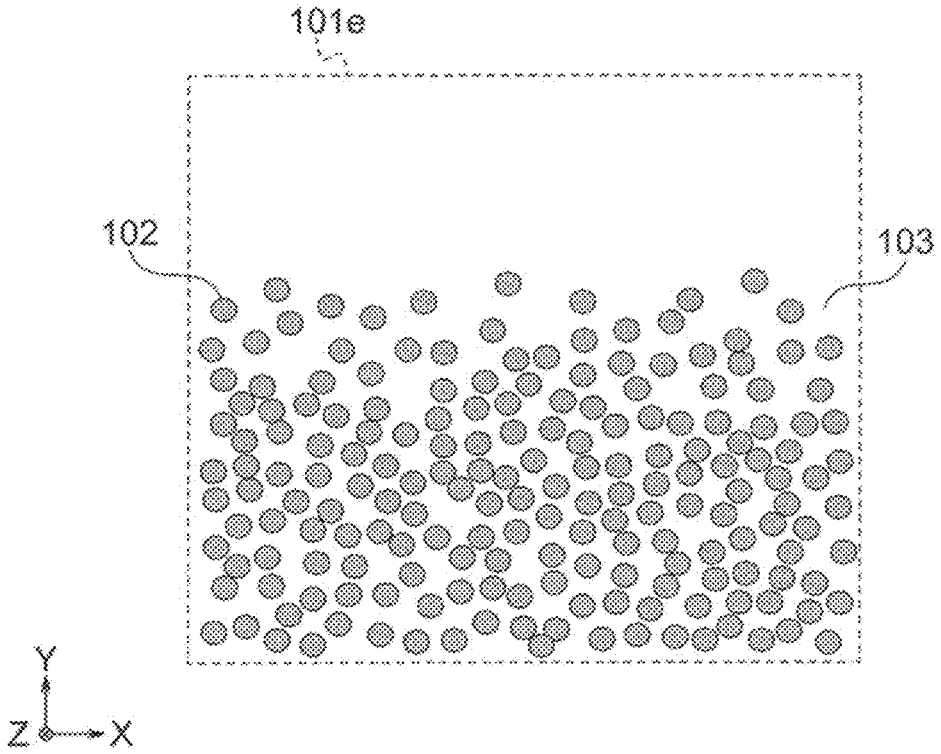
FIG. 101 is an enlarged sectional view for illustrating a portion 101*e* in FIG. 100.

Next, FIG. 100 is a sectional view for illustrating the suspension body for an elevator according to a forty-sixth embodiment of this invention. FIG. 101 is an enlarged sectional view for illustrating a portion 101*e* in FIG. 100. The portion 101*e* in FIG. 100 is located at the end portion of the load bearing layer 23 in the thickness direction.

In the forty-sixth embodiment, the density of the high-strength fibers 102 in the center portion of the load bearing layer 23 in the thickness direction is higher than the density of the high-strength fibers 102 in each end portion of the load bearing layer 23 in the thickness direction. Further, a layer including only the impregnation resin 103 is formed in each end portion of the load bearing layer 23 in the thickness direction. The other configurations and the other processes of the manufacturing method are the same as those of the forty-third embodiment or the forty-fourth embodiment.

Even with this configuration of the suspension body, bendability can be improved. Further, the layer including only the impregnation resin 103 is present on the surface of the load bearing layer 23, thereby being capable of improving adhesiveness with respect to the covering layer 22. With this configuration, occurrence of separation between the load bearing layer 23 and the covering layer 22 due to bending can be suppressed.

The layer including only the impregnation resin 103 in the forty-sixth embodiment may be formed in the second end portion in the forty-fifth embodiment.

Further, in a portion other than the layer including only the impregnation resin 103, the density of the high-strength fibers 102 may be uniform in the thickness direction of the load bearing layer 23.

Forty-Seventh Embodiment

Figure 102:
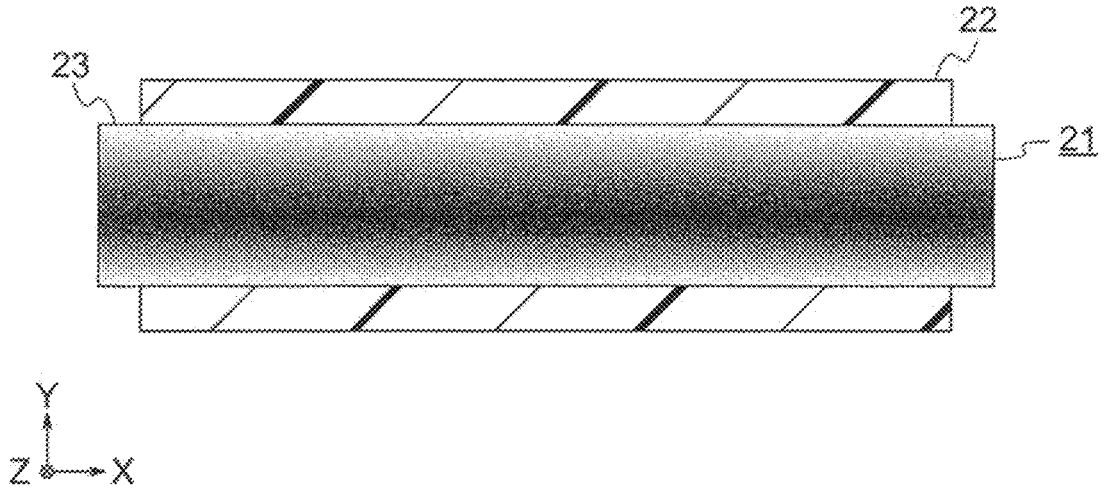
FIG. 102 is a sectional view for illustrating the suspension body for an elevator according to a forty-seventh embodiment of this invention.

Next, FIG. 102 is a sectional view for illustrating the suspension body for an elevator according to a forty-seventh embodiment of this invention. In the forty-seventh embodiment, the width dimension of the covering layer 22 is smaller than the width dimension of the load bearing layer 23. That is, the covering layer 22 covers only both surfaces of the load bearing layer 23 in the thickness direction, but does not cover both end surfaces of the load bearing layer 23 in the width direction.

With this configuration, both end portions of the core 21 in the width direction, namely, both end portions of the load bearing layer 23 in the width direction protrude from the covering layer 22 to the outside, and are exposed from the covering layer 22 to the outside. The other configurations and the other processes of the manufacturing method are the same as those of the forty-third embodiment.

With regard to this suspension body, an inspection for the load bearing layer 23 can be carried out directly from the both end portions of the load bearing layer 23 in the width direction.

The both end surfaces of the load bearing layer 23 in the width direction may be flush with both end surfaces of the covering layer 22 in the width direction, or may be retracted from the both end surfaces of the covering layer 22 in the width direction to the center side in the width direction.

Further, the configuration as described in the forty-seventh embodiment, in which both end portions of the core 21 in the width direction are exposed from the covering layer 22 to the outside, is applicable also to all other embodiments relating to the configuration of the suspension body.

Forty-Eighth Embodiment

Figure 103:
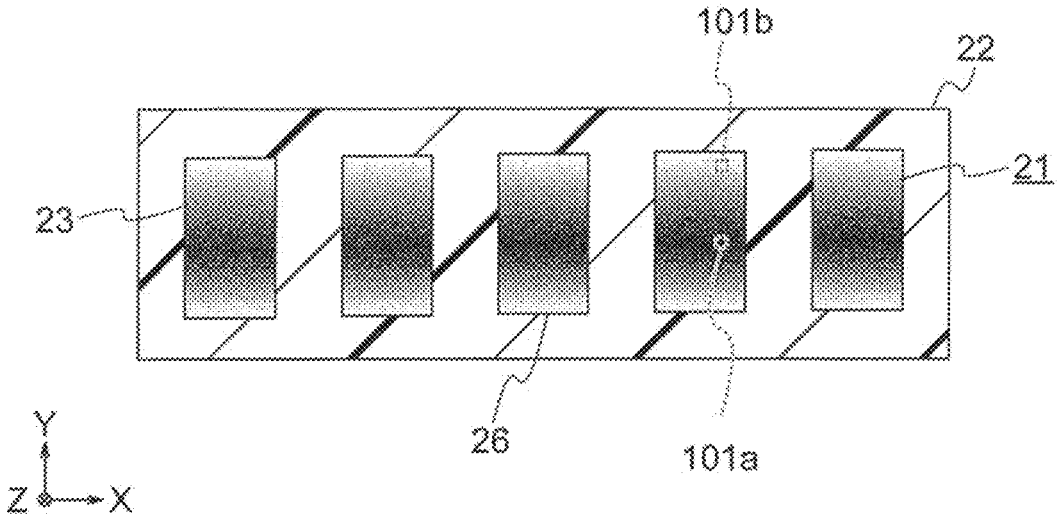
FIG. 103 is a sectional view for illustrating the suspension body for an elevator according to a forty-eighth embodiment of this invention.

Next, FIG. 103 is a sectional view for illustrating the suspension body for an elevator according to a forty-eighth embodiment of this invention. In the forty-eighth embodiment, the core 21 includes only the load bearing layer 23. Further, the core 21 is divided into the plurality of core segments 26. The core segments 26 are arranged apart from each other in the width direction of the core 21. The covering layer 22 enters a region between the adjacent core segments 26.

A density of the high-strength fibers in a center portion of each of the core segments 26 in the thickness direction (Y-axis direction) is higher than a density of the high-strength fibers in each end portion of each of the core segments 26 in the thickness direction. Further, the density of the high-strength fibers in each of the core segments 26 decreases continuously from the center portion toward each end portion in the thickness direction.

Further, it is preferred that, in a portion of the load bearing layer 23 having the highest density of the high-strength fibers 102, namely, the center portion of each of the core segments 26 in the thickness direction, a volume content of the high-strength fibers 102 be set equal to or larger than 60%, more preferably, equal to or larger than 70%.

Further, it is preferred that, in a portion of the load bearing layer 23 having the lowest density of the high-strength fibers 102, namely, each end portion of each of the core segments in the thickness direction, the volume content of the high-strength fibers 102 be set equal to or smaller than 50%, more preferably, equal to or smaller than 40%.

The sectional shape of each of the core segments 26 perpendicular to the length direction (Z-axis direction) is rectangular. The other configurations and the other processes of the manufacturing method are the same as those of the forty-third embodiment or the forty-fourth embodiment. The cross section of the portion 101*a* in FIG. 103 is the same as that in FIG. 91 or FIG. 95. The cross section of the portion 101*b* in FIG. 103 is the same as that in FIG. 92, FIG. 96, or FIG. 101.

With regard to this suspension body, the core 21 is divided into the core segments 26, and hence a size of equipment for manufacturing the load bearing layer 23 can be reduced.

Forty-Ninth Embodiment

Figure 104:
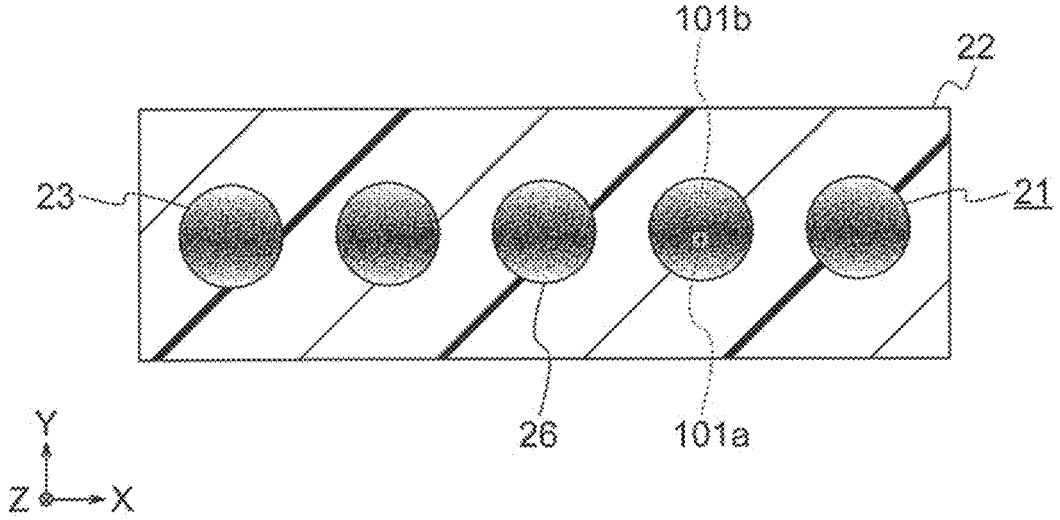
FIG. 104 is a sectional view for illustrating the suspension body for an elevator according to a forty-ninth embodiment of this invention.

Next, FIG. 104 is a sectional view for illustrating the suspension body for an elevator according to a forty-ninth embodiment of this invention. In the forty-ninth embodiment, the sectional shape of each of the core segments 26 is circular. The other configurations and the other processes of the manufacturing method are the same as those of the forty-eighth embodiment. The cross section of the portion 101*a* in FIG. 104 is the same as that in FIG. 91 or FIG. 95. The cross section of the portion 101*b* in FIG. 104 is the same as that in FIG. 92, FIG. 96, or FIG. 101.

With regard to this suspension body, in addition to an effect of enabling reduction in size of equipment for manufacturing the load bearing layer 23, there can be attained such an effect that stress concentration on corner portions of the cross section of each of the core segments 26 can be avoided. Thus, separation between the high-strength fibers can be suppressed.

Fiftieth Embodiment

Figure 105:
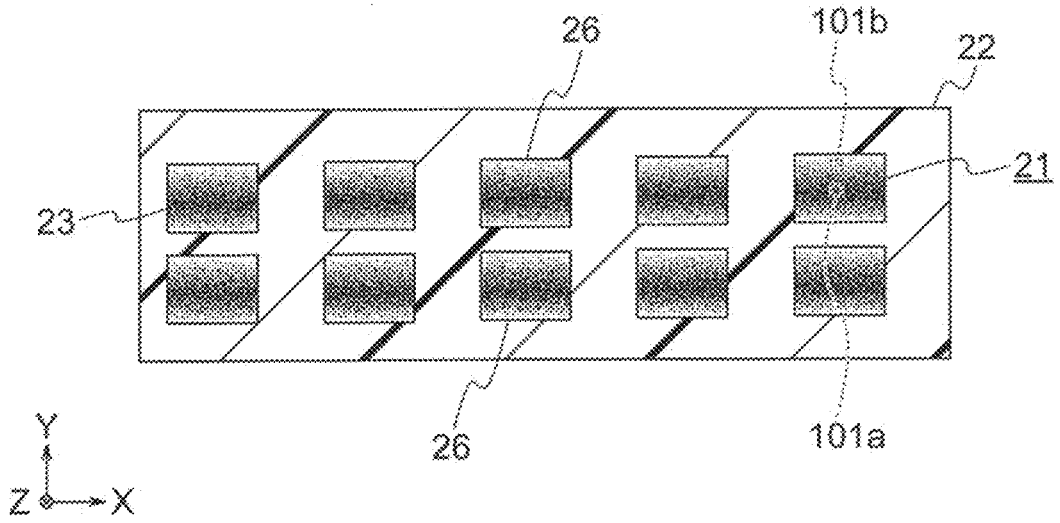
FIG. 105 is a sectional view for illustrating the suspension body for an elevator according to a fiftieth embodiment of this invention.

Next, FIG. 105 is a sectional view for illustrating the suspension body for an elevator according to a fiftieth embodiment of this invention. In the fiftieth embodiment, the core 21 is divided not only in the width direction but also in the thickness direction. With this configuration, the core segments 26 are arranged apart from each other in the width direction and the thickness direction of the core 21. The other configurations and the other processes of the manufacturing method are the same as those of the forty-eighth embodiment. The cross section of the portion 101*a* in FIG. 105 is the same as that in FIG. 91 or FIG. 95. The cross section of the portion 101*b* in FIG. 105 is the same as that in FIG. 92, FIG. 96, or FIG. 101.

With regard to this suspension body, the size of equipment for manufacturing the load bearing layer 23 can be further reduced. Further, the suspension body is more easily bent.

Fifty-First Embodiment

Figure 106:
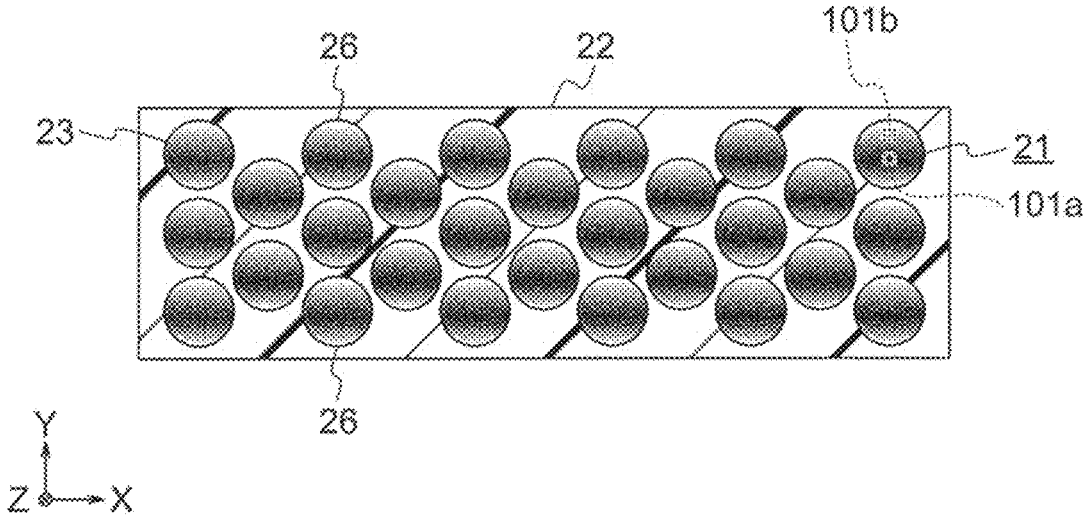
FIG. 106 is a sectional view for illustrating the suspension body for an elevator according to a fifty-first embodiment of this invention.

Next, FIG. 106 is a sectional view for illustrating the suspension body for an elevator according to a fifty-first embodiment of this invention. The core 21 in the fifty-first embodiment includes six first core segment rows and five second core segment rows. Each of the first core segment rows includes three core segments 26 aligned in the thickness direction of the core 21 (Y-axis direction). Further, the first core segment rows are arranged apart from each other in the width direction of the core 21 (X-axis direction).

The second core segment row is arranged between the adjacent first core segment rows. Each of the second core segment rows includes two core segments 26 aligned in the thickness direction of the core 21. The core segments 26 of the second core segment row are arranged so as to be staggered from the core segments 26 of the first core segment row in the thickness direction of the core 21.

The sectional shape of each of the core segments 26 is circular. The other configurations and the other processes of the manufacturing method are the same as those of the fiftieth embodiment. The cross section of the portion 101*a* in FIG. 106 is the same as that in FIG. 91 or FIG. 95. The cross section of the portion 101*b* in FIG. 106 is the same as that in FIG. 92, FIG. 96, or FIG. 101.

With regard to this suspension body, a larger number of the core segments 26 can be arranged. Thus, when the core segments 26 are used to form a single suspension body having the same strength, readiness of bending can be improved.

Fifty-Second Embodiment

Figure 107:
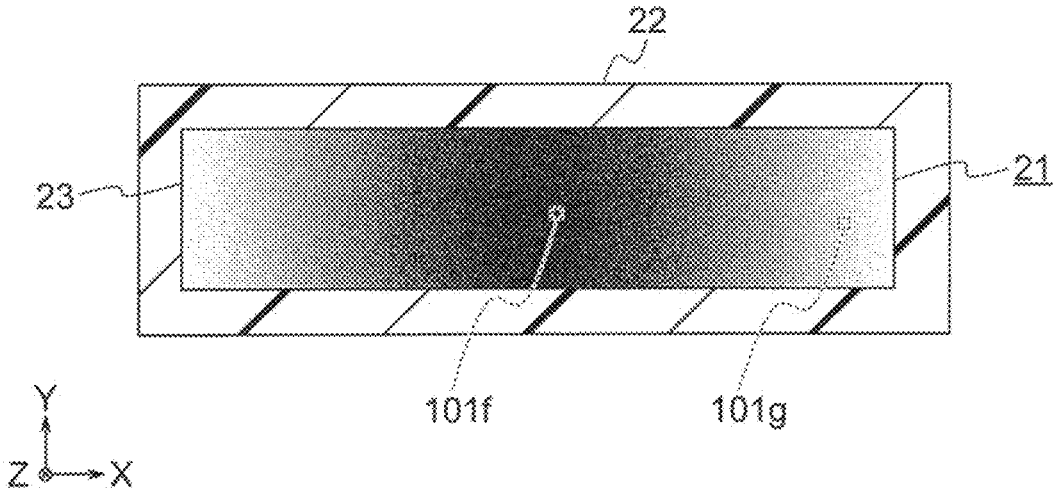
FIG. 107 is a sectional view for illustrating the suspension body for an elevator according to a fifty-second embodiment of this invention.
Figure 108:
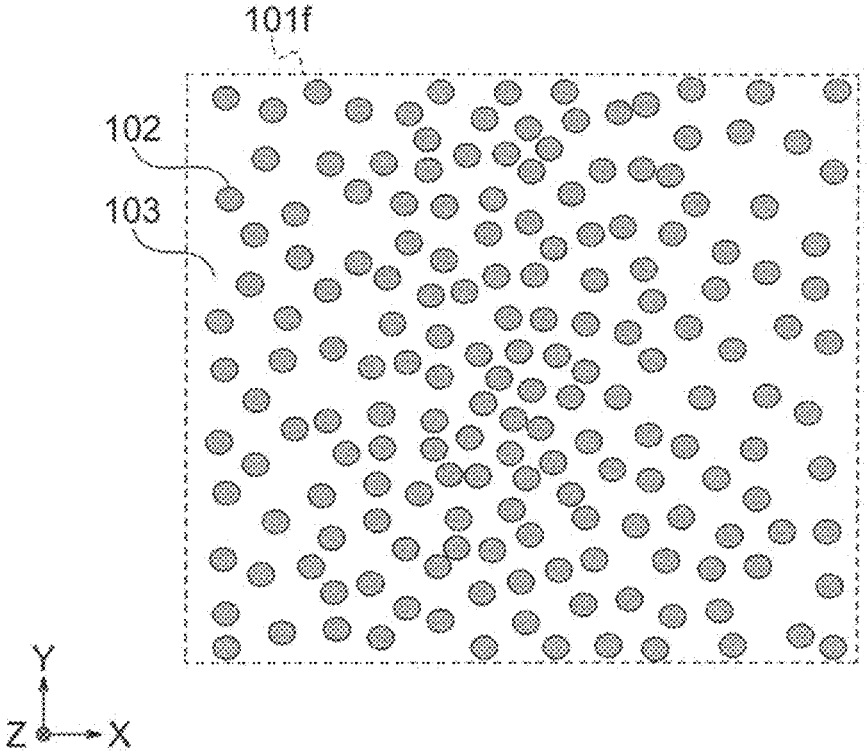
FIG. 108 is an enlarged sectional view for illustrating a portion 101*f* in FIG. 107.
Figure 109:
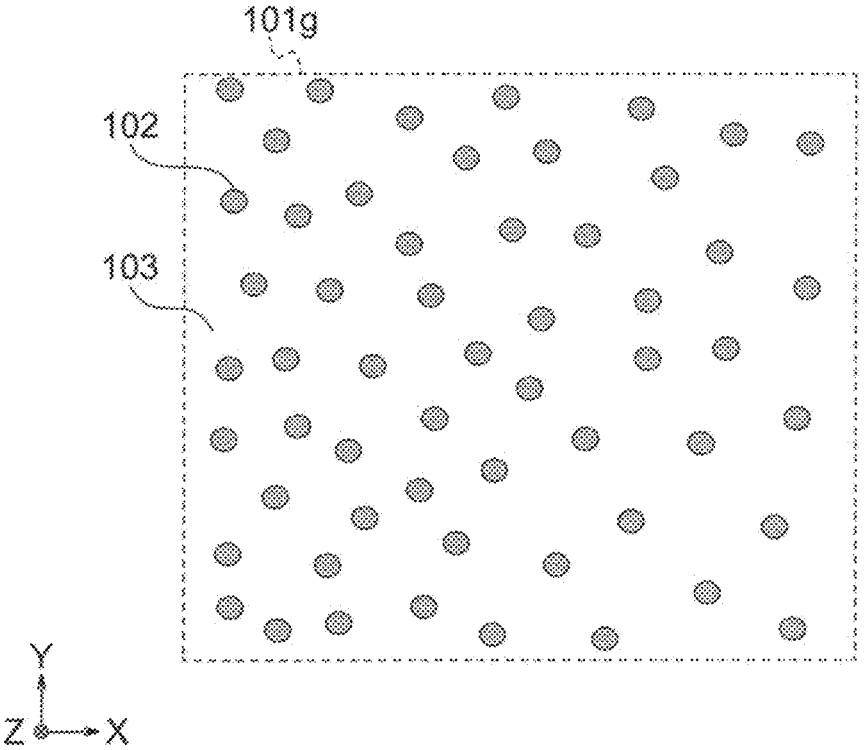
FIG. 109 is an enlarged sectional view for illustrating a portion 101*g* in FIG. 107.

Next, FIG. 107 is a sectional view for illustrating the suspension body for an elevator according to a fifty-second embodiment of this invention. FIG. 108 is an enlarged sectional view for illustrating a portion 101*f* in FIG. 107. FIG. 109 is an enlarged sectional view for illustrating a portion 101*g* in FIG. 107. The portion 101*f* in FIG. 107 is located at the center portion of the load bearing layer 23 in the width direction. Further, the portion 101*g* in FIG. 108 is located at the end portion of the load bearing layer 23 in the width direction.

In the fifty-second embodiment, the density of the high-strength fibers 102 in the center portion of the load bearing layer 23 in the width direction is higher than the density of the high-strength fibers 102 at each end portion of the load bearing layer 23 in the width direction. Further, the density of the high-strength fibers 102 decreases continuously from the center portion of the load bearing layer 23 in the width direction toward each end portion of the load bearing layer 23 in the width direction.

Further, it is preferred that, in a portion of the load bearing layer 23 having the highest density of the high-strength fibers 102, namely, the center portion of the load bearing layer 23 in the width direction, a volume content of the high-strength fibers 102 be set equal to or larger than 60%, more preferably, equal to or larger than 70%.

Further, it is preferred that, in a portion of the load bearing layer 23 having the lowest density of the high-strength fibers 102, namely, each end portion of the load bearing layer 23 in the width direction, the volume content of the high-strength fibers 102 be set equal to or smaller than 50%, more preferably, equal to or smaller than 40%. The other configurations and the other processes of the manufacturing method are the same as those of the forty-third embodiment.

With regard to this suspension body, rigidity of both end portions of the core 21 in the width direction is low, and hence the core 21 is easily bent with respect to the Z-axis. As a result, adhesiveness with respect to the driving sheave 6 is improved.

The fifty-second embodiment may be combined with the forty-third embodiment. That is, in the fifty-second embodiment, the density of the high-strength fibers 102 in each end portion of the load bearing layer 23 in the thickness direction may be set lower than the density of the high-strength fibers 102 in the center portion in the thickness direction.

Further, a layer including only the impregnation resin 103 may be formed in each end portion of the load bearing layer 23 in the width direction.

Fifty-Third Embodiment

Figure 110:
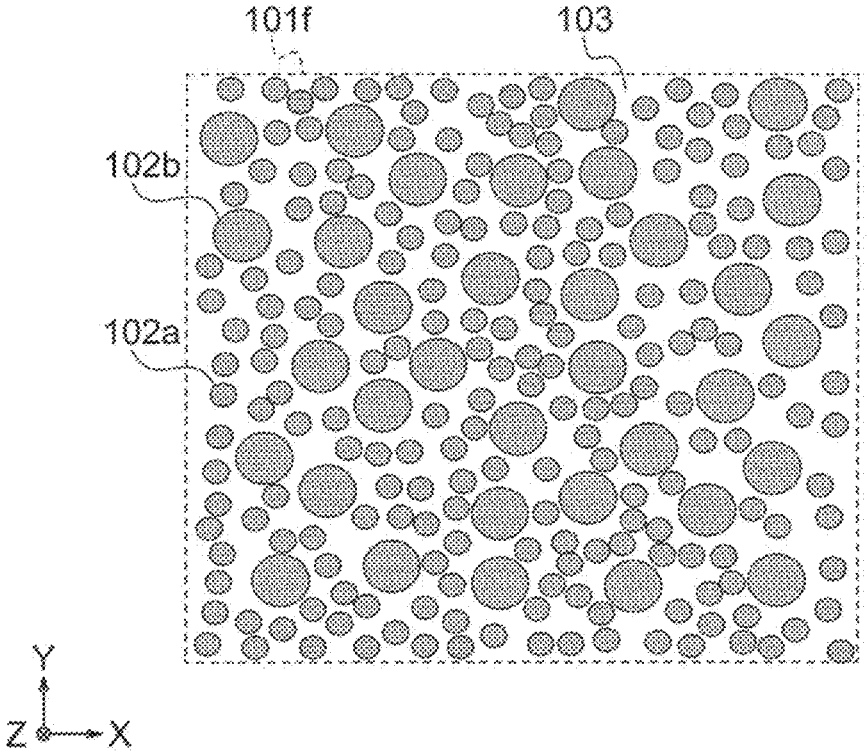
FIG. 110 is an enlarged sectional view for illustrating the center portion of the load bearing layer in a width direction thereof in a fifty-third embodiment of this invention.
Figure 111:
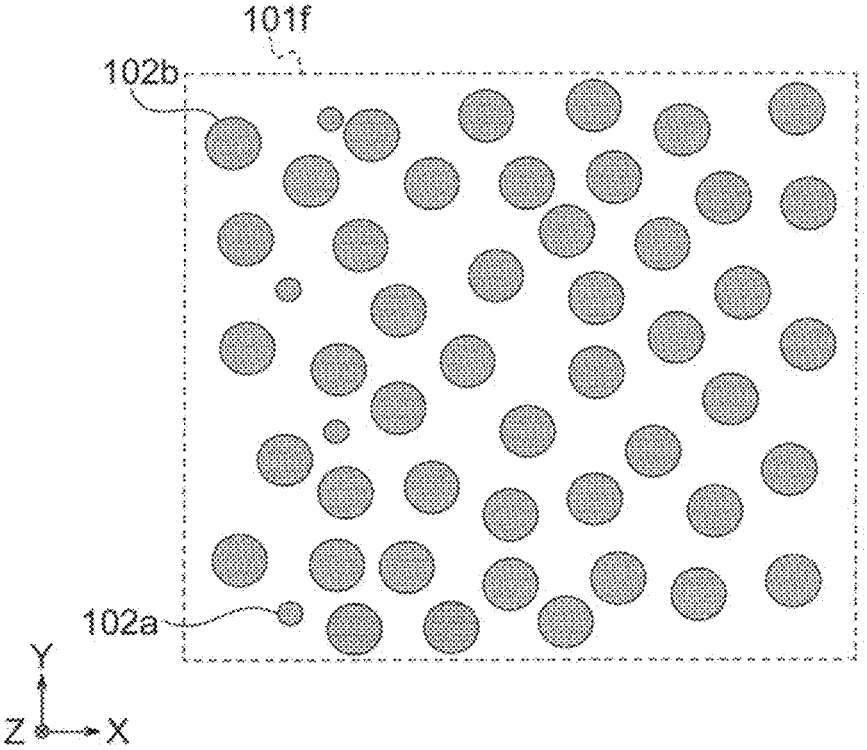
FIG. 111 is an enlarged sectional view for illustrating the end portion of the load bearing layer in the width direction in the fifty-third embodiment.

Next, FIG. 110 is an enlarged sectional view for illustrating the center portion of the load bearing layer 23 in the width direction in a fifty-third embodiment of this invention. FIG. 111 is an enlarged sectional view for illustrating the end portion of the load bearing layer 23 in the width direction in the fifty-third embodiment. The entire cross section of the suspension body is the same as that in FIG. 107.

In the fifty-third embodiment, in a manner similar to that in the forty-fourth embodiment, the density of the high-strength fibers 102 in the center portion of the load bearing layer 23 in the width direction is set higher than the density of the high-strength fibers 102 in each end portion of the load bearing layer 23 in the width direction. The other configurations and the other processes of the manufacturing method are the same as those of the fifty-second embodiment.

With regard to this suspension body, the high-strength fibers 102*a* and 102*b* having different sizes are used, and hence gathering of the high-strength fibers 102*a* and 102*b* is less liable to occur at the time of resin impregnation. Thus, the target density distribution can be achieved with better accuracy.

Fifty-Fourth Embodiment

Figure 112:
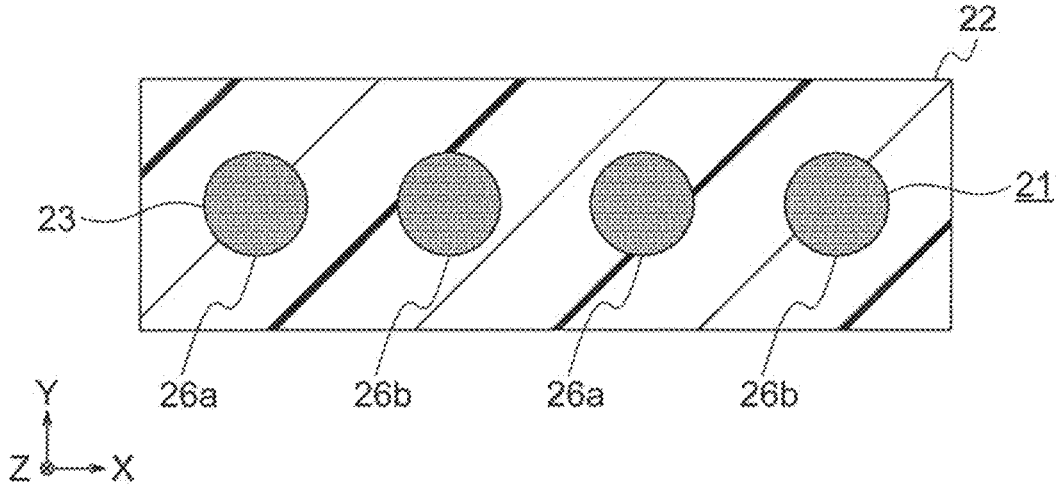
FIG. 112 is a sectional view for illustrating the suspension body for an elevator according to a fifty-fourth embodiment of this invention.

Next, FIG. 112 is a sectional view for illustrating the suspension body for an elevator according to a fifty-fourth embodiment of this invention. The core 21 in the fifty-fourth embodiment is divided into a plurality of first core segments 26*a* and a plurality of second core segments 26*b*. The sectional shape of each of the core segments 26*a* and 26*b* is circular. The core segments 26*a* and 26*b* have the same sectional area.

The high-strength fibers in each of the core segments 26*a* and 26*b* are arranged in a spirally twisted state. In order to spirally arrange the high-strength fibers, prior to forming of the core 21, it is only required to add a step of twisting a bundle of the high-strength fiber group in a circumferential direction thereof about a center of a cross section of the bundle perpendicular to the length direction.

Figure 113:
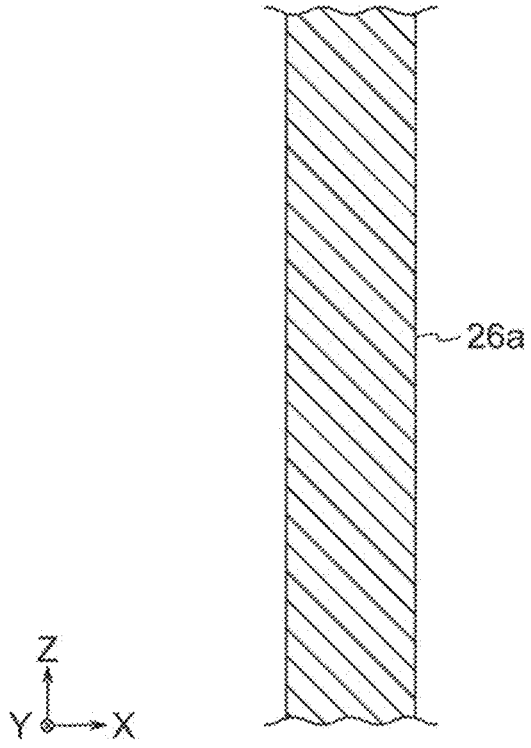
FIG. 113 is a plan view for illustrating a first core segment in FIG. 112.
Figure 114:
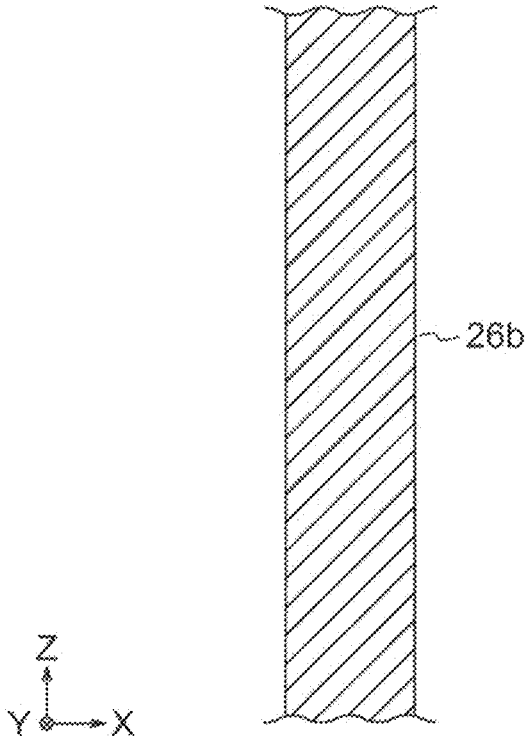
FIG. 114 is a plan view for illustrating a second core segment in FIG. 112.

FIG. 113 is a plan view for illustrating the first core segment 26*a* in FIG. 112. FIG. 114 is a plan view for illustrating the second core segment 26*b* in FIG. 112. As illustrated in FIG. 113 and FIG. 114, the high-strength fibers of the first core segment 26*a* and the high-strength fibers of the second core segment 26*b* are twisted in reverse directions.

Further, in FIG. 112, the first core segments 26*a* and the second core segments 26*b* are alternately arranged in the width direction of the core 21. The density of the high-strength fibers in the cross section of each of the core segments 26*a* and 26*b* perpendicular to the length direction may be uniform, or may decrease from the center portion to the radially outer side of each of the core segments. Further, a layer including only the impregnation resin may be formed on an outer periphery of each of the core segments 26*a* and 26*b*. The other configurations and the other processes of the manufacturing method are the same as those of the forty-ninth embodiment.

As described above, when the high-strength fibers are arranged in a spirally twisted state, strength and rigidity in an oblique direction can be improved, and the structure more resistant to torsion can be achieved.

In FIG. 112, the first core segments 26*a* and the second core segments 26*b* are alternately arranged. However, the first core segments 26*a* may be arranged on one side in the width direction with respect to the center of the core 21 in the width direction, and the second core segments 26*b* may be arranged on another side in the width direction. It is preferred that the number of the first core segments 26*a* and the number of the second core segments 26*b* be the same.

Fifty-Fifth Embodiment

Figure 115:
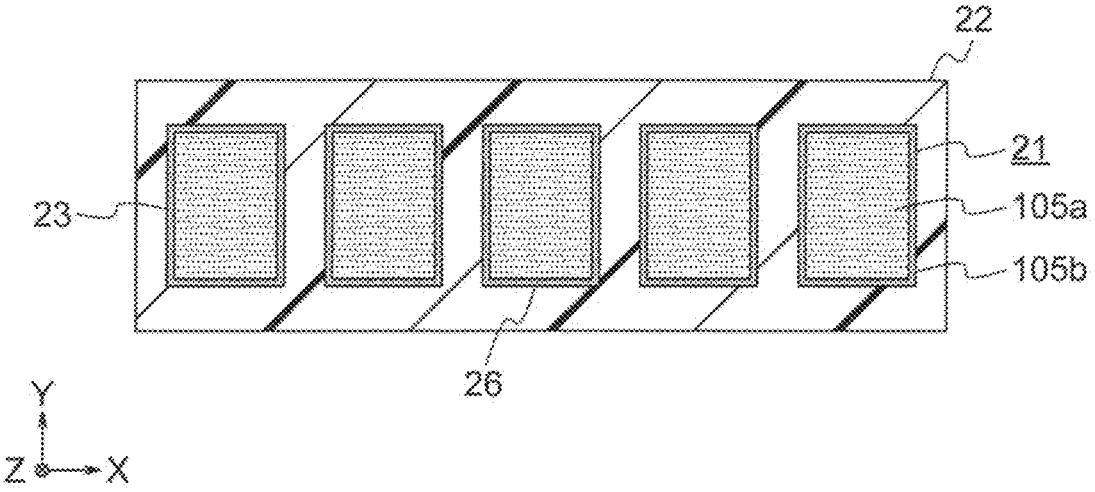
FIG. 115 is a sectional view for illustrating the suspension body for an elevator according to a fifty-fifth embodiment of this invention.
Figure 116:
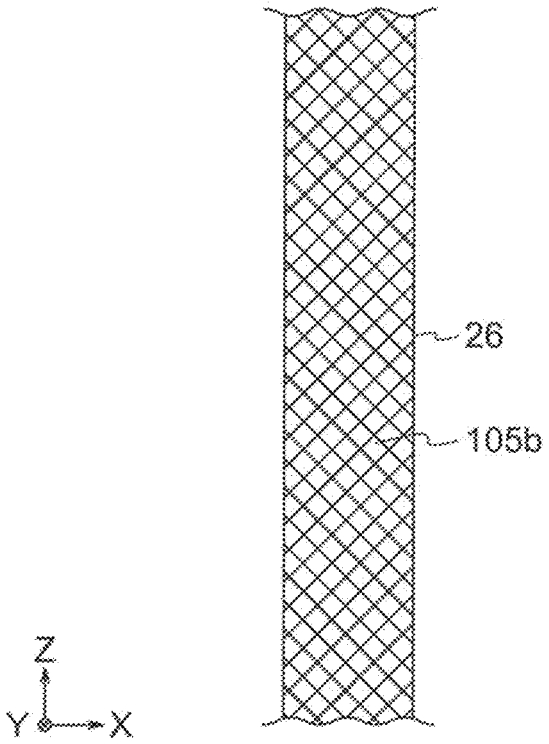
FIG. 116 is a plan view for illustrating the core segment in FIG. 115.

Next, FIG. 115 is a sectional view for illustrating the suspension body for an elevator according to a fifty-fifth embodiment of this invention. FIG. 116 is a plan view for illustrating the core segment 26 in FIG. 115.

In the fifty-fifth embodiment, the high-strength fibers in an inner portion 105*a* of the load bearing layer 23 in each of the core segments 26 are arranged in parallel to the length direction of the core 21. The density of the high-strength fibers in the inner portion 105*a* may be uniform, or may be varied as in any of the above-mentioned embodiments.

Further, the high-strength fibers in an outer peripheral portion 105*b* of the load bearing layer 23 in each of the core segments 26 are arranged in a direction crossing the length direction of the core 21. In this example, the high-strength fibers in the outer peripheral portion 105*b* are arranged in a fabric form. That is, the high-strength fibers in the outer peripheral portion 105*b* are arranged obliquely to the length direction of the core 21. The other configurations and the other processes of the manufacturing method are the same as those of the forty-eighth embodiment.

A main function of the load bearing layer 23 is to bear the load in the Z-axis direction, and hence the high-strength fibers in the inner portion 105*a* occupying a large part of the sectional area are arranged along the Z-axis direction. Meanwhile, the high-strength fibers are arranged on the surface of the load bearing layer 23 in a fabric form.

Thus, according to the configuration in the fifty-fifth embodiment, strength in the oblique direction can be improved. Further, the high-strength fibers in the inner portion 105*a* aligned in one direction are wrapped with the high-strength fibers arranged in a fabric form, thereby being capable of performing manufacturing steps while integrating the entire high-strength fibers. In this manner, forming becomes relatively easier.

Fifty-Sixth Embodiment

Figure 117:
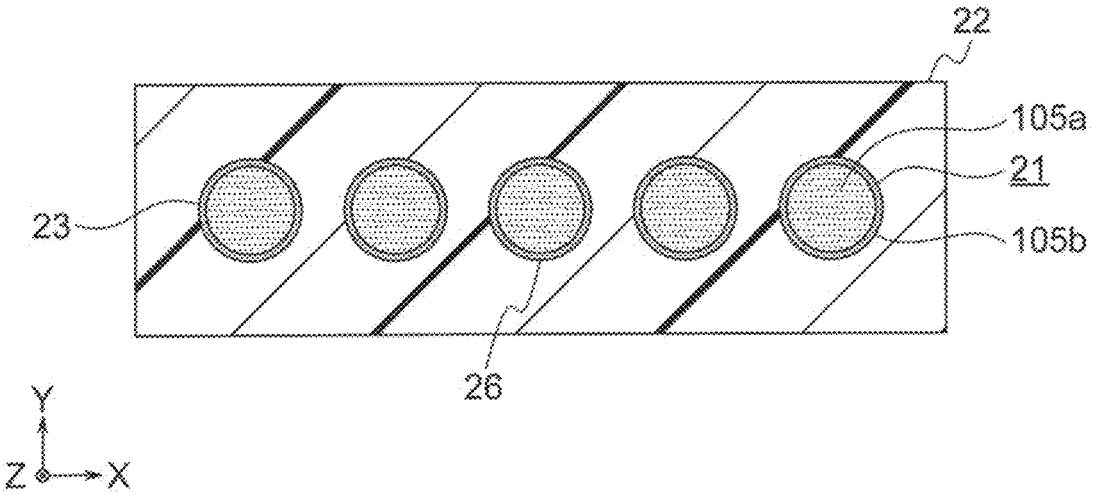
FIG. 117 is a sectional view for illustrating the suspension body for an elevator according to a fifty-sixth embodiment of this invention.

Next, FIG. 117 is a sectional view for illustrating the suspension body for an elevator according to a fifty-sixth embodiment of this invention. In the fifty-sixth embodiment, the sectional shape of each of the core segments 26 in the fifty-fifth embodiment is formed into a circular shape. The other configurations and the other processes of the manufacturing method are the same as those of the fifty-fifth embodiment.

With regard to this suspension body, stress concentration on corner portions of the cross section of each of the core segments 26 can be avoided. Thus, separation between the high-strength fibers can be suppressed.

The high-strength fibers in the inner portion 105*a* of each of the core segments 26 in the fifty-sixth embodiment may be arranged in a spirally twisted state as in the fifty-fourth embodiment.

Fifty-Seventh Embodiment

Figure 118:
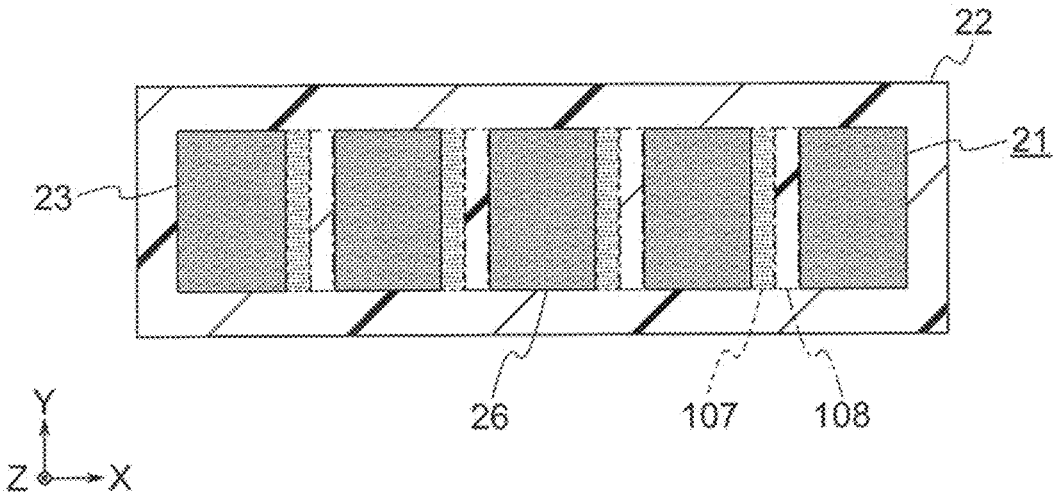
FIG. 118 is a sectional view for illustrating the suspension body for an elevator according to a fifty-seventh embodiment of this invention.

Next, FIG. 118 is a sectional view for illustrating the suspension body for an elevator according to a fifty-seventh embodiment of this invention. In the fifty-seventh embodiment, a first resin layer 107 and a second resin layer 108 are interposed between the adjacent core segments 26. The first resin layer 107 is made of the same material as that for the impregnation resin of the load bearing layer 23. The second resin layer 108 is made of the same material as that for the covering layer 22.

When the suspension body is manufactured, a first plate made of the same material as that for the impregnation resin, and a second plate made of the same material as that for the covering layer 22 are continuously arranged between the adjacent core segments 26 along the length direction of the core segments 26. Then, the core segments 26, the first plate, and the second plate are integrated with each other, thereby forming the first resin layer 107 and the second resin layer 108.

The density of the high-strength fibers in each of the core segments 26 may be uniform, or may be varied as in any of the above-mentioned embodiments. The other configurations and the other processes of the manufacturing method are the same as those of the forty-eighth embodiment.

With regard to this suspension body, the core segments 26 are integrated with each other through intermediation of the first and second resin layers 107 and 108. Thus, the core 21 is easily bent in a direction of rotating about the Z-axis, and the suspension body easily comes into intimate contact with the surface of the driving sheave 6.

The core segments 26 in the fifty-seventh embodiment may be formed in a manner similar to that in the fifty-fifth embodiment.

Fifty-Eighth Embodiment

Figure 119:
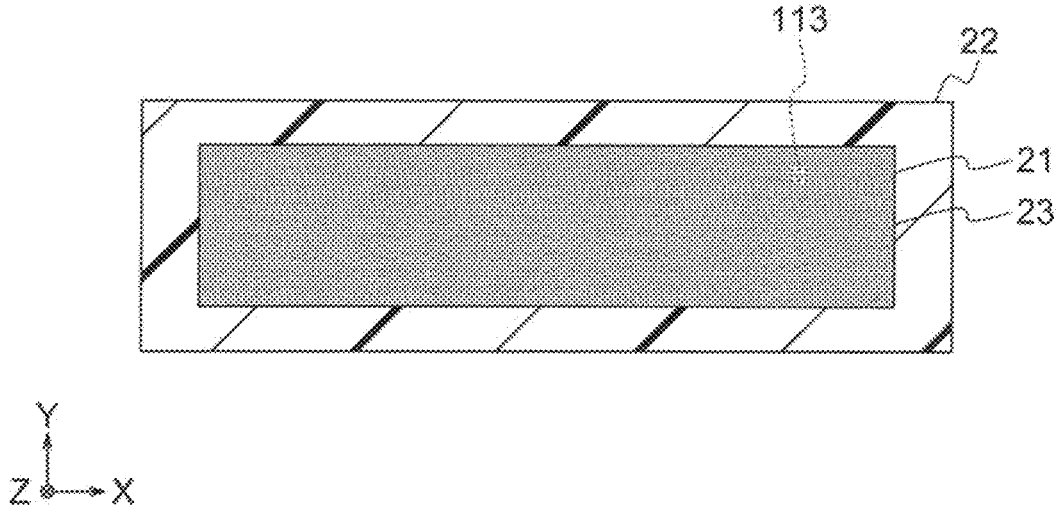
FIG. 119 is a sectional view for illustrating the suspension body for an elevator according to a fifty-eighth embodiment of this invention.
Figure 120:
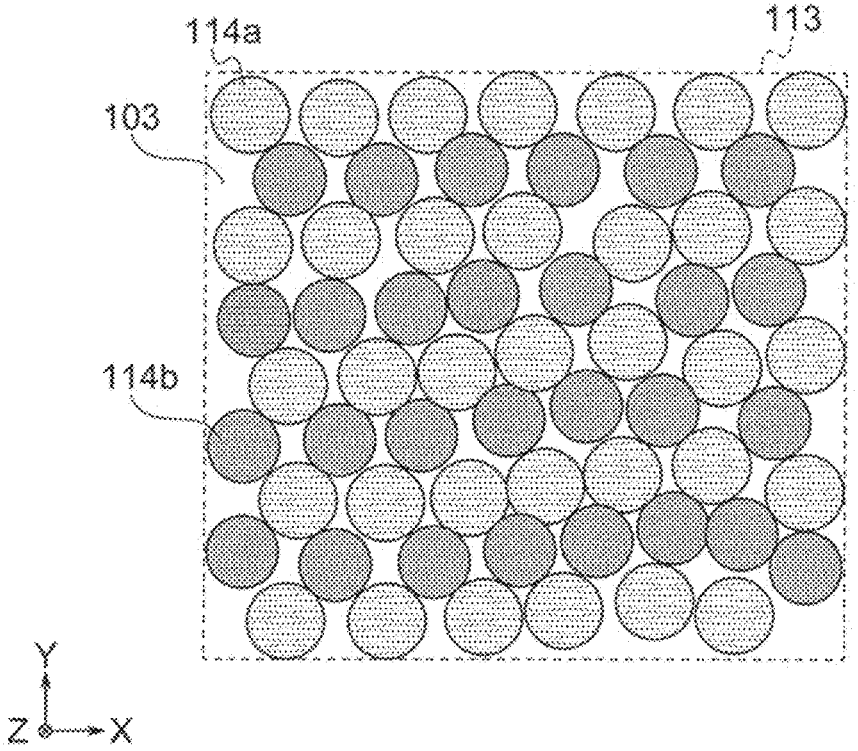

Next, FIG. 119 is a sectional view for illustrating the suspension body for an elevator according to a fifty-eighth embodiment of this invention. FIG. 120 is an enlarged sectional view for illustrating a portion 113 in FIG. 119. The core 21 in the fifty-eighth embodiment includes only the load bearing layer 23. The load bearing layer 23 includes the impregnation resin 103, a plurality of first high-strength fiber bundles 114*a*, and a plurality of second high-strength fiber bundles 114*b*. The first and second high-strength fiber bundles 114*a* and 114*b* are arranged along the length direction of the core 21.

Figure 121:
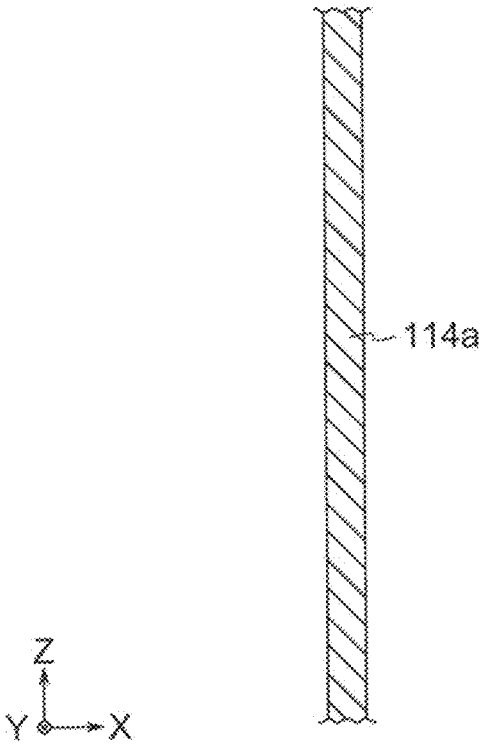
Figure 122:
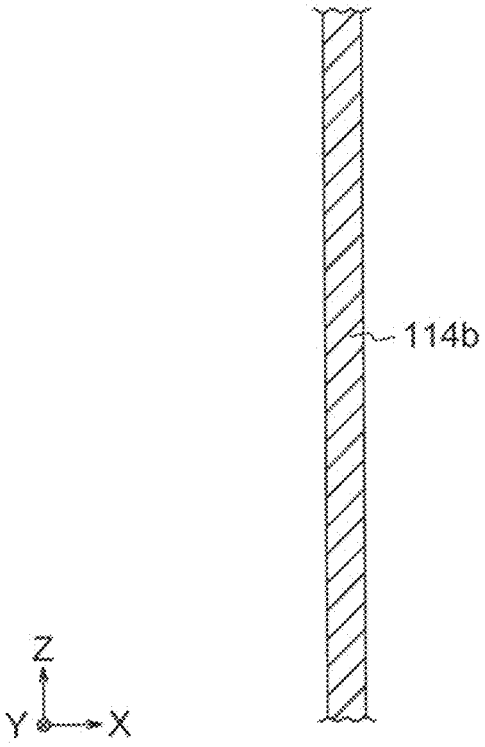

FIG. 121 is a plan view for illustrating the first high-strength fiber bundle 114*a* in FIG. 119. FIG. 122 is a plan view for illustrating the second high-strength fiber bundle 114*b* in FIG. 119. In each of the high-strength fiber bundles 114*a* and 114*b*, the plurality of high-strength fibers are arranged in a spirally twisted state. The high-strength fibers of the first high-strength fiber bundle 114*a* and the high-strength fibers of the second high-strength fiber bundle 114*b* are twisted in reverse directions.

Further, it is preferred that the number of the first high-strength fiber bundles 114*a* and the number of the second high-strength fiber bundles 114*b* be the same. Further, it is preferred that the first high-strength fiber bundles 114*a* and the second high-strength fiber bundles 114*b* be evenly distributed in the cross section perpendicular to the length direction of the core 21. In the example in FIG. 120, layers including the first high-strength fiber bundles 114*a* and layers including the second high-strength fiber bundles 114*b* are alternately arranged in the thickness direction of the core 21.

The suspension body according to the fifty-eighth embodiment can be manufactured through winding of the high-strength fiber bundles 114*a* and 114*b*, which are twisted in advance, around the plurality of bobbins illustrated in FIG. 93. Further, the suspension body according to the fifty-eighth embodiment can also be manufactured by twisting the high-strength fiber bundles paid out from the plurality of bobbins, and then gathering the high-strength fiber bundles. In this case, the high-strength fiber bundles may be twisted through rotation of the bobbins. The other configurations and the other processes of the manufacturing method are the same as those of the forty-third embodiment.

With regard to this suspension body, the high-strength fibers are arranged also obliquely to the length direction of the core 21, and hence strength against torsional deformation can be improved.

Further, the first and second high-strength fiber bundles 114*a* and 114*b* are twisted in different directions, and hence strength of the suspension body against torsional deformation in the both directions can be improved.

Further, the impregnation resin 103 is interposed between the first high-strength fiber bundle 114*a* and the second high-strength fiber bundle 114*b* adjacent to each other, and hence the first high-strength fiber bundle 114*a* and the second high-strength fiber bundle 114*b* are less liable to come into contact with each other. However, even when the high-strength fiber bundles 114*a* and 114*b* are impregnated with the impregnation resin 103, the high-strength fiber bundles 114*a* and 114*b* partially come into contact with each other in some cases. Further, the suspension body applied to the elevator is repeatedly bent, with the result that fatigue is caused in the impregnation resin 103 and the first high-strength fiber bundle 114*a* and the second high-strength fiber bundle 114*b* come into contact with each other.

As described above, when the first high-strength fiber bundle 114*a* and the second high-strength fiber bundle 114*b* come into contact with each other, the high-strength fibers in the respective surfaces come into contact with each other in a parallel or almost parallel state without crossing each other. Thus, contact stress generated on the high-strength fibers in the surfaces can be reduced, thereby being capable of improving fatigue resistance and strength.

All of the high-strength fiber bundles may be twisted in the same direction.

Further, the untwisted high-strength fiber bundle or high-strength fibers, and the twisted high-strength fiber bundle may be mixed together.

Further, the core 21 in the fifty-eighth embodiment may be divided into the plurality of core segments 26 as illustrated in FIG. 103, FIG. 104, FIG. 105, or FIG. 106.

Further, when the core 21 in the fifty-eighth embodiment is divided into the plurality of core segments 26, each of the core segments 26 may be twisted as illustrated in FIG. 112, or the high-strength fibers in a fabric form may be arranged on the outer peripheral portion 105*b* as illustrated in FIG. 115 or FIG. 117. Alternatively, the first and second resin layers 107 and 108 may be interposed between the core segments 26 as illustrated in FIG. 118.

REFERENCE SIGNS LIST

6 driving sheave, 7 suspension body, 8 car (ascending/descending body), 9 counterweight (ascending/descending body), 21 core, 22 covering layer, 23 load bearing layer, 24 intermediate layer, 25 segment layer, 26 core segment, 27, 28, 29 deformation suppressing member, 31 outermost layer (outer bearing layer), 32 innermost layer (outer bearing layer), 33 intermediate bearing layer, 34, 102 high-strength fiber, 41 end holding device, 44 shaft, 46*a* arc, 51 high-strength fiber layer, 52 low-elasticity fiber layer, 53, 70 laminated body, 54 high-strength fiber fabric, 71, 74 unidirectional FRP plate, 72 intermediate-layer thermoplastic sheet, 73 covering-layer thermoplastic sheet, 102*a* first high-strength fiber, 102*b* second high-strength fiber, 103 impregnation resin, 105*a* inner portion, 105*b* outer peripheral portion, 107 first resin layer, 108 second resin layer, 111, 112 high-strength fiber group

The invention claimed is:

1. A suspension body for an elevator, comprising:

a core having a belt-like shape and including a load bearing layer formed of an impregnation resin and a plurality of high-strength fibers; and a covering layer covering at least a part of an outer periphery of the core, wherein a density of the high-strength fibers in a first center portion of the load bearing layer in a thickness direction of the load bearing layer is higher than a density of the high-strength fibers in both end portions of the load bearing layer in the thickness direction, or a density of the high-strength fibers in a second center portion of the load bearing layer in a width direction of the load bearing layer is higher than a density of the high-strength fibers in both end portions of the load bearing layer in the width direction.

2. The suspension body for an elevator according to claim 1, wherein tensile rigidity of the first center portion of the load bearing layer is higher than that of the both end portions of the load bearing layer in the thickness direction.

3. The suspension body for an elevator according to claim 1, wherein in the first center portion of the load bearing layer a volume content of the high-strength fibers is equal to or larger than 60%, and wherein in the both end portions of the load bearing layer in the thickness direction, a volume content of the high-strength fibers is equal to or smaller than 50%.

4. The suspension body for an elevator according to claim 1, wherein the Young's modulus of the impregnation resin is set equal to or lower than 1.5 GPa and equal to or higher than 0.1 GPa.

5. The suspension body for an elevator according to claim 1, wherein the first center portion of the load bearing layer in the thickness direction is located on a side closer to a contact surface with a driving sheave around which the suspension body is wound than to a neutral axis of the suspension body in the thickness direction.

6. The suspension body for an elevator according to claim 1, wherein the plurality of high-strength fibers include a plurality of kinds of high-strength fibers having different diameters, and wherein a number of the high-strength fibers having smaller diameters in the both end portions of the load bearing layer in the thickness direction is reduced as compared with that in the first center portion of the load bearing layer.

7. The suspension body for an elevator according to claim 1, wherein the density of the high-strength fibers decreases continuously from the first center portion toward the both end portions of the load bearing layer in the thickness direction.

8. An elevator, comprising:

a car; and the suspension body of claim 1, which is configured to suspend the car.

9. A suspension body for an elevator, comprising:

a core including a load bearing layer formed of an impregnation resin and a plurality of high-strength fibers; and a covering layer covering at least a part of an outer periphery of the core, wherein the core is divided into a plurality of core segments arranged apart from each other, each of the core segments being made of the load bearing layer, wherein the covering layer enters a region between the core segments adjacent to each other, and wherein a density of the high-strength fibers in a center portion of each of the core segments in a thickness direction of each of the core segments is higher than a density of the high-strength fibers in both end portions of each of the core segments in the thickness direction.

10. The suspension body for an elevator according to claim 9, wherein the core segments are arranged apart from each other in a width direction of the core.

11. The suspension body for an elevator according to claim 9, wherein the core segments are arranged apart from each other in a width direction and the thickness direction.

12. The suspension body for an elevator according to claim 9, wherein tensile rigidity of the center portion of each of the core segments in the thickness direction is higher than that of the both end portions of each of the core segments in the thickness direction.

13. The suspension body for an elevator according to claim 9, wherein in the center portion of each of the core segments in the thickness direction, a volume content of the high-strength fibers is equal to or larger than 60%, and wherein in the both end portions of each of the core segments in the thickness direction, a volume content of the high-strength fibers is equal to or smaller than 50%.

14. The suspension body for an elevator according to claim 9, wherein the Young's modulus of the impregnation resin is set equal to or lower than 1.5 GPa and equal to or higher than 0.1 GPa.

15. The suspension body for an elevator according to claim 9, wherein the density of the high-strength fibers decreases continuously from the center portion toward the both end portions.

16. An elevator, comprising:

a car; and the suspension body of claim 9, which is configured to suspend the car.

* * * * *